US010401035B2

(12) United States Patent
Pionek et al.

(10) Patent No.: US 10,401,035 B2
(45) Date of Patent: Sep. 3, 2019

(54) VERTICALLY MOUNTED GAS COOKTOP CONTROL KNOB

(71) Applicant: Wolf Appliance, Inc., Fitchburg, WI (US)

(72) Inventors: Jason C. Pionek, Madison, WI (US); Mark R. Eckert, Verona, WI (US); Curtis Leroy Cruver, IV, Elmhurst, IL (US); William Cesare Cesaroni, Glenview, IL (US); Curt P. Vitcenda, Edgerton, WI (US); Patrick W. Best, Mount Horeb, WI (US)

(73) Assignee: WOLF APPLIANCE, INC., Fitchburg, WI (US)

( * ) Notice: Subject to any disclaimer, the term of this patent is extended or adjusted under 35 U.S.C. 154(b) by 698 days.

(21) Appl. No.: 15/040,078

(22) Filed: Feb. 10, 2016

(65) Prior Publication Data

US 2017/0227231 A1 Aug. 10, 2017

(51) Int. Cl.

| | |
|---|---|
| ***F24C 7/08*** | (2006.01) |
| ***F24C 3/12*** | (2006.01) |
| ***G05G 1/10*** | (2006.01) |

(52) U.S. Cl.

CPC ..... *F24C 3/124* (2013.01); *G05G 1/105* (2013.01)

(58) Field of Classification Search

CPC ..... G01B 7/003; G01B 6/0096; F24C 7/082; F24C 7/08; F24C 3/122

USPC ..... 126/1 R, 4, 27, 37 A, 37 R, 52, 39 A, 126/39 E, 39 N, 211, 217, 190, 194

See application file for complete search history.

(56) References Cited

U.S. PATENT DOCUMENTS

| | | | |
|---|---|---|---|
| 2,682,859 | A | 7/1954 | Jensen et al. |
| 2,699,141 | A | 1/1955 | Gaguski |
| 2,998,733 | A | 9/1961 | Thompson |
| D194,137 | S | 11/1962 | Jenn |
| D266,348 | S | 9/1982 | Piesco |
| D316,293 | S | 4/1991 | Ragonot |
| D324,807 | S | 3/1992 | Reid et al. |
| D369,940 | S | 5/1996 | Wilsdorf |
| 5,936,613 | A | 8/1999 | Jaeger et al. |
| D419,218 | S | 1/2000 | Mullenmeister |
| 6,079,401 | A | 6/2000 | Alvord et al. |
| D493,090 | S | 7/2004 | Chen et al. |

(Continued)

FOREIGN PATENT DOCUMENTS

| | | |
|---|---|---|
| EP | 2659190 | 9/2014 |

*Primary Examiner* — Gregory A Wilson

(74) *Attorney, Agent, or Firm* — Bell & Manning, LLC

(57) ABSTRACT

A knob assembly for a gas cooktop is provided that includes a receptacle mounted between a valve and a knob. The knob directly mounts to a knob control rod and is configured to mount in a vertical plane perpendicular to a plane defined by a horizontal support surface for a cooking receptacle. The receptacle includes a receptacle abutment wall, a receptacle wall extending from the receptacle abutment wall, and a control rod aperture wall formed through the receptacle abutment wall. The control rod aperture wall is sized and positioned to support insertion of the knob control rod therethrough. The receptacle abutment wall is configured to abut a back of a control panel when the knob assembly is mounted to the control panel. The receptacle wall is sized and positioned within a knob aperture wall formed through the control panel when the knob assembly is mounted to the control panel.

20 Claims, 40 Drawing Sheets

(56) References Cited

U.S. PATENT DOCUMENTS

D498,657 S 11/2004 Milrud et al.
D509,095 S 9/2005 Grutzke et al.
D509,987 S 9/2005 Vetter
D511,290 S 11/2005 Coudurier
D525,517 S 7/2006 Baldwin
D534,628 S 1/2007 Chisenhall
7,171,727 B2 * 2/2007 Wylie ..... F24C 7/082 16/441
7,251,861 B2 8/2007 Suzuki
7,259,908 B2 8/2007 Wagener et al.
D568,715 S 5/2008 Gustafson et al.
7,381,128 B2 6/2008 Ogawa et al.
D578,890 S 10/2008 Swanson et al.
7,462,795 B2 12/2008 Montalvo
D597,632 S 8/2009 Obara et al.
D631,726 S 2/2011 Sanchez
7,967,005 B2 * 6/2011 Parrish ..... A47J 37/0713 126/39 N
D644,912 S 9/2011 Benold
D645,702 S 9/2011 Baacke et al.
D649,004 S 11/2011 Sanchez
8,430,460 B2 4/2013 Erro et al.
D696,068 S 12/2013 Baacke
8,613,276 B2 * 12/2013 Parrish ..... A47J 37/0713 126/1 R
D697,359 S 1/2014 Meda et al.
8,662,102 B2 * 3/2014 Shaffer ..... F24C 3/124 126/52
D704,028 S 5/2014 Meda et al.
D724,381 S 3/2015 Pionek et al.
D724,382 S 3/2015 Pionek et al.
D724,888 S 3/2015 Lee et al.
8,979,289 B2 * 3/2015 Camli ..... F24C 7/082 362/23.09
9,146,033 B2 9/2015 Cadima et al.
D741,454 S 10/2015 Freier et al.
D752,385 S 3/2016 Pionek et al.
D752,386 S 3/2016 Pionek et al.
D764,028 S 8/2016 Schoenherr et al.
D779,262 S 2/2017 Kim et al.
D781,126 S 3/2017 Pionek et al.
D806,512 S 1/2018 Chow et al.
10,114,405 B2 * 10/2018 Swayne ..... G05G 1/082
2014/0047943 A1 2/2014 Camli et al.
2017/0227231 A1 8/2017 Pionek et al.
2018/0238552 A1 * 8/2018 Ha ..... G05G 1/12
2018/0238554 A1 * 8/2018 Ha ..... F24C 3/124

* cited by examiner

VERTICALLY MOUNTED GAS COOKTOP CONTROL KNOB

BACKGROUND

A gas cooktop may be mounted on top of a counter. The knobs that control operation of the cooktop gas burners are arranged in a control knob panel. Typically, the control knob panel is mounted along a side of the cooktop or in a corner of the cooktop and in a plane that is parallel to the counter on which the cooktop is mounted.

SUMMARY

In an example embodiment, a knob assembly is provided. The knob assembly may include, but is not limited to, a valve, a knob, and a receptacle mounted between the valve and the knob. The valve may include, but is not limited to, a valve housing, an input gas port mounted to the valve housing and configured to connect to an input gas line to receive gas, an output gas port mounted to the valve housing, and a knob control rod extending from the valve housing and configured to control a gas flow from the input gas port to the output gas port when the knob control rod is rotated and when the input gas port is connected to an input gas line. The knob directly mounts to the knob control rod such that the knob control rod rotates with the knob when the knob is rotated to control a flame from a cooktop burner positioned below a horizontal support surface for a cooking receptacle. The knob is configured to mount in a vertical plane that is perpendicular to a plane defined by the horizontal support surface for the cooking receptacle. The receptacle may include, but is not limited to, a receptacle abutment wall, a receptacle wall extending from the receptacle abutment wall, and a control rod aperture wall formed through the receptacle abutment wall. The control rod aperture wall is sized and positioned to support insertion of the knob control rod therethrough. The receptacle abutment wall is configured to abut a back panel face of a control panel when the knob assembly is mounted to the control panel. The receptacle wall is sized and positioned within a knob aperture wall formed through the control panel when the knob assembly is mounted to the control panel.

In another example embodiment, a gas cooktop is provided. The gas cooktop may include, but is not limited to, a housing, a grate, a burner, an input gas line, and the knob assembly. The housing may include, but is not limited to, one or more walls. The grate is mounted between the one or more walls of the housing. The grate forms a horizontal support surface for a cooking receptacle. The burner is mounted below the grate within the one or more walls of the housing.

In yet another example embodiment, a method of installing a gas cooktop is provided. The method may include, but is not limited to, mounting the receptacle to the valve of the gas cooktop, positioning the gas cooktop within an opening formed in a counter top by inserting the receptacle wall into a knob aperture wall of a control panel until the receptacle abutment wall or a spacer that abuts the receptacle abutment wall abuts a back panel face of the control panel, and mounting the knob directly to the knob control rod such that the knob control rod rotates with the knob when the knob is rotated to control the flame from the burner of the gas cooktop. The knob aperture wall is formed through the control panel in a horizontal direction that is parallel to the horizontal support surface of the grate of the gas cooktop. The control panel is mounted perpendicular to the horizontal support surface.

Other principal features of the disclosed subject matter will become apparent to those skilled in the art upon review of the following drawings, the detailed description, and the appended claims.

BRIEF DESCRIPTION OF THE DRAWINGS

Illustrative embodiments of the disclosed subject matter will hereafter be described referring to the accompanying drawings, wherein like numerals denote like elements.

DETAILED DESCRIPTION

Figure 1:
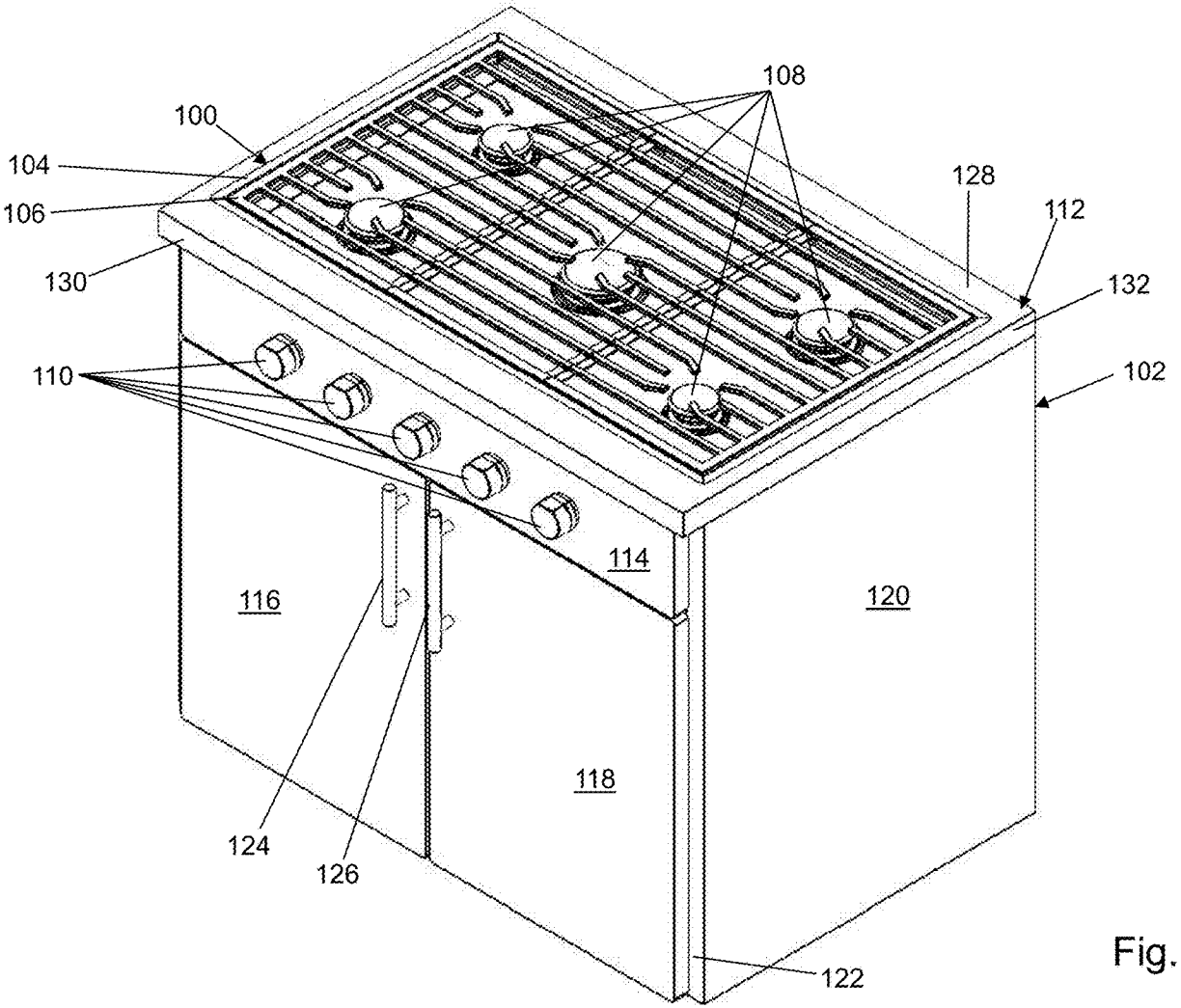
FIG. 1 depicts a top, front perspective view of a cooktop mounted to a cabinet in accordance with an illustrative embodiment.
Figure 2:
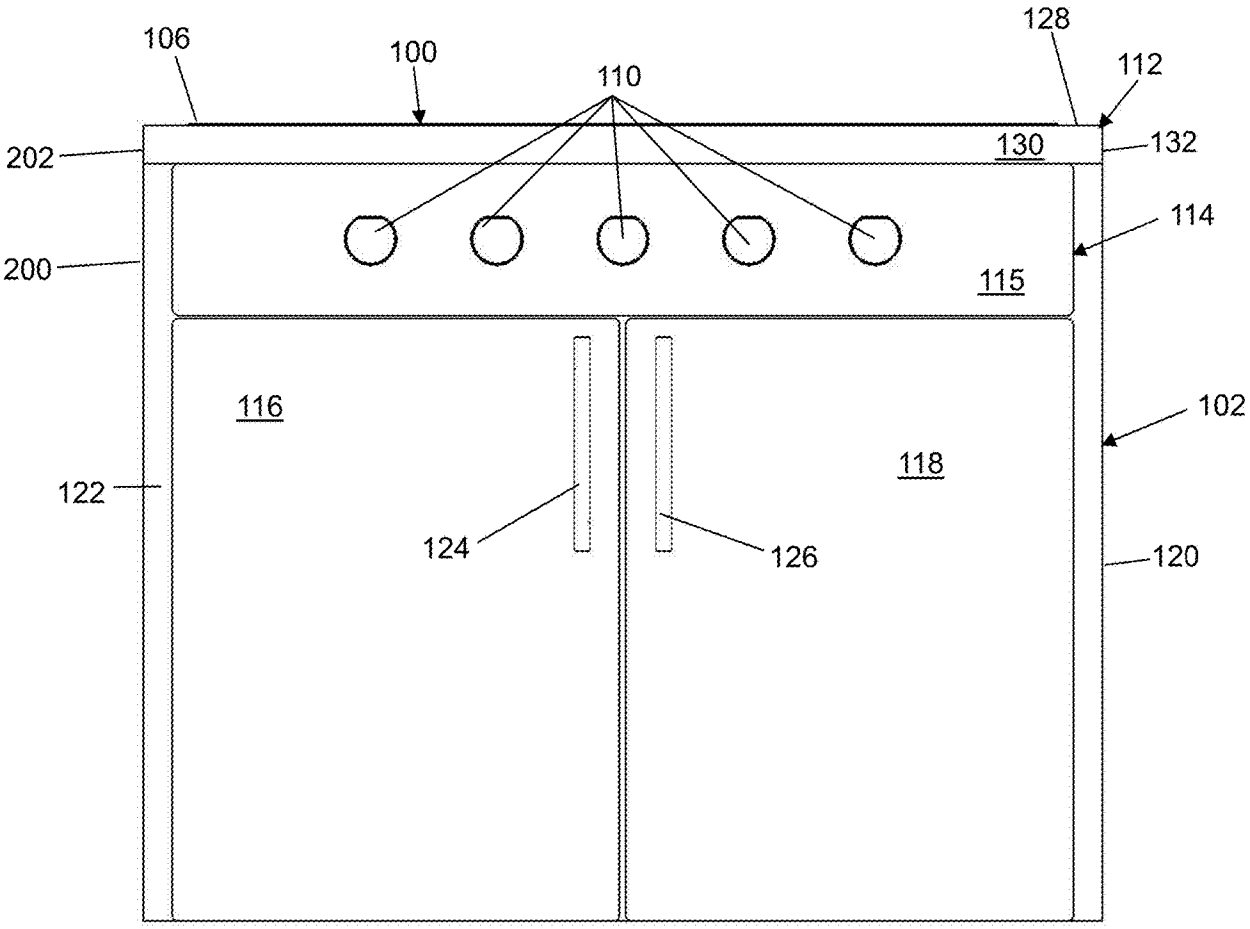
FIG. 2 depicts a front view of the cooktop of FIG. 1 in accordance with an illustrative embodiment.
Figure 3:
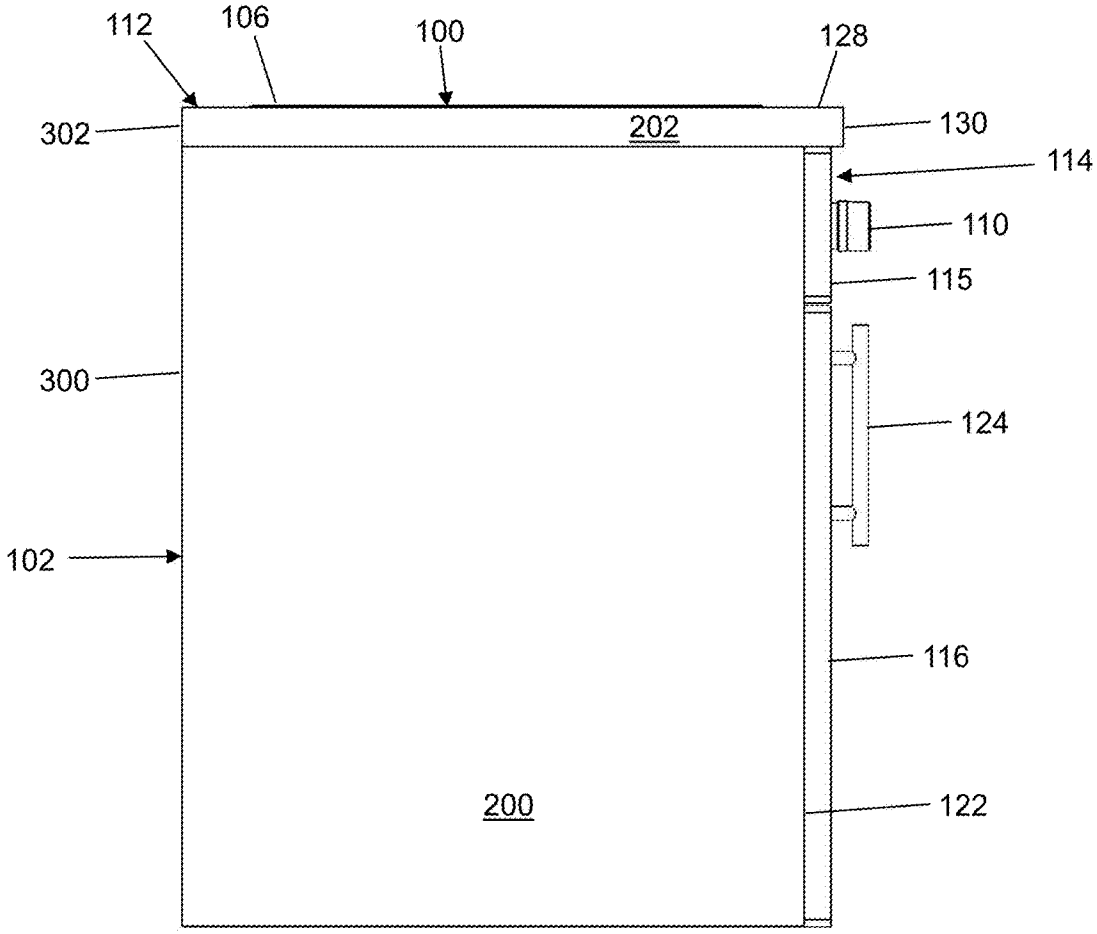
FIG. 3 depicts a left view of the cooktop of FIG. 1 in accordance with an illustrative embodiment.

Referring to FIG. 1, a top, front perspective view of a cooktop 100 is shown in accordance with an illustrative embodiment. Referring to FIG. 2, a front side view of cooktop 100 is shown in accordance with an illustrative embodiment. Referring to FIG. 3, a left side view of cooktop 100 is shown in accordance with an illustrative embodiment. With reference to FIGS. 1, 2, and 3, cooktop 100 is mounted on a cabinet 102 shown in accordance with an illustrative embodiment. Cooktop 100 mounted on a cabinet 102 may be located indoors or outdoors. For example, cabinet 102 may be coordinated with surrounding cabinets in an indoor or outdoor kitchen. Cooktop 100 may be purchased separately and installed into cabinet 102.

Cooktop 100 may include a cooktop mounting flange 104, a grate 106, a plurality of burners 108, and a plurality of control knobs 110. A control knob of the plurality of control knobs 110 controls a respective burner of the plurality of burners 108. There may be a fewer or a greater number of the plurality of control knobs 110 and the plurality of burners 108. The plurality of control knobs 110 are mounted vertically with respect to the plurality of burners 108.

As used herein, the term "mount" includes join, unite, connect, couple, associate, insert, hang, hold, affix, attach, fasten, bind, paste, secure, hinge, bolt, screw, rivet, solder, weld, glue, form over, form in, layer, mold, rest on, rest against, abut, and other like terms. The phrases "mounted on", "mounted to", and equivalent phrases indicate any interior or exterior portion of the element referenced. These phrases also encompass direct mounting (in which the referenced elements are in direct contact) and indirect mounting (in which the referenced elements are not in direct contact, but are connected through an intermediate element) unless specified otherwise. Elements referenced as mounted to each other herein may further be integrally formed together, for example, using a molding or thermoforming process as understood by a person of skill in the art. As a result, elements described herein as being mounted to each other need not be discrete structural elements unless specified otherwise. The elements may be mounted permanently, removably, or releasably unless specified otherwise.

Use of directional terms, such as top, bottom, right, left, front, back, upper, lower, horizontal, vertical, behind, etc. are merely intended to facilitate reference to the various surfaces of the described structures relative to the orientations introduced in the drawings and are not intended to be limiting in any manner unless otherwise indicated.

Grate 106 mounts to cooktop mounting flange 104 and extends over the plurality of burners 108 to support various cooking receptacles as understood by a person of skill in the art. Grate 106 may have various prong designs.

The plurality of burners 108 provide a flame to heat the various cooking receptacles placed on grate 106. The burners may be single or multiple level burners, such as a dual stack burner. Merely for illustration, each burner may be implemented similar to the stacked dual gas burner described in U.S. Pat. No. 6,322,354, which issued Nov. 27, 2001, to Wolf Appliance Inc., the assignee of the present application. Other gas burner designs may be used. The plurality of burners 108 may be arranged in manners other than that shown in the illustrative embodiment of FIGS. 1-3. For example, cooktop 100 may include a greater or a fewer number of the plurality of burners 108.

Cooktop 100 may include a greater or a fewer number of components. The one or more components of cooktop 100 may be formed of one or more materials, such as various metals, glass, and/or plastics having a sufficient strength and rigidity as well as thermal and permeability properties sufficient to support the described application.

Figure 5:
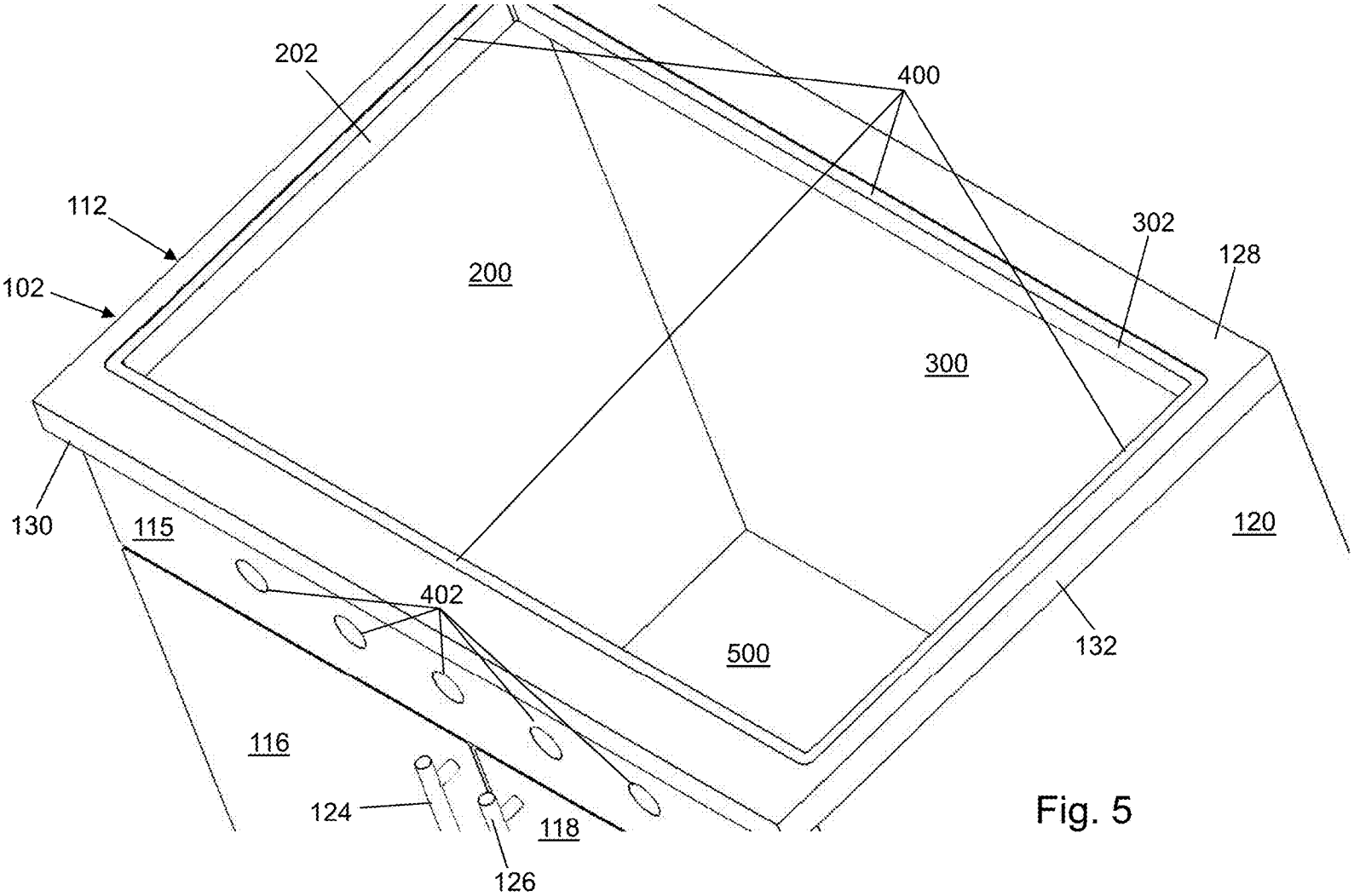
FIG. 5 depicts a top perspective view of the cabinet to which the cooktop of FIG. 1 is mounted in accordance with an illustrative embodiment.

Cabinet 102 may include a counter top 112, a control panel 114, a left door 116, a right door 118, a left side wall 200, a right side wall 120, a front wall 122, a back wall 300, and a bottom wall 500 (shown with reference to FIG. 5). An opening formed in a counter top 112 is sized to accept cooktop 100. Cooktop mounting flange 104 supports cooktop 100 within the opening formed in counter top 112. The plurality of control knobs 110 is mounted to control panel 114 in a horizontal row though the plurality of control knobs 110 may be arranged in other manners. For example, the plurality of control knobs 110 may be arranged to form a plurality of horizontal rows and may be distributed more closely or further apart. Control panel 114 is mounted to a top portion of front wall 122 just below counter top 112. Control panel 114 is mounted perpendicular to counter top 112 and grate 106 so that the plurality of control knobs 110 are arranged vertically with respect to grate 106, which provides a generally horizontal support surface for the various cooking receptacles. Control panel 114 may be part of cabinet 102 and may be sold or built separately from cooktop 100 so that control panel 114 is modified to accommodate the plurality of control knobs 110 as part of the installation of cooktop 100 on cabinet 102.

Left door 116 and right door 118 are mounted to front wall 122 below control panel 114. A left handle 124 is mounted to left door 116 on a right edge to facilitate opening of left door 116. A right handle 126 is mounted to right door 118 on a left edge to facilitate opening of right door 118. Counter top 112, left side wall 200, right side wall 120, front wall 122, back wall 300, and bottom wall 500 define an enclosed cabinet space when left door 116 and right door 118 are closed. One or more doors may be mounted to left side wall 200, right side wall 120, and/or back wall 300, in the alternative, or in addition to front wall 122, to provide access to the enclosed cabinet space. The cabinet space provides a storage area below cooktop 100. The cabinet space may not be enclosed on all sides.

Counter top 112 is mounted on left side wall 200, right side wall 120, front wall 122, and back wall 300. Counter top 112 may include a counter top surface 128, a left counter top wall 202, a front counter top wall 130, a right counter top wall 132, and a back counter top wall 302. Counter top surface 128 extends between left counter top wall 202, front counter top wall 130, right counter top wall 132, and back counter top wall 302. As shown with reference to the illustrative embodiments of FIGS. 2 and 3, cooktop mounting flange 104 is mounted approximately level with or below counter top surface 128. A top edge of grate 106 extends above counter top surface 128 though grate 106 could be positioned level with, above, or below counter top surface 128.

Figure 4:
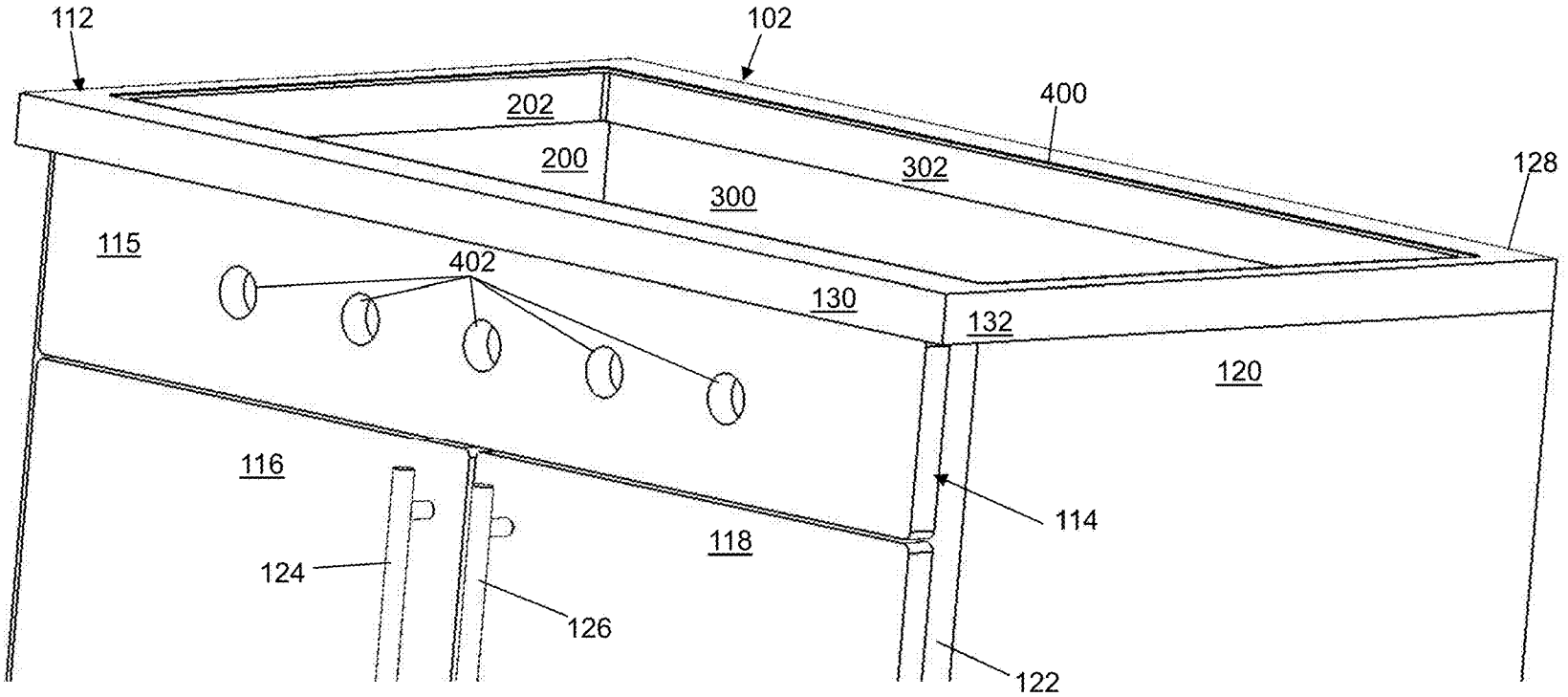
FIG. 4 depicts a front perspective view of the cabinet to which the cooktop of FIG. 1 is mounted in accordance with an illustrative embodiment.

Referring to FIG. 4, a front perspective view of cabinet 102 is shown in accordance with an illustrative embodiment. Referring to FIG. 5, a top perspective view of cabinet 102 is shown in accordance with an illustrative embodiment. Referring to FIGS. 4 and 5, cabinet 102 is shown without cooktop 100 in accordance with an illustrative embodiment. Counter top 112 includes an opening within which cooktop 100 is mounted. A platform 400 is cut into counter top surface 128 a desired depth so that cooktop mounting flange 104 is mounted approximately level with, above, or below counter top surface 128 possibly depending on a preferred aesthetic of a consumer of cooktop 100. Cooktop mounting flange 104 of cooktop 100 is mounted on platform 400 of cabinet 102. For example, platform 400 is sized and shaped to support cooktop mounting flange 104.

Control panel 114 of cabinet 102 may include knob aperture walls 402. The knob aperture walls 402 extend horizontally through control panel 114 towards an interior of cabinet 102 between a front panel face 115 and a back panel face 2604 (shown referring to FIG. 26). A position of each knob aperture wall of the knob aperture walls 402 is selected to align with a respective control knob of the plurality of control knobs 110 when cooktop 100 is mounted to cabinet 102. A size and a shape of each knob aperture wall of the knob aperture walls 402 is selected to allow insertion there through of a portion of a knob assembly 700 (shown with reference to FIG. 7) associated with each control knob. A location of each knob assembly 700 may be adjustable to allow the consumer of cooktop 100 to select, at least to some extent, a location of knob aperture walls 402 through control panel 114.

Figure 6:
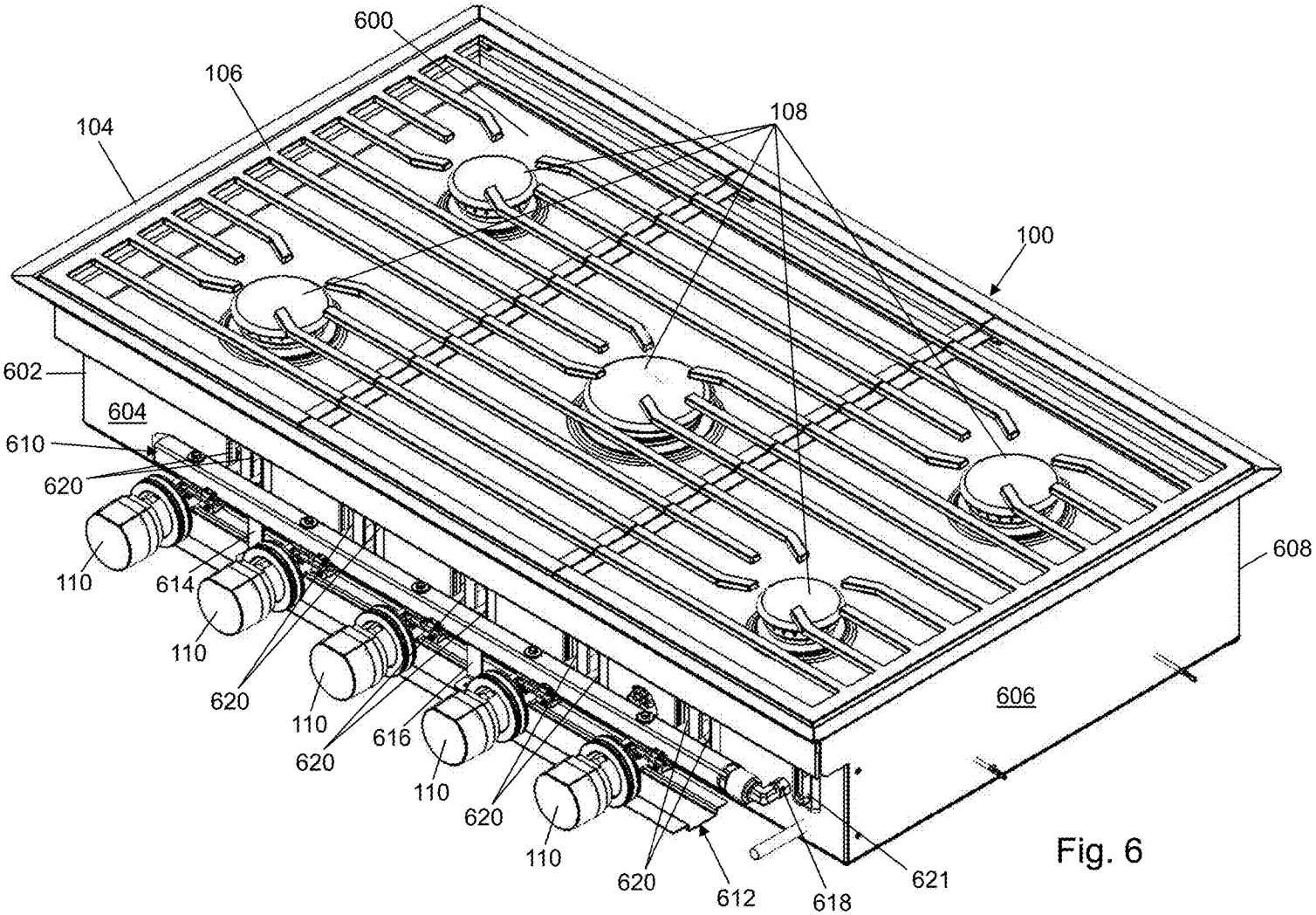
FIG. 6 depicts a top, front perspective view of the cooktop of FIG. 1 in accordance with an illustrative embodiment.

Referring to FIG. 6, cooktop 100 is shown without cabinet 102 in accordance with an illustrative embodiment. Cooktop 100 further may include a burner pan 600, a left housing wall 602, a front housing wall 604, a right housing wall 606, and a back housing wall 608. A plurality of slot aperture walls 620 are formed through front housing wall 604. The plurality of burners 108 are mounted through openings in burner pan 600. A gas line connects to each knob assembly 700 and extends through a slot aperture wall of the plurality of slot aperture walls 620 to connect to an associated burner of the plurality of burners 108 as described further below.

Cooktop mounting flange 104 extends outward and perpendicular to left housing wall 602, front housing wall 604, right housing wall 606, and back housing wall 608 so that cooktop 100 can be supported by platform 400.

Cooktop 100 further may include a gas manifold 610, a protection bracket 612, a first bracket 614, a second bracket 616, and a main gas line port 618. Gas manifold 610 is mounted between the plurality of control knobs 110 and front housing wall 604. When cooktop 100 is mounted to cabinet 102, gas manifold 610 extends in line with the plurality of control knobs 110 though in an interior of cabinet 102 so that it is not visible by the consumer. Main gas line port 618 mounts to a main gas line (not shown) at a first end of gas manifold 610 and provides an entry port for gas that is provided to one or more of the plurality of burners 108 under control of a respective control knob of the plurality of control knobs 110. For example, the consumer adjusts a flame from a burner of the plurality of burners 108 by rotating the respective control knob. Main gas line port 618 mounts to the main gas line that extends through a main line slot aperture wall 621.

Protection bracket 612 is mounted to gas manifold 610 by first bracket 614 and second bracket 616. A greater or a fewer number of brackets may be used to mount protection bracket 612 to gas manifold 610. Other mounting devices may be used in alternative embodiments. Protection bracket 612 is mounted below the plurality of control knobs 110 to protect a user from inadvertently touching an electrical component of the plurality of control knobs 110. In alternative embodiments, protection bracket 612, first bracket 614, and second bracket 616 may not be included.

Figure 7:
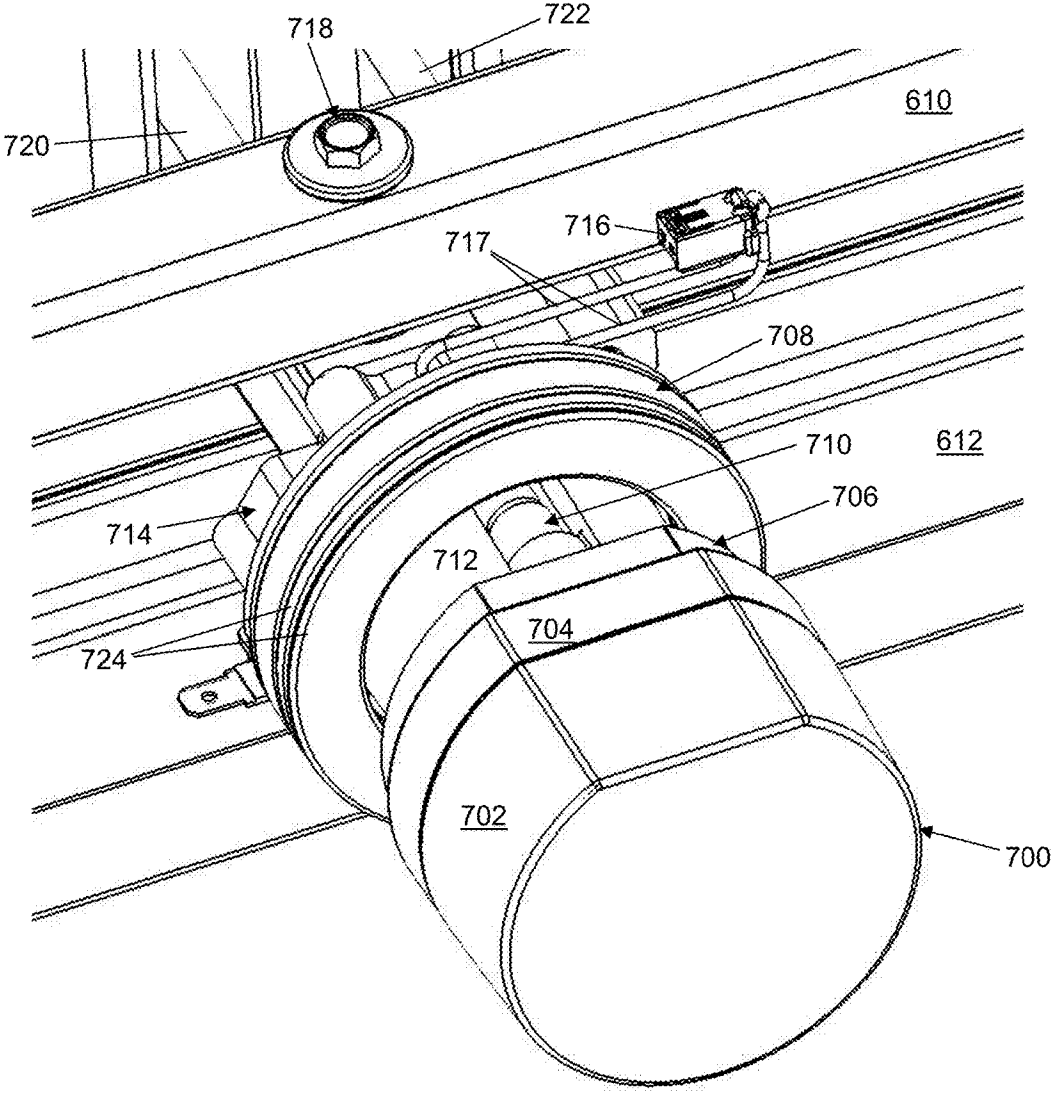
FIG. 7 depicts a zoomed, top, front perspective view of a knob assembly of the cooktop of FIG. 1 in accordance with an illustrative embodiment.
Figure 8:
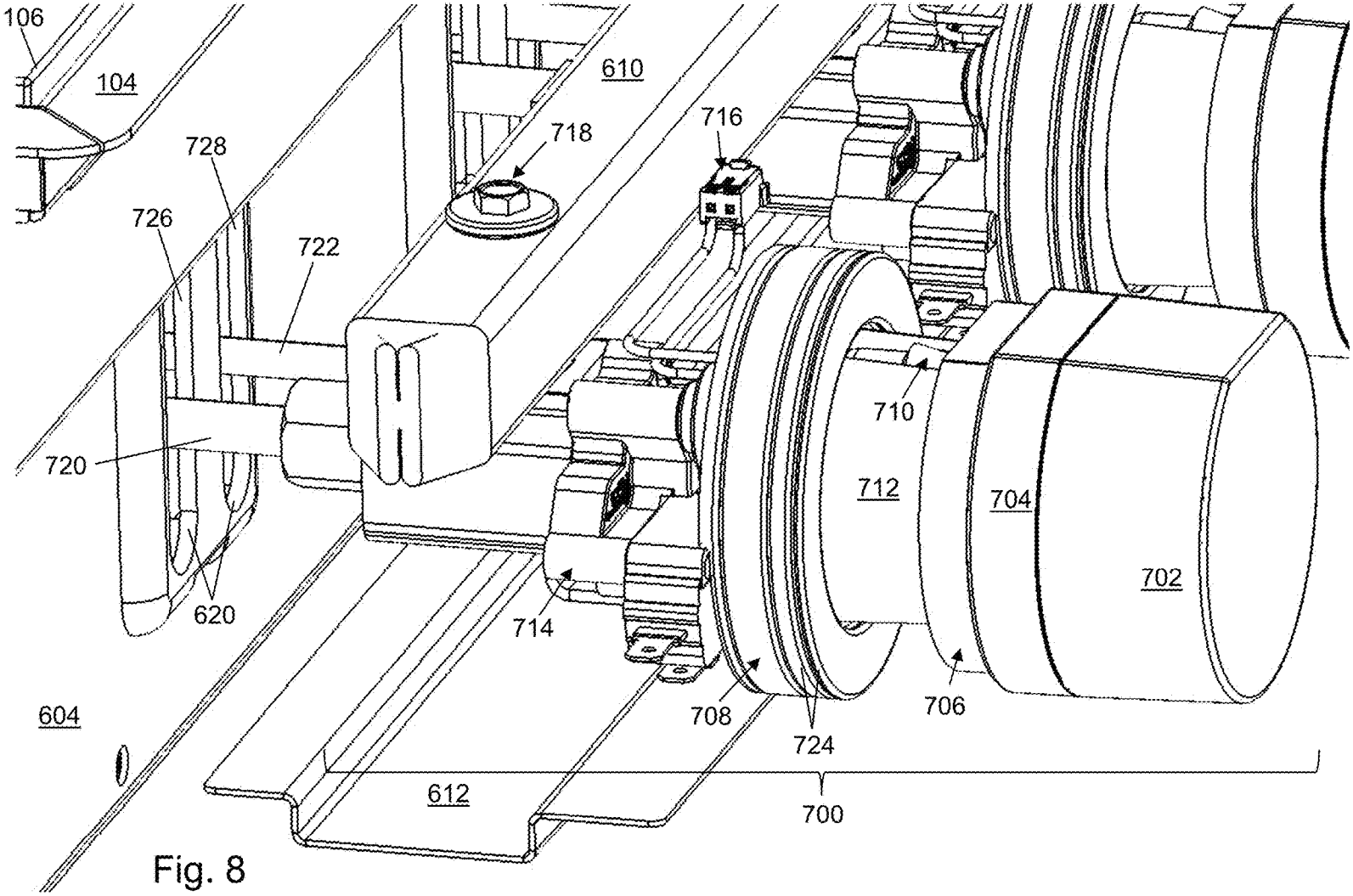
FIG. 8 depicts a zoomed, left perspective view of the knob assembly of FIG. 7 in accordance with an illustrative embodiment.
Figure 9:
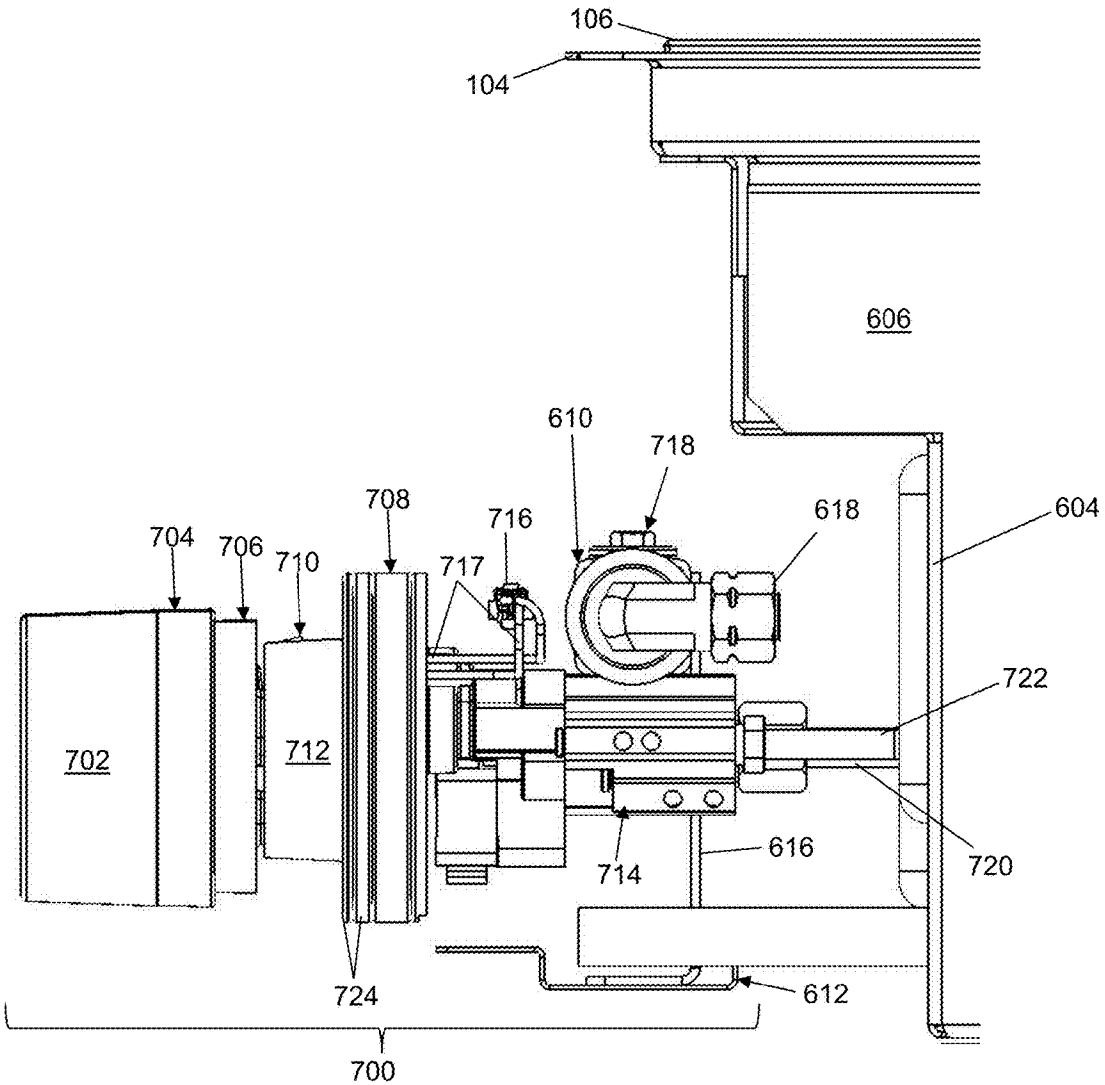
FIG. 9 depicts a zoomed right side view of the knob assembly of FIG. 7 in accordance with an illustrative embodiment.

Referring to FIG. 7, a top, front zoomed perspective view of knob assembly 700 is shown in accordance with an illustrative embodiment. Referring to FIG. 8, a left zoomed perspective view of knob assembly 700 is shown in accordance with an illustrative embodiment. Referring to FIG. 9, a zoomed, right side view of knob assembly 700 is shown in accordance with an illustrative embodiment. Knob assembly 700 is associated with each of the plurality of control knobs 110 to mount the control knob to the respective burner to control the flame for cooking. Knob assembly 700 may include a knob 702, a bezel 704, a mounting disc 706, a spacer 708, a light assembly 710, a receptacle 712, a valve 714, a light power connector 716, light power connectors 717, a valve manifold connector 718, an upper burner gas line 720, a lower burner gas line 722, and one or more additional spacer rings 724. Spacer 708 and the one or more additional spacer rings 724 have a disc shape with a width selected to fill a space between receptacle 712 and a back face of control panel 114 based on a thickness of control panel 114 distance between front panel face 115 and back panel face 2604) of cabinet 102.

Though not shown, upper burner gas line 720 and lower burner gas line 722, respectively, connect to an upper burner and a lower burner of a dual stack burner. For example, lower burner gas line 722 may provide a simmer flame, and upper burner gas line 720 may provide a main cooking flame. Lower burner gas line 722 and upper burner gas line 720 may be small metallic tubes. For illustration, lower burner gas line 722 and upper burner gas line 720 may be formed of corrugated stainless steel tubing. Use of corrugated stainless steel allows each knob assembly 700 to move in and out relative to front housing wall 604 to support a greater range of options in mounting cooktop 100 to cabinet 102. In an alternative embodiment, one or more burner of the plurality of burners 108 may not be a multiple stack burner such as a dual stack burner. Thus, each knob assembly 700 may connect to a fewer or a greater number of gas lines.

Upper burner gas line 720 may extend through a first gas line slot aperture wall 726 of the plurality of slot aperture walls 620 formed through front housing wall 604. Lower burner gas line 722 may extend through a second gas line slot aperture wall 728 of the plurality of slot aperture walls 620 formed through front housing wall 604. In the illustrative embodiment, first gas line slot aperture wall 726 and second gas line slot aperture wall 728 are separate aperture walls though this is not required. Lower burner gas line 722 and upper burner gas line 720 may extend through the same slot aperture wall. Each knob assembly 700 may include a similar arrangement of first gas line slot aperture wall 726 and second gas line slot aperture wall 728 though this is not required.

In the illustrative embodiment, first gas line slot aperture wall 726, second gas line slot aperture wall 728, and main line slot aperture wall 621 (shown in FIG. 6) are elongated in the vertical direction to allow each knob assembly 700 and main gas line port 618 to move up and down within the respective slot to support a greater range of options in positioning the knob aperture walls 402 through control panel 114 to mount cooktop 100 to cabinet 102. First gas line slot aperture wall 726 and second gas line slot aperture wall 728 further have a slot width greater than a width of lower burner gas line 722 and upper burner gas line 720 to allow each knob assembly 700 to move left and right within the slot to further support a greater range of options in positioning the knob aperture walls 402 through control panel 114 to mount cooktop 100 to cabinet 102. Main line slot aperture wall 621 further has a slot width greater than a width of the main gas line to allow each knob assembly 700 to move left and right. The ability to move each knob assembly 700 in three directions (vertically, horizontally, and into and out of the plurality of slot aperture walls 620) relative to front housing wall 604 greatly simplifies the mounting of cooktop 100 to cabinet 102, and the alignment of each knob aperture wall of the knob aperture walls 402 with a respective control knob of the plurality of control knobs 110.

Valve 714 connects to gas manifold 610 using valve manifold connector 718. Valve 714 regulates gas pressure to the respective burner based on a rotation angle of knob 702 by a consumer. Though not shown a small wire may extend from valve 714 to an igniter at the respective burner. The igniter receives an electrical current and lights the selected burner flame when knob 702 is depressed and rotated to an ignite or "ON" position. Knob 702 may provide separate rotation angles to control the flow of gas to the upper and lower burners separately.

When cooktop 100 is mounted to cabinet 102, the knob aperture walls 402 are positioned between mounting disc 706 and spacer 708. A distance may be selected between mounting disc 706 and spacer 708 based on a thickness of control panel 114 through which the knob aperture walls 402 extend. For flexibility, the one or more additional spacer rings 724 of various widths may be positioned between spacer 708 and control panel 114 so that spacer 708 or one of the spacer rings 724 abuts the back face of control panel 114 to add stability to the plurality of control knobs. For example, the one or more additional spacer rings 724 may be determined by measuring the thickness of control panel 114, by subtracting one inch from the measured value of the thickness to determine a remaining width, and by adding an appropriate number and width of the one or more additional spacer rings 724 that provide the determined remaining width.

When cooktop 100 is mounted to cabinet 102, front panel face 115 of control panel 114 may be positioned a distance from bezel 704. The distance may be selected to allow the consumer to move knob 702 towards control panel 114 to release knob 702 for rotation to switch on the burner for use.

Figure 10:
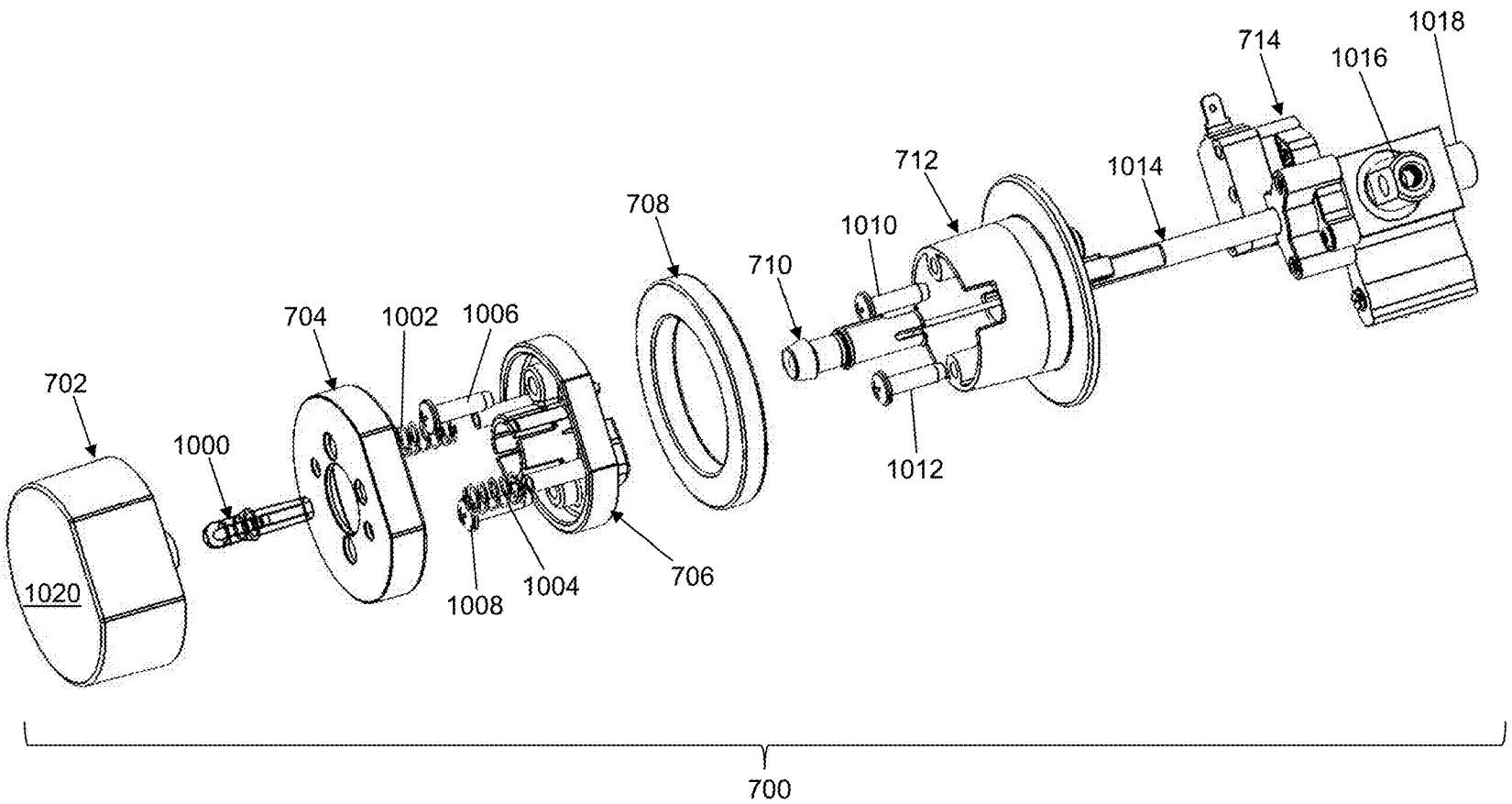
FIG. 10 depicts a top exploded view of the knob assembly of FIG. 7 in accordance with an illustrative embodiment.
Figure 11:
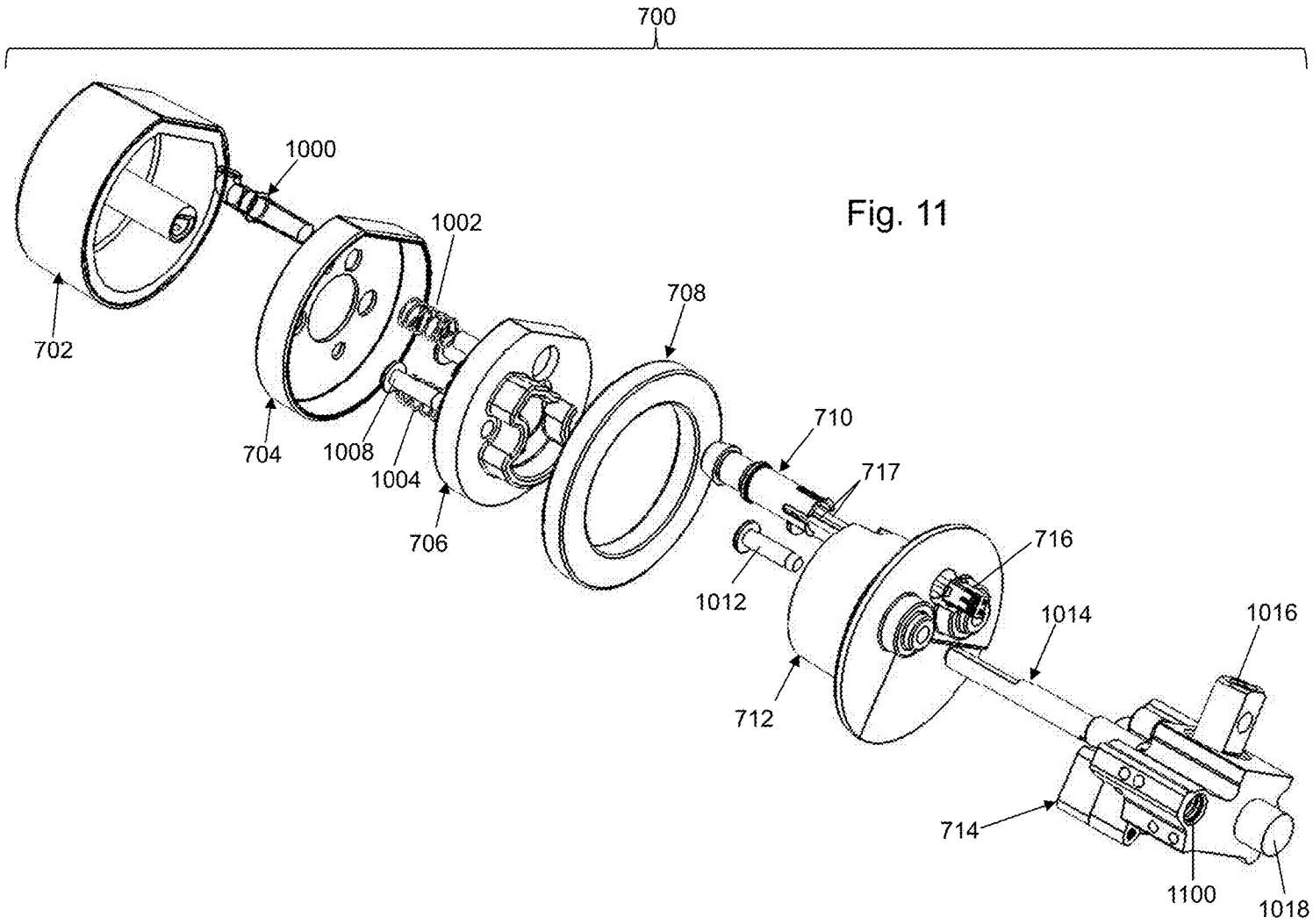
FIG. 11 depicts a back, right exploded view of the knob assembly of FIG. 7 in accordance with an illustrative embodiment.

Referring to FIG. 10, a top exploded view of knob assembly 700 is shown in accordance with an illustrative embodiment. Referring to FIG. 11, a back exploded view of knob assembly 700 is shown in accordance with an illustrative embodiment. Knob assembly 700 further may include a light pipe 1000, a first biasing element 1002, a second biasing element 1004, a first fastener 1006, a second fastener 1008, a third fastener 1010, a fourth fastener 1012, and a knob control rod 1014.

Figure 20:
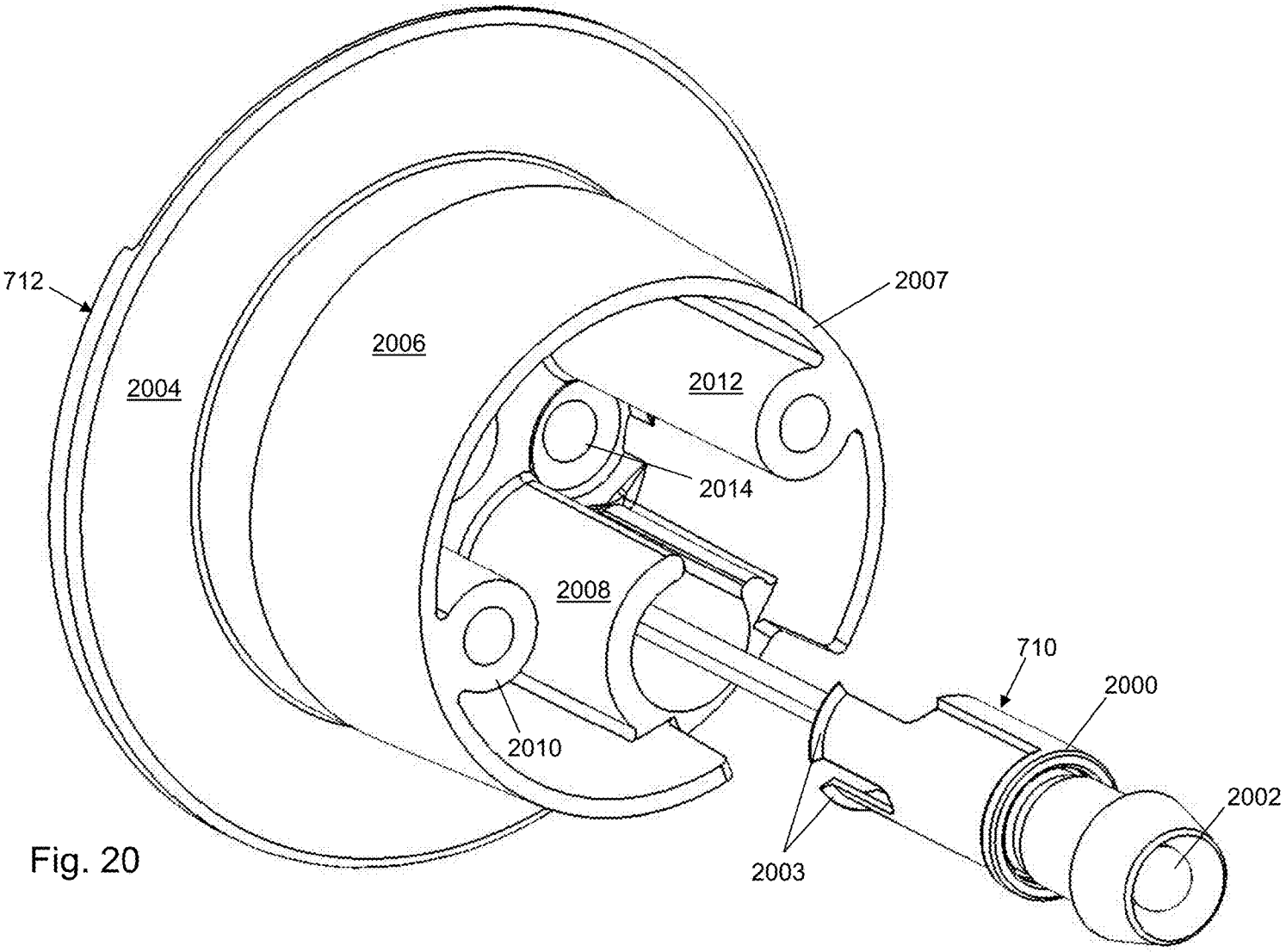
FIG. 20 depicts a front perspective view of a receptacle of the knob assembly of FIG. 7 in accordance with an illustrative embodiment.
Figure 21:
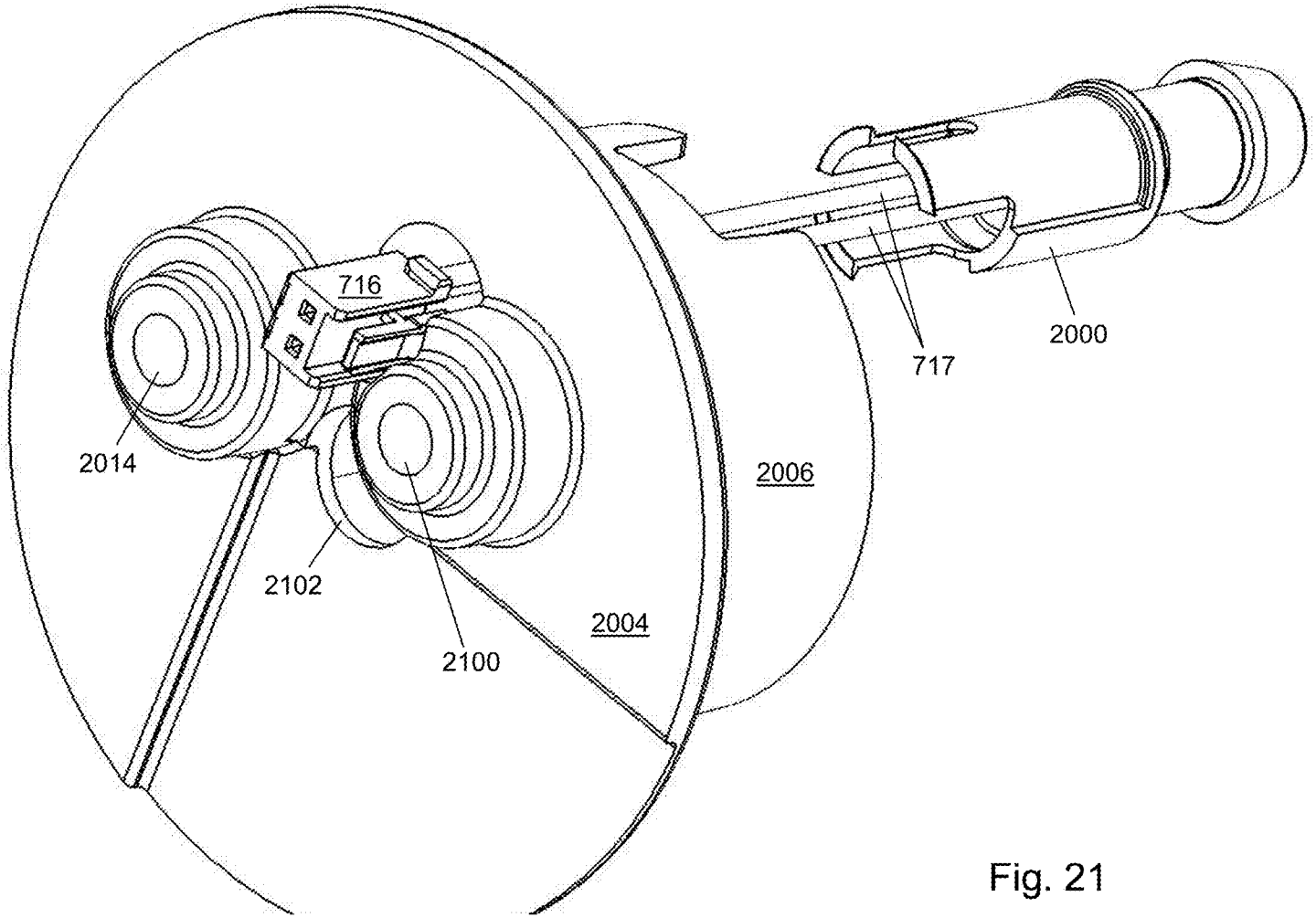
FIG. 21 depicts a back perspective view of the receptacle of FIG. 20 in accordance with an illustrative embodiment.

Light pipe 1000 mounts to light assembly 710. Referring to FIGS. 20 and 21, light assembly 710 may include a light sleeve 2000, a light source 2002, light power connector 716, and the light power connectors 717. For illustration, light source 2002 may be a light emitting diode (LED), and the light power connectors 717 may be a cathode and an anode of the LED. Light source 2002 is mounted within light sleeve 2000. Light pipe 1000 is mounted to receive light from light source 2002 and to radiate the light to illuminate a control setting on knob 702 as discussed further below.

Referring again to FIGS. 10 and 11, valve 714 may include knob control rod 1014, an input gas line connector port 1016, a first burner gas line connector port 1018, and a second burner gas line connector port 1100. Each of input gas line connector port 1016, first burner gas line connector port 1018, and second burner gas line connector port 1100 may have threaded fittings where the gas line tubes attach. For example, lower burner gas line 722 may be mounted to second burner gas line connector port 1100, and upper burner gas line 720 may be mounted to first burner gas line connector port 1018 using threaded fittings. Input gas line connector port 1016 may be mounted to gas manifold 610 by valve manifold connector 718 using threaded fittings to receive gas from the main gas line of cooktop 100.

Rotation of knob control rod 1014 by rotation of knob 702 adjusts a height of the flame at the respective burner and/or whether or not one or more stacked burners are lit. First biasing element 1002 and second biasing element 1004 mount between bezel 704 and mounting disc 706 so that knob 702 returns to an "OFF" position at which knob 702 cannot be rotated in order to avoid inadvertently releasing gas from valve 714 or lighting a burner. In the illustrative embodiment, first biasing element 1002 and second biasing element 1004 are compression springs. Knob assembly 700 may include a greater or a fewer number of biasing elements. Movement of knob 702 in a direction towards control panel 114 against the biasing force of first biasing element 1002 and second biasing element 1004 releases knob 702 for rotation to adjust the height of the flame and the burner that is lit.

First fastener 1006 and second fastener 1008 mount mounting disc 706 to receptacle 712. Third fastener 1010 and fourth fastener 1012 mount receptacle 712 to valve 714. In the illustrative embodiment, first fastener 1006, second fastener 1008, third fastener 1010, and fourth fastener 1012 are screws that include a shaft and a head as understood by a person of skill in the art. A portion of the shafts may be threaded. Other types of fasteners and mounting methods than those shown for illustration may be used to mount the components of knob assembly 700 to each other and to lower burner gas line 722, upper burner gas line 720, and gas manifold 610.

Figure 12:
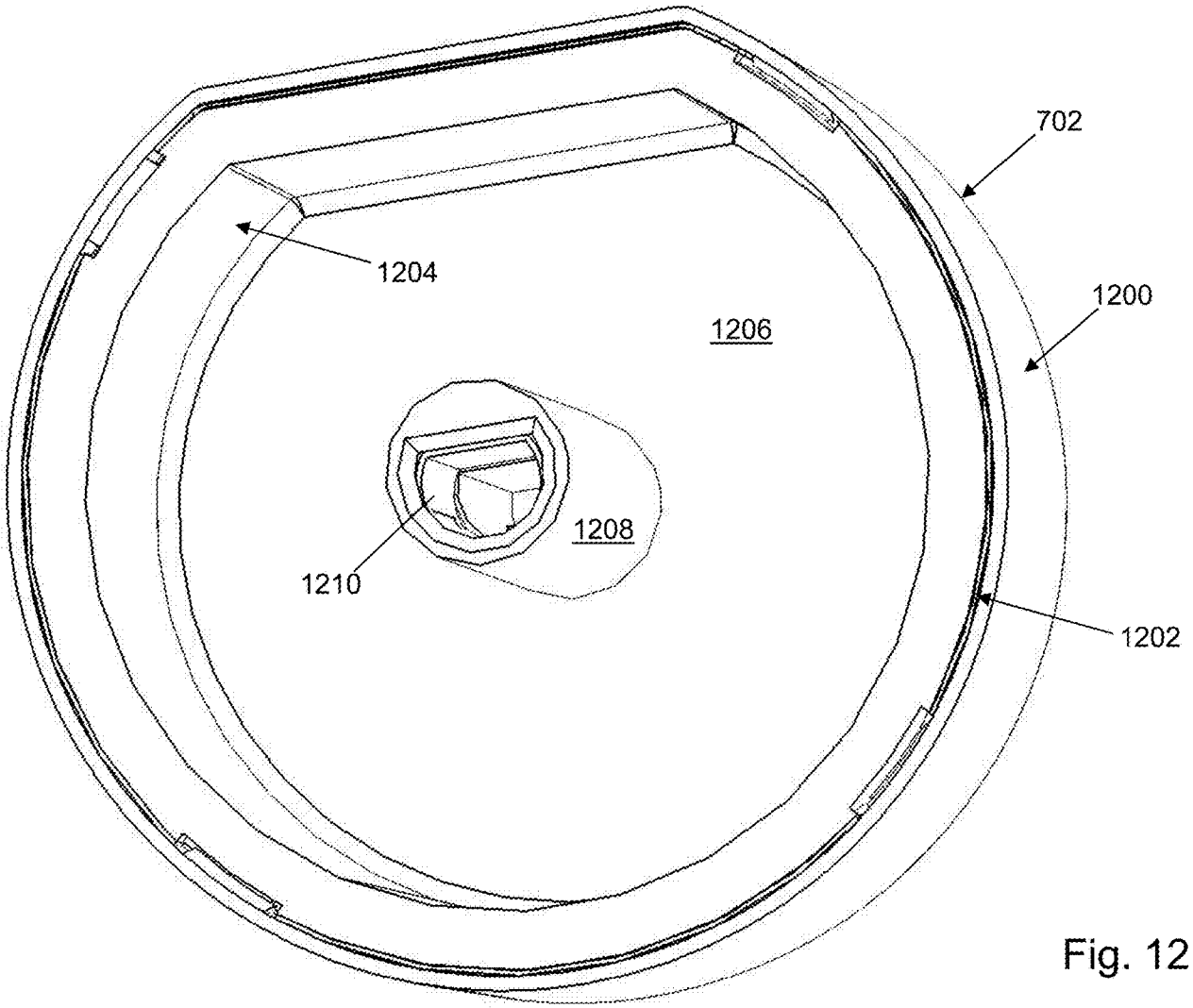
FIG. 12 depicts a back perspective view of a knob of the knob assembly of FIG. 7 in accordance with an illustrative embodiment.

Referring to FIG. 12, a back perspective view of knob 702 is shown in accordance with an illustrative embodiment. Knob 702 may include a knob face 1020 (shown with reference to FIGS. 10 and 13), a knob exterior sleeve 1200, a knob lettering sleeve 1202, a knob interior sleeve 1204, a knob back wall 1206, a knob mounting protrusion 1208, and a knob mounting aperture wall 1210. Knob lettering sleeve 1202 is mounted between knob exterior sleeve 1200 and knob interior sleeve 1204.

Knob mounting protrusion 1208 is mounted to knob back wall 1206 to extend towards valve 714 when knob assembly 700 is assembled. Knob interior sleeve 1204 extends from edges of knob back wall 1206 towards valve 714 to create a cavity between knob interior sleeve 1204 and knob mounting protrusion 1208. The cavity between knob interior sleeve 1204 and knob mounting protrusion 1208 is sized to accommodate light pipe 1000 as knob 702 is rotated around light pipe 1000. Knob mounting aperture wall 1210 extends into knob mounting protrusion 1208 to form a hole sized and shaped to accept a tip 2210 (shown with reference to FIG. 22) of knob control rod 1014. Tip 2210 of knob control rod 1014 is sized and shaped so that knob control rod 1014 is captured by knob 702 to rotate with knob 702. Knob 702 may have a different shape than that illustrated.

Figure 13:
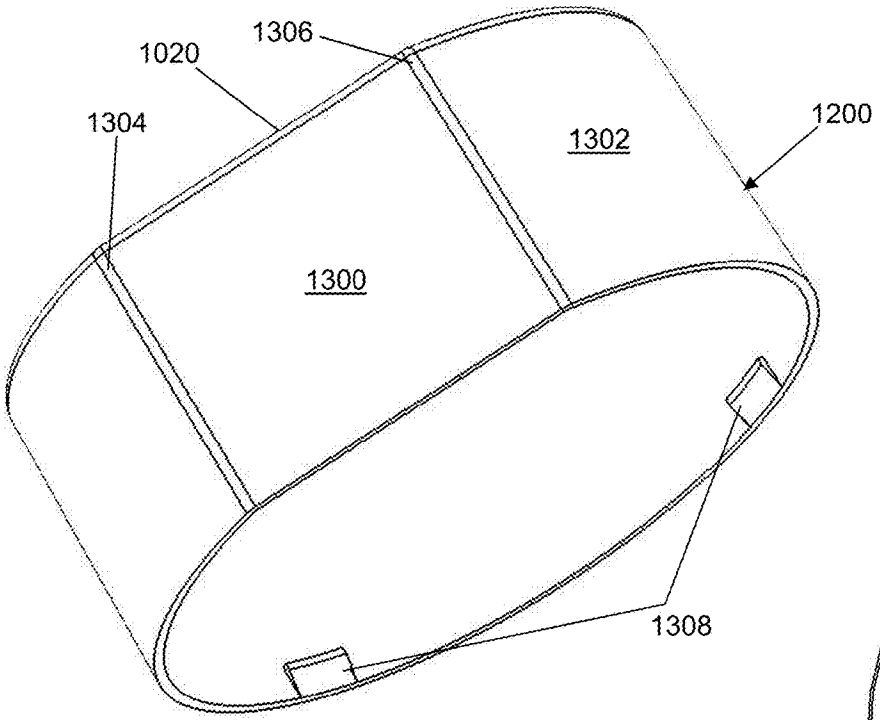
FIG. 13 depicts a back perspective view of a knob exterior sleeve of the knob of FIG. 12 in accordance with an illustrative embodiment.

Referring to FIG. 13, a back perspective view of knob exterior sleeve 1200 is shown in accordance with an illustrative embodiment. Knob exterior sleeve 1200 may include an exterior flat wall 1300, an exterior curved wall 1302, a first exterior flat wall edge 1304, a second exterior flat wall edge 1306, and a plurality of tabs 1308. Exterior flat wall 1300 is generally flat. Exterior curved wall 1302 is generally curved. Exterior curved wall 1302 transitions to exterior flat wall 1300 at first exterior flat wall edge 1304 and at second exterior flat wall edge 1306. Knob face 1020 extends between top edges of exterior flat wall 1300 and exterior curved wall 1302. The plurality of tabs 1308 protrude from and towards an interior of knob exterior sleeve 1200. In the illustrative embodiment, the plurality of tabs 1308 includes four tabs though a greater or a fewer number of tabs may be used in alternative embodiments. Knob exterior sleeve 1200 and knob face 1020 may be integrally formed together.

Figure 14:
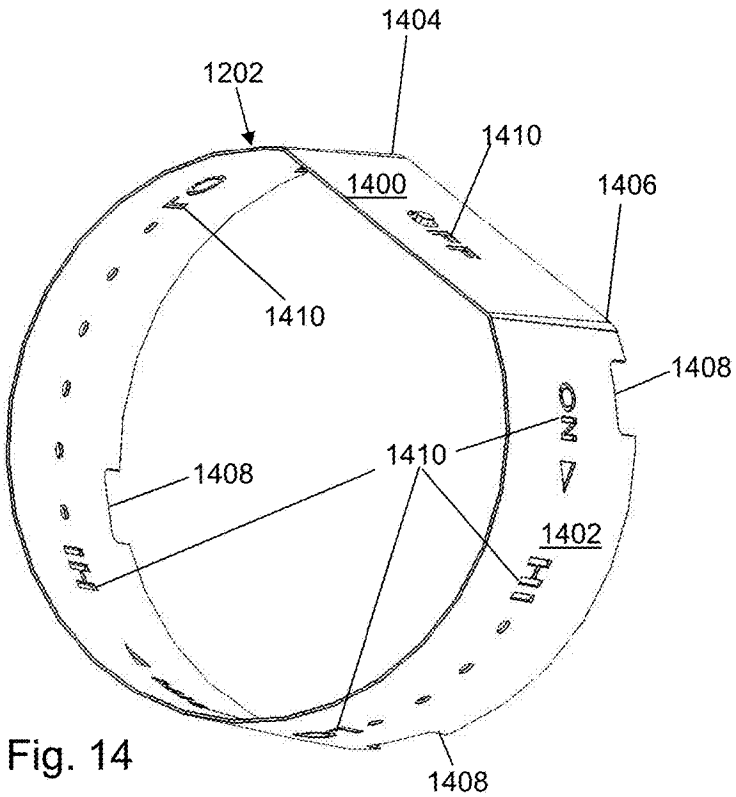
FIG. 14 depicts a front perspective view of a knob lettering sleeve of the knob of FIG. 12 in accordance with an illustrative embodiment.

Referring to FIG. 14, a front perspective view of knob lettering sleeve 1202 is shown in accordance with an illustrative embodiment. Knob lettering sleeve 1202 may include a lettering flat wall 1400, a lettering curved wall 1402, a first lettering flat wall edge 1404, a second lettering flat wall edge 1406, a plurality of cutouts 1408, and lettering aperture walls 1410. Lettering flat wall 1400 is generally flat. Lettering curved wall 1402 is generally curved. Lettering curved wall 1302 transitions to exterior flat wall 1300 at first lettering flat wall edge 1404 and at second lettering flat wall edge 1406. The plurality of cutouts 1408 are in a lower edge of lettering curved wall 1402 and are sized and shaped to fit over the plurality of tabs 1308 so that knob lettering sleeve 1202 abuts knob exterior sleeve 1200. In the illustrative embodiment, the plurality of cutouts 1408 includes four cutouts though a greater or a fewer number of cutouts may be used in alternative embodiments to correspond with the number of the plurality tabs 1308.

The lettering aperture walls 1410 are cutouts that indicate a flame setting. In the illustrative embodiment, the lettering includes "OFF ON⊳HI . . . LO ON⊳HI . . . LO". The lettering OFF is positioned on lettering flat wall 1400 and is upwards when the burner is off. Turning the knob counter clockwise controls a first burner ON⊳HI . . . LO. Continued rotation controls a second burner ON⊳HI . . . LO. Numerical setting values may be used in alternative embodiments. The lettering further may not be in the form of cutouts. For example, the lettering may be formed by etching partially into lettering flat wall 1400 and lettering curved wall 1402 or by a different coloration. In an illustrative embodiment, only one of first burner and second burner is lit at a time. Thus, continued rotation to turn the second burner on turns off the first burner.

Figure 15:
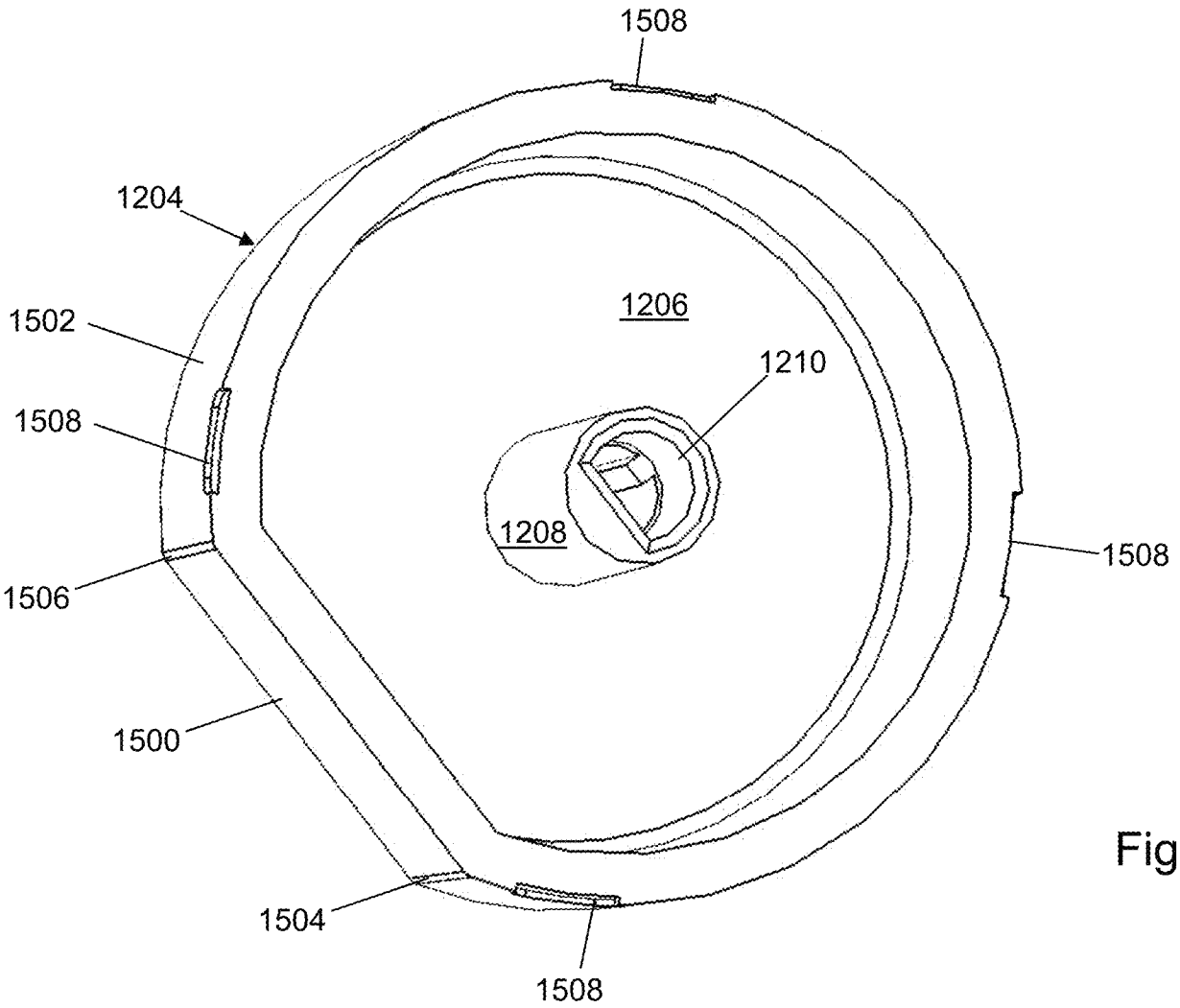
FIG. 15 depicts a back perspective view of a knob interior sleeve of the knob of FIG. 12 in accordance with an illustrative embodiment.

Referring to FIG. 15, a back perspective view of knob interior sleeve 1204 is shown in accordance with an illustrative embodiment. Knob interior sleeve 1204 may include an interior flat wall 1500, an interior curved wall 1502, a first interior flat wall edge 1504, a second interior flat wall edge 1506, and a plurality of tab cutouts 1508. Interior flat wall 1500 is generally flat. Interior curved wall 1502 is generally curved. Interior curved wall 1502 transitions to interior flat wall 1500 at first interior flat wall edge 1504 and at second interior flat wall edge 1506. Knob back wall 1206 extends between top edges of interior flat wall 1500 and interior curved wall 1502.

The plurality of tab cutouts 1508 protrude from and towards an interior of knob interior sleeve 1500. The plurality of tab cutouts 1508 align with and abut the plurality of tabs 1308 to mount knob exterior sleeve 1200, knob lettering sleeve 1202, and knob interior sleeve 1204 to each other. In the illustrative embodiment, the plurality of tab cutouts 1508 includes four tab cutouts though a greater or a fewer number of tab cutouts may be used in alternative embodiments. Interior flat wall 1500, interior curved wall 1502, first interior flat wall edge 1504, second interior flat wall edge 1506, and the plurality of tab cutouts 1508 may be integrally formed together.

Figure 16:
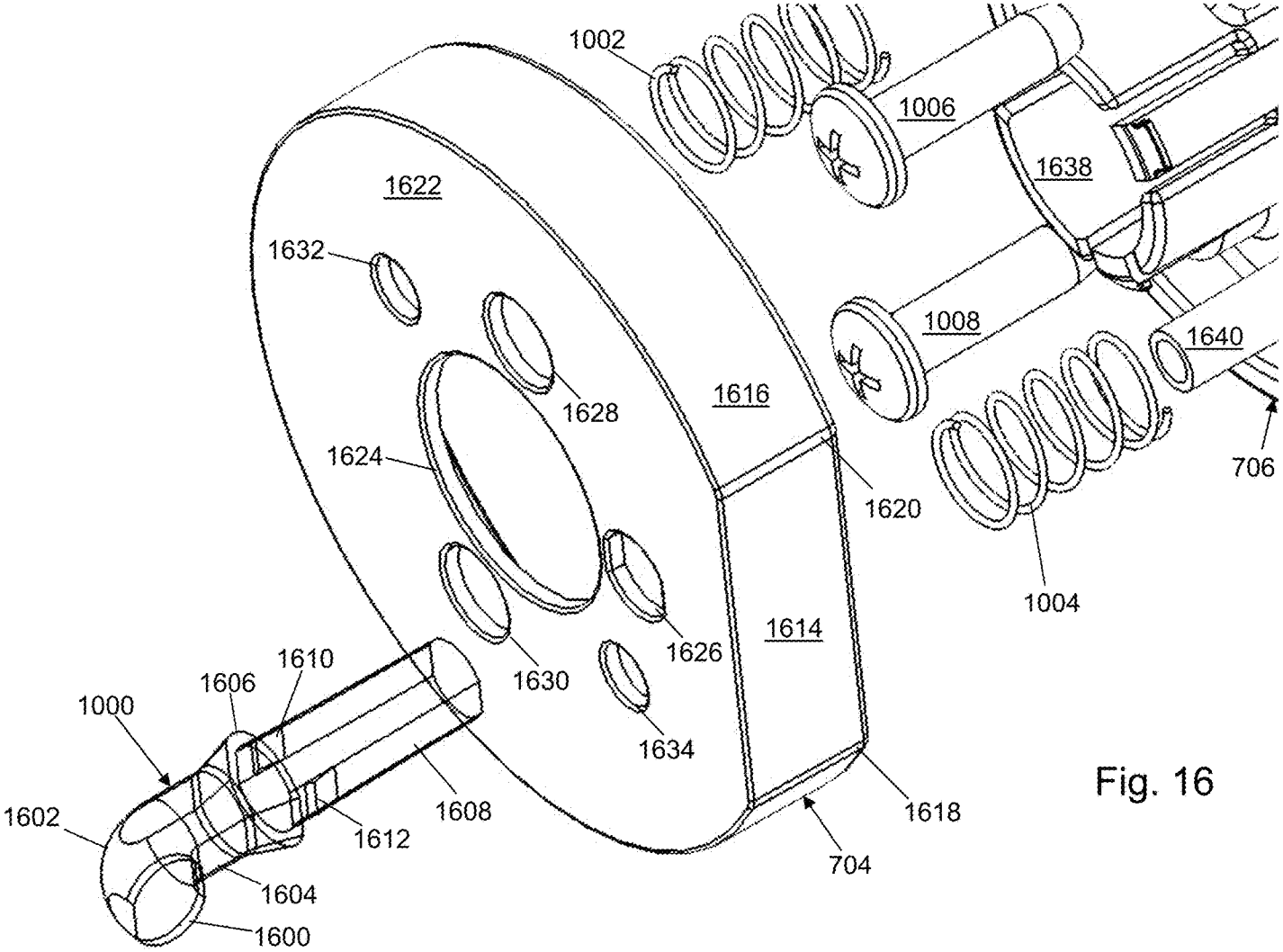
FIG. 16 depicts a front perspective view of a bezel of the knob assembly of FIG. 7 in accordance with an illustrative embodiment.

Referring to FIG. 16, a front perspective view of light pipe 1000 is shown in accordance with an illustrative embodiment. Light pipe 1000 may include a light exit aperture wall 1600, a pipe elbow 1602, a pipe tube 1604, a pipe mounting flange 1606, a pipe insertion rod 1608, a first pipe tab 1610, and a second pipe tab 1612. Light exit aperture wall 1600 extends from pipe elbow 1602. Pipe elbow 1602 extends from pipe tube 1604. Pipe tube 1604 extends from pipe mounting flange 1606. Pipe insertion rod 1608 extends from pipe mounting flange 1606. Pipe mounting flange 1606 has a larger circumference than pipe insertion rod 1608 at the end of pipe mounting flange 1606 from which pipe insertion rod 1608 extends. First pipe tab 1610 and second pipe tab 1612 extend from sides of pipe insertion rod 1608. In the illustrative embodiment, pipe insertion rod 1608 includes two tabs though a greater or a fewer number of tabs may be used in alternative embodiments.

Pipe insertion rod 1608 is sized and shaped to fit within a light pipe aperture wall 1626 of bezel 704. To mount light pipe 1000 to bezel 704, pipe insertion rod 1608 is inserted through light pipe aperture wall 1626 until a top of first pipe tab 1610 and second pipe tab 1612 abuts a back face of a top wall 1622 of bezel 704. Pipe mounting flange 1606 has a larger circumference than light pipe aperture wall 1626 to mount light pipe 1000 in a fixed position relative to bezel 704. Pipe insertion rod 1608 is non-circular so that it does not rotate within light pipe aperture wall 1626 of bezel 704.

Light from light source 2002 is reflected inside an interior of light pipe 1000 to exit through light exit aperture wall 1600. Light exit aperture wall 1600 is aligned with a bezel flat wall 1614 of bezel 704 so that the light exits in a plane that is perpendicular to an exterior face of bezel flat wall 1614. Light exit aperture wall 1600 is mounted below the lettering of a portion of the lettering aperture walls 1410. As knob 702 is rotated, light exit aperture wall 1600 remains directed upwards to illuminate a portion of the lettering aperture walls 1410 based on the rotation angle of knob 702. For example, when knob 702 is in the "OFF" position, the "OFF" portion of the lettering aperture walls 1410 is above light exit aperture wall 1600. When knob 702 is pushed towards front panel face 115 of control panel 114, light source 2002 is switched on, and the light reflected out of light pipe 1000 through light exit aperture wall 1600 illuminates the "OFF" portion of the lettering aperture walls 1410.

Bezel 704 may include bezel flat wall 1614, a bezel curved wall 1616, a first bezel flat wall edge 1618, a second bezel flat wall edge 1620, top wall 1622, a center mounting aperture wall 1624, light pipe aperture wall 1626, a first fastener aperture wall 1628, a second fastener aperture wall 1630, a first prong aperture wall 1632, and a second prong aperture wall 1634. Bezel flat wall 1614 is generally flat. Bezel curved wall 1616 is generally curved. Bezel curved wall 1616 transitions to bezel flat wall 1614 at first bezel flat wall edge 1618 and at second bezel flat wall edge 1620. Bezel flat wall 1614 and bezel curved wall 1616 approximately align with exterior flat wall 1300 and exterior curved wall 1302, respectively, when knob assembly 700 is assembled, and knob 702 is in the "OFF" position.

Center mounting aperture wall 1624, light pipe aperture wall 1626, first fastener aperture wall 1628, second fastener aperture wall 1630, first prong aperture wall 1632, and second prong aperture wall 1634 are formed through top wall 1622. Center mounting aperture wall 1624 is sized and shaped to accept a center mounting protrusion 1638 of mounting disc 706.

First fastener aperture wall 1628 and second fastener aperture wall 1630 are sized and shaped to accept a fastening device such as a shaft of a screwdriver to pass through to allow tightening of first fastener 1006 and second fastener 1008, respectively, to mount mounting disc 706 to receptacle 712 after cooktop 100 has been positioned on cabinet 102. First prong aperture wall 1632 and second prong aperture wall 1634 are sized and shaped to accept the shafts of a first prong 1700 (shown with reference to FIG. 17) and of a second prong 1640 of mounting disc 706.

Figure 17:
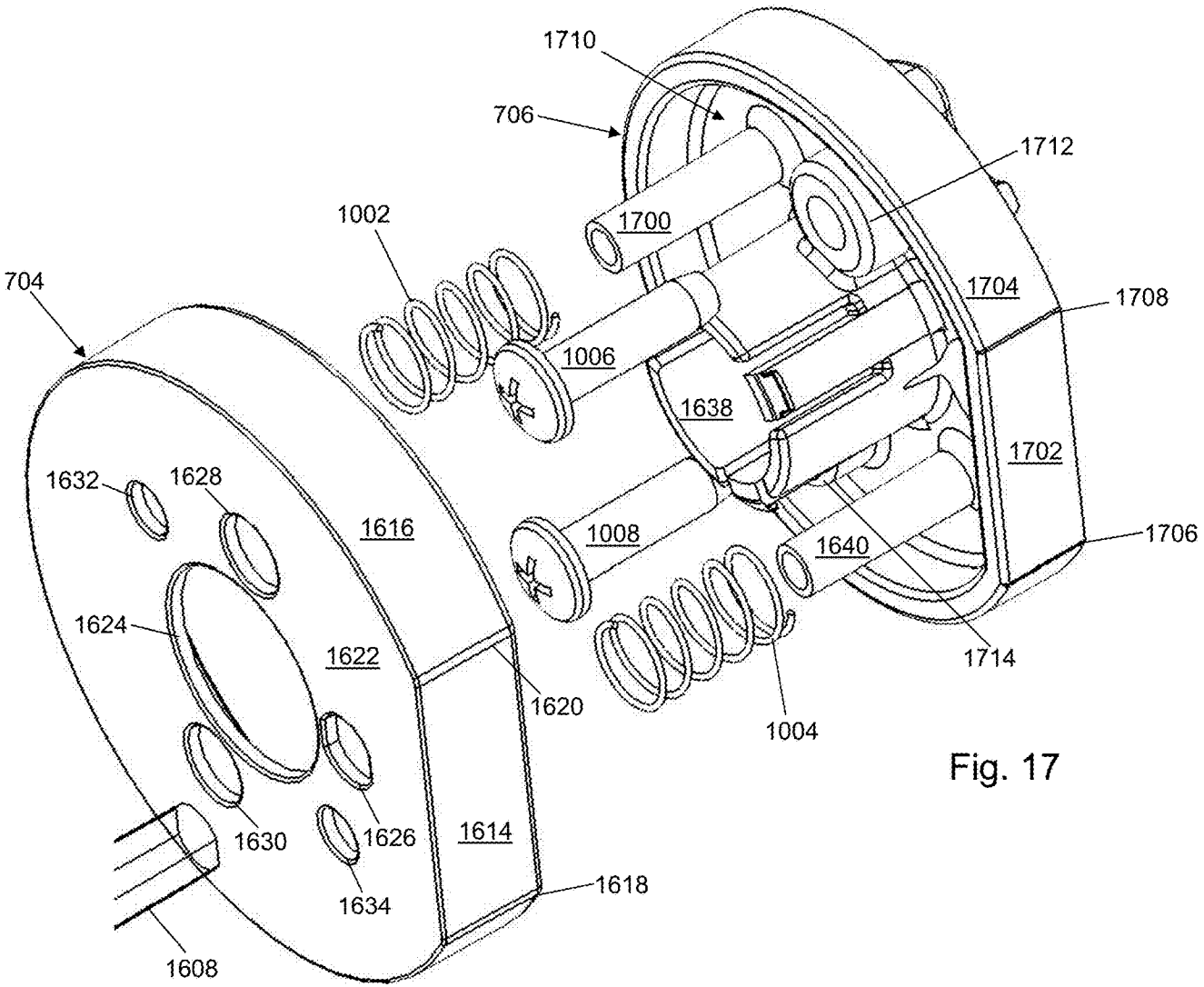
FIG. 17 depicts a front perspective view of the bezel of FIG. 16 and a mounting disc of the knob assembly of FIG. 7 in accordance with an illustrative embodiment.
Figure 18:
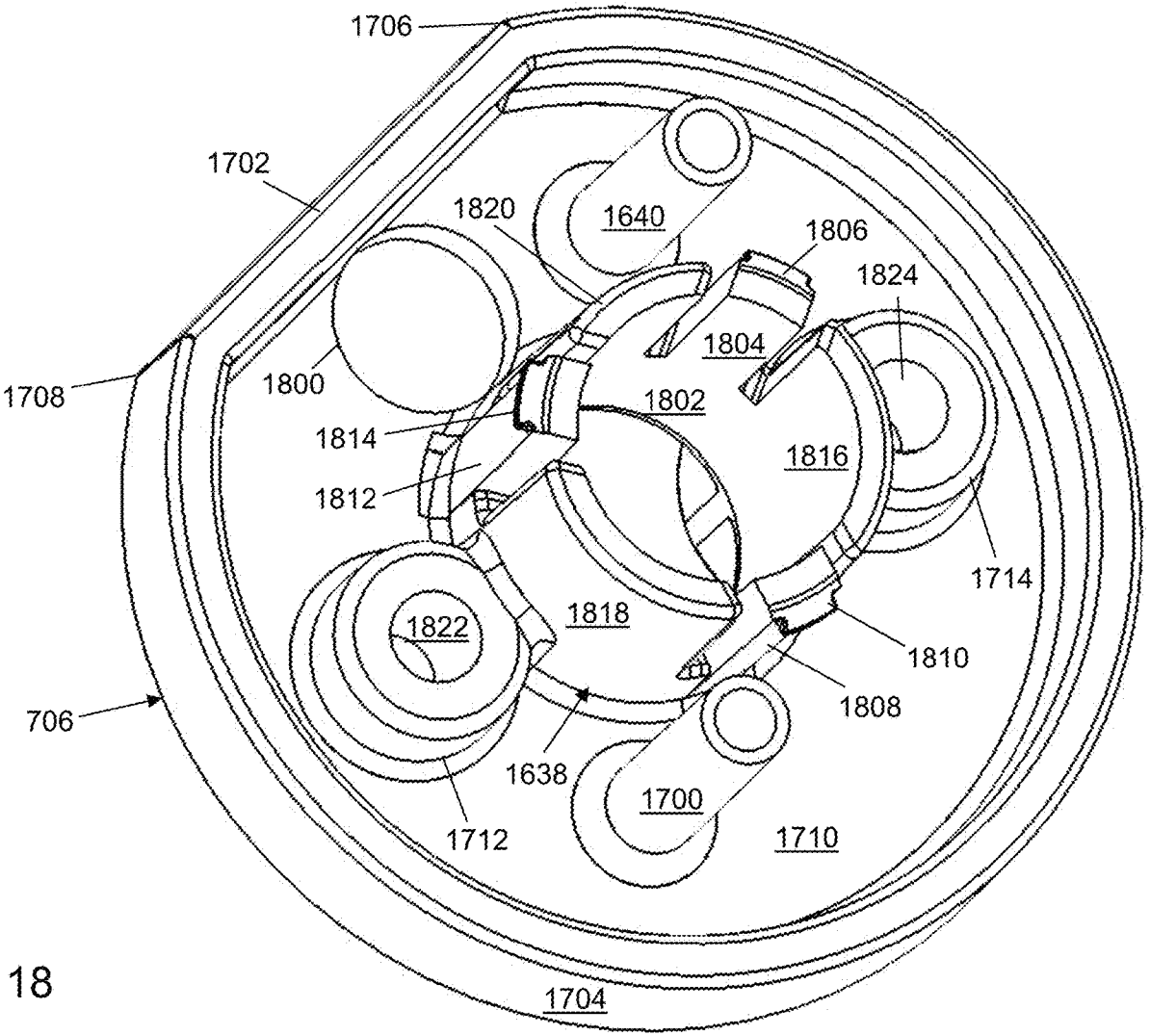
FIG. 18 depicts a front perspective view of the mounting disc of FIG. 17 in accordance with an illustrative embodiment.
Figure 19:
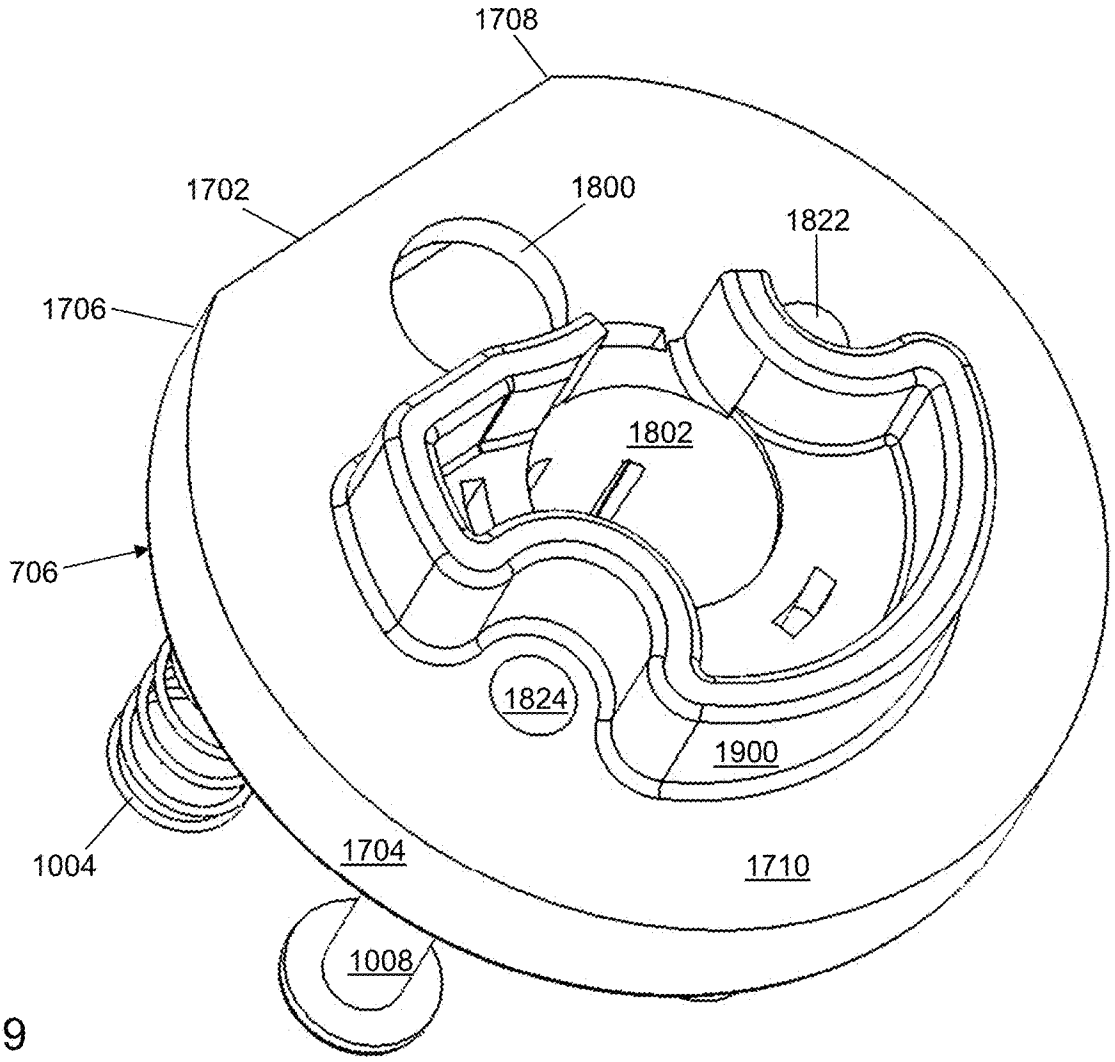
FIG. 19 depicts a back perspective view of the mounting disc of FIG. 17 in accordance with an illustrative embodiment.

Referring to FIGS. 16-18, a front perspective view of mounting disc 706 is shown in accordance with an illustrative embodiment. Referring to FIG. 19, a back perspective view of mounting disc 706 is shown in accordance with an illustrative embodiment. Mounting disc 706 may include center mounting protrusion 1638, first prong 1700, second prong 1640, a mounting disc flat wall 1702, a mounting disc curved wall 1704, a first mounting disc flat wall edge 1706, a second mounting disc flat wall edge 1708, a bottom wall 1710, a first fastener nut 1712, a first fastener nut interior wall 1822, a second fastener nut 1714, a second fastener nut interior wall 1824, a light assembly aperture wall 1800, and a curved wall 1900. Center mounting protrusion 1638, first prong 1700, second prong 1640, mounting disc flat wall 1702, mounting disc curved wall 1704, first fastener nut 1712, and second fastener nut 1714 are mounted to extend upwards from bottom wall 1710 toward bezel 704 when knob assembly 700 is assembled. First fastener nut interior wall 1822, second fastener nut interior wall 1824, and light assembly aperture wall 1800 are formed through bottom wall 1710. Curved wall 1900 extends from a bottom surface of bottom wall 1710 toward receptacle 712 when knob assembly 700 is assembled and fits within a receptacle wall 2006 (shown with reference to FIG. 20) of receptacle 712. The components of mounting disc 706 may be integrally formed together.

Mounting disc flat wall 1702 is generally flat. Mounting disc curved wall 1704 is generally curved. Mounting disc curved wall 1704 transitions to mounting disc flat wall 1702 at first mounting disc flat wall edge 1706 and at second mounting disc flat wall edge 1708. Mounting disc flat wall 1702 approximately aligns with bezel flat wall 1614 and with exterior flat wall 1300 when knob assembly 700 is assembled and knob 702 is in the "OFF" position. Mounting disc curved wall 1704 approximately aligns with bezel curved wall 1616 and with exterior curved wall 1302 when knob assembly 700 is assembled and knob 702 is in the "OFF" position.

First biasing element 1002 is positioned over first prong 1700, and second biasing element 1004 is positioned over second prong 1640. When knob 702 is pushed in a horizontal direction towards front panel face 115 of control panel 114, bezel 704 is moved towards mounting disc 706 along the shafts of first prong 1700, of second prong 1640, of pipe insertion rod 1608, and of center mounting protrusion 1638 against the biasing force of first biasing element 1002 and of second biasing element 1004. First biasing element 1002 and second biasing element 1004 return the knob 702 to the initial position.

First fastener 1006 is inserted through first fastener nut interior wall 1822 of first fastener nut 1712, and second fastener 1008 is inserted through second fastener nut interior wall 1824 of second fastener nut 1714 to mount mounting disc 706 to valve 714.

An end of light assembly 710 is sized and shaped to fit within light assembly aperture wall 1800 of mounting disc 706. To mount light assembly 710 to mounting disc 706, the end of light assembly 710 that includes light source 2002 is inserted through light assembly aperture wall 1800.

Center mounting protrusion 1638 includes a center aperture wall 1802, a first tab protrusion 1804, a first tab 1806, a second tab protrusion 1808, a second tab 1810, a third tab protrusion 1812, a third tab 1814, a first wall extension 1816, a second wall extension 1818, and a third wall extension 1820. Center aperture wall 1802 is mounted to bottom wall 1710 and forms an aperture through which knob control rod 1014 is inserted. First tab protrusion 1804, second tab protrusion 1808, third tab protrusion 1812, first wall extension 1816, second wall extension 1818, and third wall extension 1820 extend from center aperture wall 1802 and are separated by openings. First wall extension 1816 is positioned between first tab protrusion 1804 and second tab protrusion 1808. Second wall extension 1818 is positioned between second tab protrusion 1808 and third tab protrusion 1810. Third wall extension 1820 is positioned between third tab protrusion 1810 and first tab protrusion 1804. First tab 1806 extends from a top edge of first tab protrusion 1804. Second tab 1810 extends from a top edge of second tab protrusion 1808. Third tab 1814 extends from a top edge of third tab protrusion 1812. First tab protrusion 1804, first tab 1806, second tab protrusion 1808, second tab 1810, third tab protrusion 1812, third tab 1814, first wall extension 1816, second wall extension 1818, and third wall extension 1820 are sized and shaped to fit within center mounting aperture wall 1624. First tab 1806, second tab 1810, and third tab 1814 are positioned to abut a top surface of top wall 1622 of bezel 704 that surrounds center mounting aperture wall 1624 when knob assembly 700 is assembled.

Referring to FIG. 20, a front perspective view of receptacle 712 is shown in accordance with an illustrative embodiment. Referring to FIG. 21, a back perspective view of receptacle 712 is shown in accordance with an illustrative embodiment. Receptacle 712 may include a receptacle abutment wall 2004, receptacle wall 2006, a light support wall 2008, a first fastener wall 2010, a second fastener wall 2012, a third fastener wall 2100, a fourth fastener wall 2014, and a control rod aperture wall 2102. In the illustrative embodiment, receptacle abutment wall 2004 is circular though receptacle abutment wall 2004 may have other shapes. Receptacle wall 2006, light support wall 2008, first fastener wall 2010, and second fastener wall 2012 mount to and extend upwards from receptacle abutment wall 2004 towards mounting disc 706 when knob assembly 700 is assembled. Light support wall 2008 further defines an aperture formed through receptacle abutment wall 2004. Third fastener wall 2100, fourth fastener wall 2014, and control rod aperture wall 2102 are formed through receptacle abutment wall 2004. First fastener wall 2010, and second fastener wall 2012 are sized and shaped to accept the shafts of first fastener 1006 and second fastener 1008, respectively, to mount mounting disc 706 to receptacle 712. Third fastener wall 2100 and fourth fastener wall 2014 are sized and shaped to accept the shafts of third fastener 1010 and fourth fastener 1012, respectively, to mount receptacle 712 to valve 714 so that rotation of knob 702 directly controls operation of valve 714 by rotating knob control rod 1014 within valve 714. Curved wall 1900 of mounting disc 706 is sized and shaped to fit within receptacle wall 2006 while avoiding light support wall 2008, first fastener wall 2010, and second fastener wall 2012. The bottom surface of bottom wall 1710 abuts an edge 2007 of receptacle wall 2006 of receptacle 712 when knob assembly 700 is assembled.

Spacer 708 is sized and shaped to slide over receptacle wall 2006 and abut a top surface of receptacle abutment wall 2004 before mounting disc 706 is mounted to receptacle 712. Similarly, the one or more additional spacer rings 724 are sized and shaped to slide over receptacle wall 2006 and abut a top surface of spacer 708 or another of the one or more additional spacer rings 724 before mounting disc 706 is mounted to receptacle 712.

Light support wall 2008 is sized and shaped to accept light sleeve 2000 of light assembly 710. In the illustrative embodiment, light support wall 2008 has a horseshoe shape to make room for fourth fastener wall 2014. Light tabs 2003 extend from a bottom edge of light sleeve 2000 to hold light sleeve 2000 adjacent a bottom surface of receptacle abutment wall 2004.

Control rod aperture wall 2102 extends through approximately a center of receptacle abutment wall 2004. Control rod aperture wall 2102 is sized and shaped to accept knob control rod 1014 therethrough.

Figure 22:
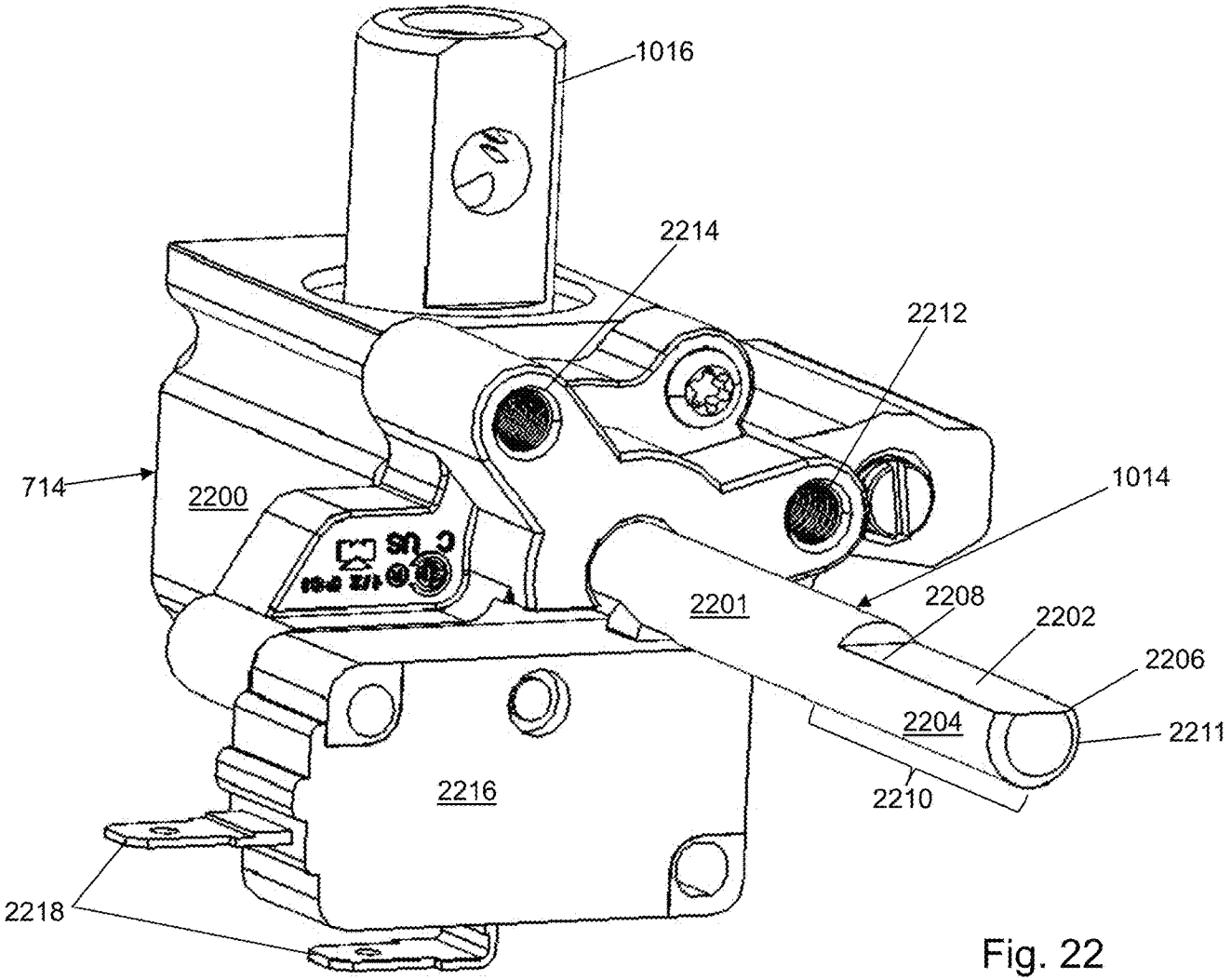
FIG. 22 depicts a front perspective view of a valve of the knob assembly of FIG. 7 in accordance with an illustrative embodiment.
Figure 23:
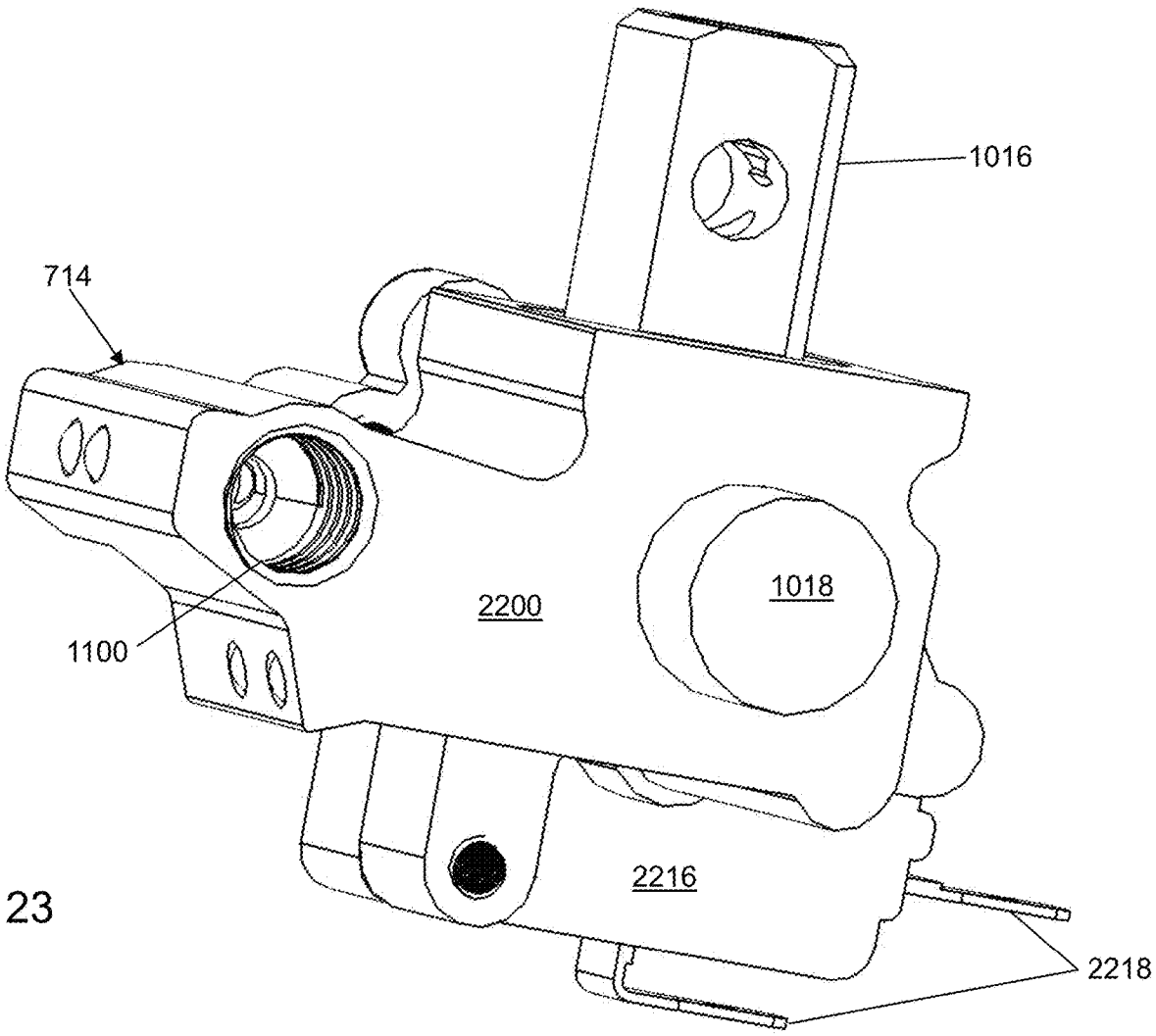
FIG. 23 depicts a back perspective view of the valve of FIG. 22 in accordance with an illustrative embodiment.

Referring to FIG. 22, a front perspective view of valve 714 is shown in accordance with an illustrative embodiment. Referring to FIG. 23, a back perspective view of valve 714 is shown in accordance with an illustrative embodiment. Valve 714 may include a valve housing 2200, knob control rod 1014, input gas line connector port 1016, first burner gas line connector port 1018, second burner gas line connector port 1100, a valve first fastener wall 2212, a valve second fastener wall 2214, a switch housing 2216, and valve power connectors 2218. Knob control rod 1014, input gas line connector port 1016 and first burner gas line connector port 1018 extend from valve housing 2200. Second burner gas line connector port 1100, valve first fastener wall 2212, and valve second fastener wall 2214 are formed in valve housing 2200. Valve first fastener wall 2212 and valve second fastener wall 2214 are sized and shaped to accept the shafts of third fastener 1010 and fourth fastener 1012, respectively, to mount receptacle 712 to valve 714. Switch housing 2216 mounts to valve housing 2200. Valve power connectors 2218 extend from switch housing 2216, which houses a switch (not shown).

A power connector is connected to valve power connectors 2218 to provide power to valve 714. The switch within switch housing 2216 controls power to switch on the igniter and to switch on light source 2002 when knob 702 is depressed and rotated to an ignite or "ON" position. The igniter may be switched off as knob 702 is rotated while light source 2002 may remain lit. In a dual burner, the igniter may be switched on again as knob 702 is rotated to a second "ON" position.

Knob control rod 1014 extends from valve 714 towards knob 702 when knob assembly 700 is assembled. Knob control rod 1014 may include a cylinder 2201 and tip 2210. Tip 2210 may include a control rod flat wall 2202, a control rod curved wall 2204, a first control rod flat wall edge 2206, a second control rod flat wall edge 2208, and tip end 2211. Cylinder 2201 is generally circular and mounts to valve 714. Control rod flat wall 2202 is cut into a portion of cylinder 2201. Control rod flat wall 2202 is mounted upwards when knob assembly 700 is assembled and knob 702 is in an "OFF" position. Rotation of knob 702 rotates knob control rod 1014 because knob mounting aperture wall 1210 does not allow rotation of knob control rod 1014 within knob mounting aperture wall 1210. Control rod curved wall 2204 transitions to mounting control rod flat wall 2202 at first control rod flat wall edge 2206 and at second control rod flat wall edge 2208. Control rod flat wall 2202 approximately aligns with mounting disc flat wall 1702, with bezel flat wall 1614, and with exterior flat wall 1300 when knob assembly 700 is assembled and knob 702 is in the "OFF" position.

Figure 24:
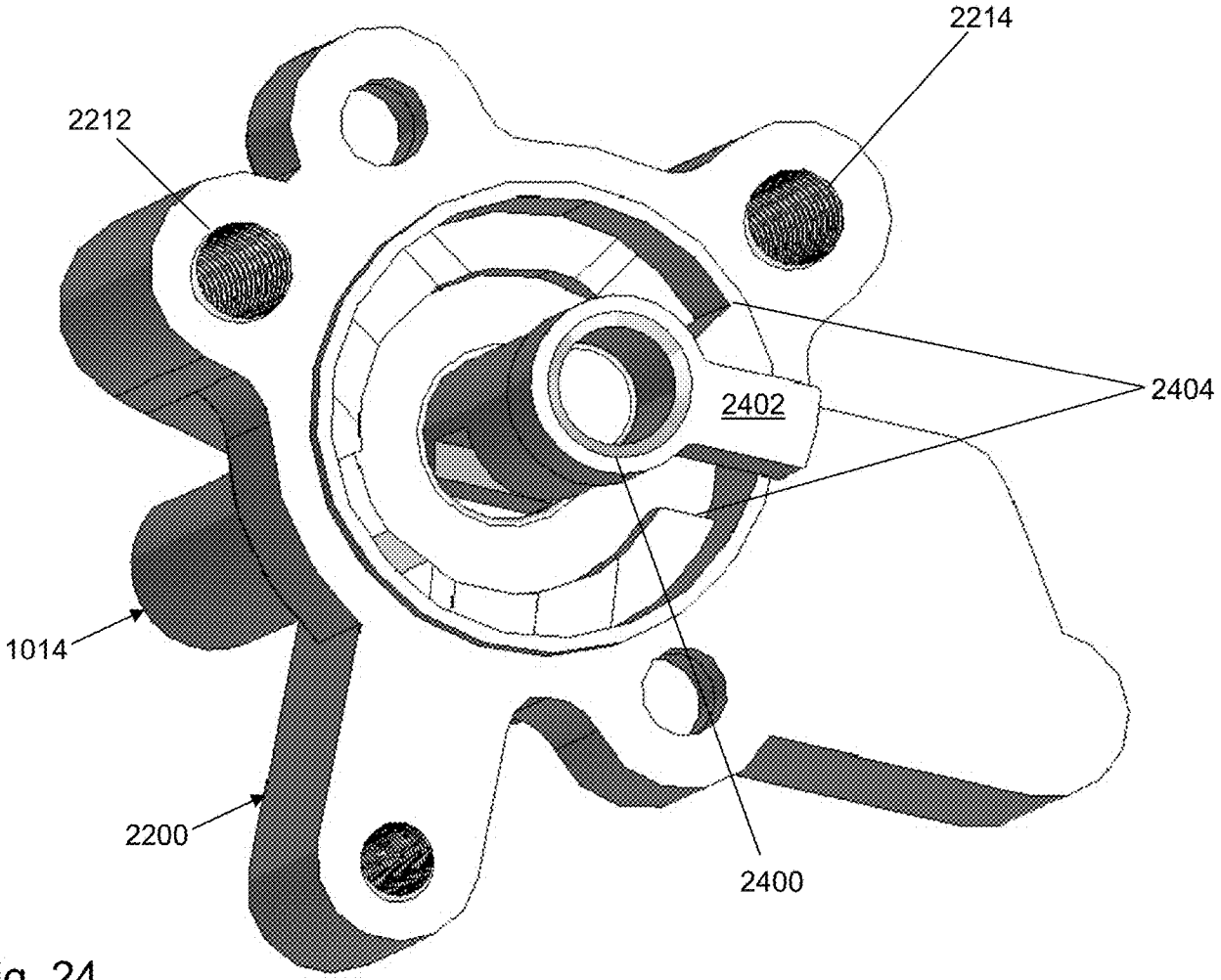
FIG. 24 depicts an interior of the valve of FIG. 22 in accordance with an illustrative embodiment.

Referring to FIG. 24, knob control rod 1014 may include a valve end 2400. Valve end 2400 is an end of knob control rod 1014 opposite tip end 2211. Valve end 2400 is mounted within an interior of valve housing 2200. A blocking protrusion 2402 extends from cylinder 2201 adjacent valve end 2400. Blocking protrusion 2402 extends approximately perpendicular to cylinder 2201. Blocking protrusion 2402 fits within detent walls 2404. When knob 702 is depressed, blocking protrusion 2402 is released from detent walls 2404 to allow rotation of knob 702 to select a burner and control a flame height of the selected burner.

A cone piece (not shown) may mount to valve end 2400. One or more channels may be formed in the cone piece to control the flow of gas from input gas line connector port 1016 to at least one of first burner gas line connector port 1018 or second burner gas line connector port 1100. Knob 702 directly controls operation of valve 714 to provide gas to a respective burner by mounting directly to knob control rod 1014 of valve 714.

To install cooktop 100, knob aperture walls 402 and platform 400 are formed in cabinet 102 at desired locations within the physical constraints of the plurality of slot aperture walls 620 and main line slot aperture wall 621. Main gas line port 618 is mounted to the main gas line. Input gas line connector port 1016 of each valve 714 of each knob assembly 700 is mounted to gas manifold 610. First burner gas line connector port 1018 and second burner gas line connector port 1100 of each valve 714 of each knob assembly 700 are mounted to upper burner gas line 720 and lower burner gas line 722, respectively. Receptacle 712 is mounted to valve 714 using third fastener 1010 and fourth fastener 1012. Spacer 708 and possibly the one or more additional spacer rings 724 of each knob assembly 700 are slid over receptacle wall 2006.

Cooktop 100 is mounted to cabinet 102 by sliding receptacle wall 2006 with spacer 708 and possibly the one or more additional spacer rings 724 of each knob assembly 700 of the plurality of knobs 110 through the knob aperture walls 402. Cooktop mounting flange 104 of cooktop 100 is positioned on platform 400 of cabinet 102. Valve 714, a portion of receptacle 712, spacer 708, and possibly the one or more additional spacer rings 724 of each knob assembly 700 are positioned on an interior side of control panel 114 of cabinet 102. Upper burner gas line 720 and lower burner gas line 722 of each knob assembly 700 and the main gas line may be adjusted in three orthogonal directions relative to control panel 114. The remaining portion of receptacle 712 is positioned within the knob aperture walls 402 so that receptacle abutment wall 2004 or spacer 708, and possibly the one or more additional spacer rings 724 of receptacle 712 abut back panel face 2604 of control panel 114.

Light assembly 710 is inserted through light support wall 2008 of receptacle 712. Curving wall 1900 of mounting disc 706 is slid into receptacle wall 2006 until the bottom surface of bottom wall 1710 of mounting disc 706 abuts edge 2007 of receptacle wall 2006. Mounting disc 706 is mounted to receptacle 712 using first fastener 1006 and second fastener 1008, for example, by inserting a shaft of a screwdriver through first fastener aperture wall 1628 and second fastener aperture wall 1630, respectively. First biasing element 1002 and second biasing element 1004 are slid over first prong 1700 and second prong 1640, respectively. Bezel 704 is slid onto center mounting protrusion 1638, first prong 1700, and second prong 1640 of mounting disc 706. First tab 1806, second tab 1810, and third tab 1814 hold bezel 704 against mounting disc 706. Light pipe 1000 is slid into light pipe aperture wall 1626 of bezel 704 to approximately abut light source 2002. Knob 702 is slid onto knob control rod 1014.

Figure 25:
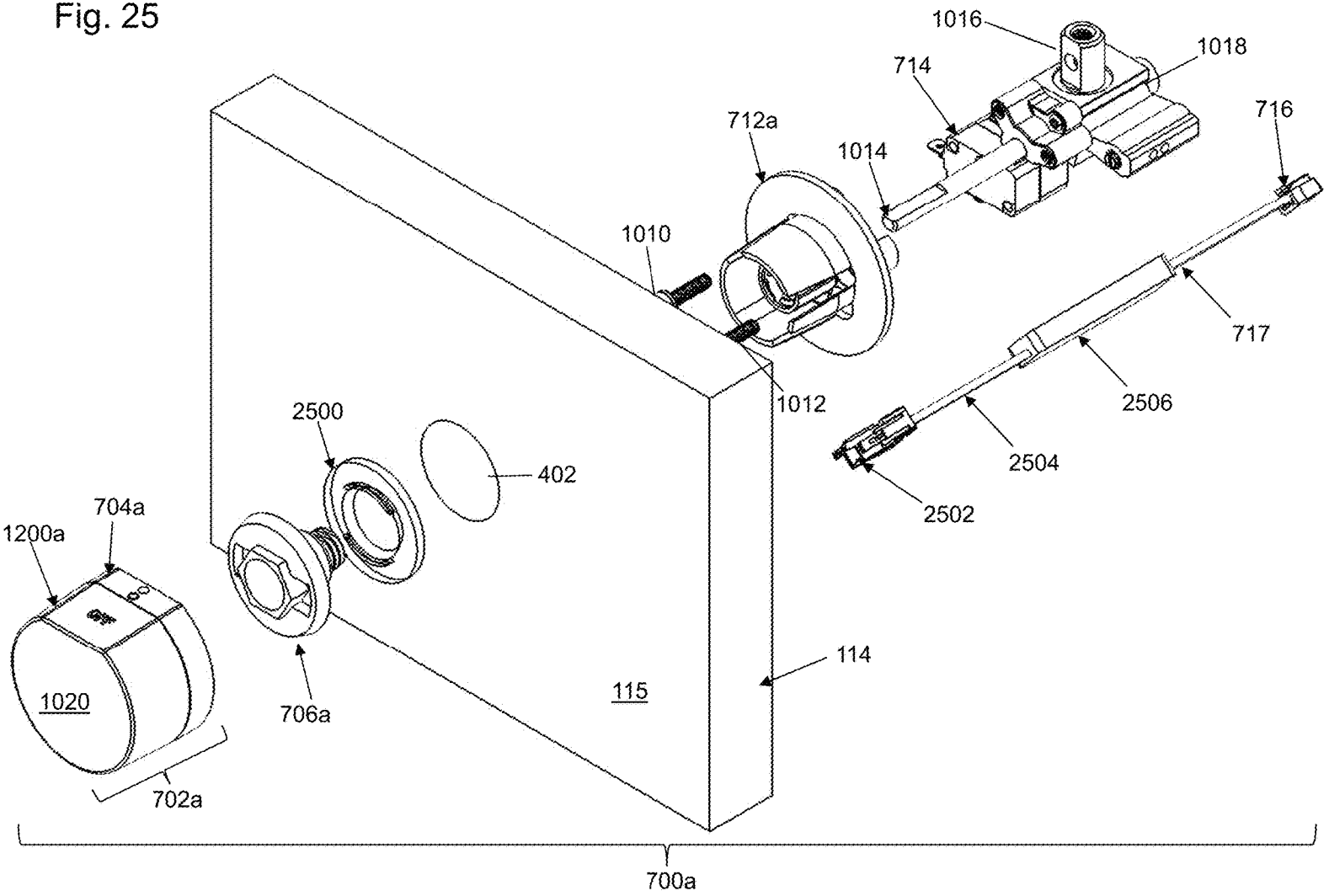
FIG. 25 depicts a top, front exploded view of a second knob assembly of the cooktop of FIG. 1 in accordance with an illustrative embodiment.
Figure 26:
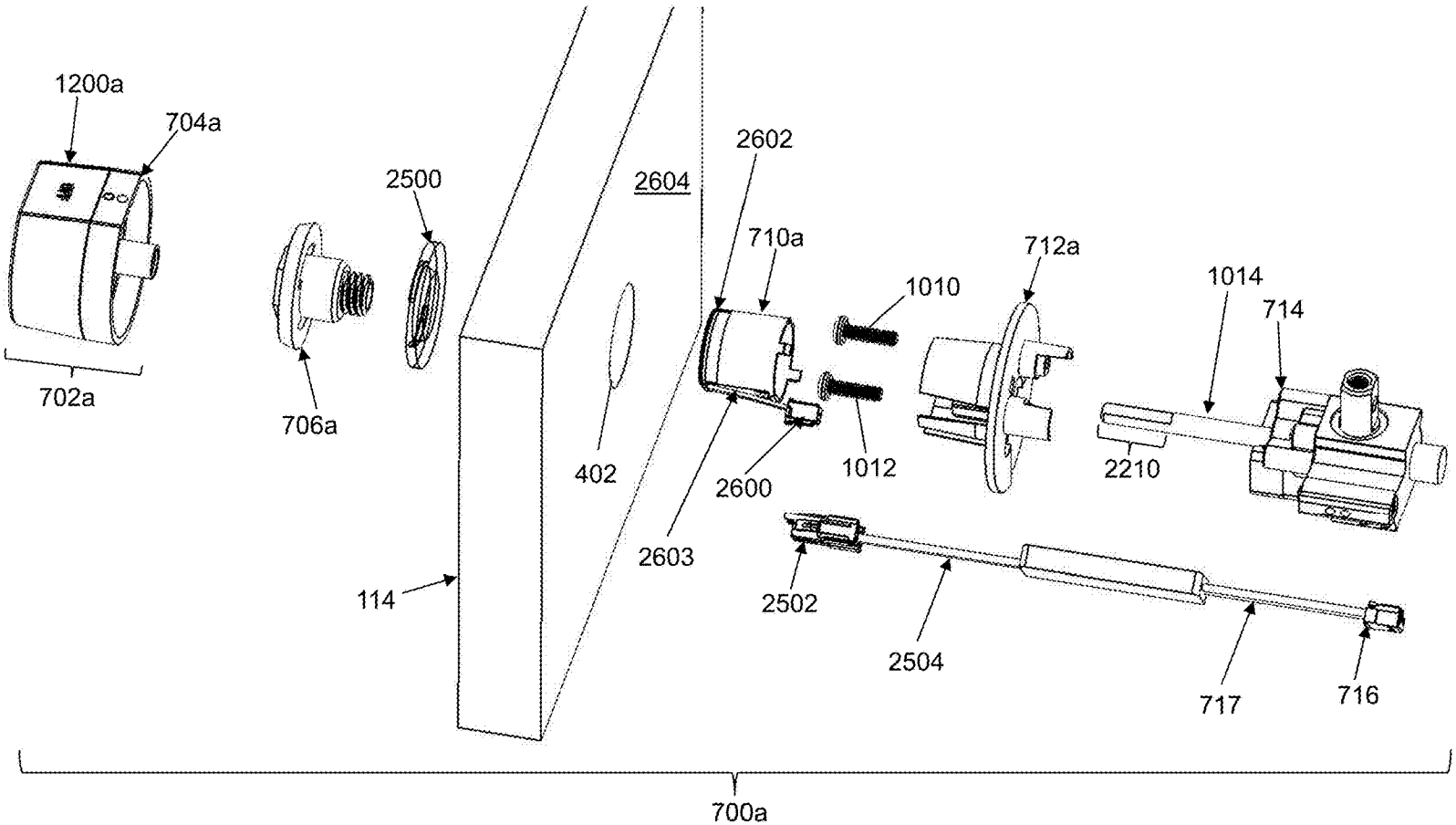
FIG. 26 depicts a top, back exploded view of the second knob assembly of FIG. 25 in accordance with an illustrative embodiment.
Figure 39:
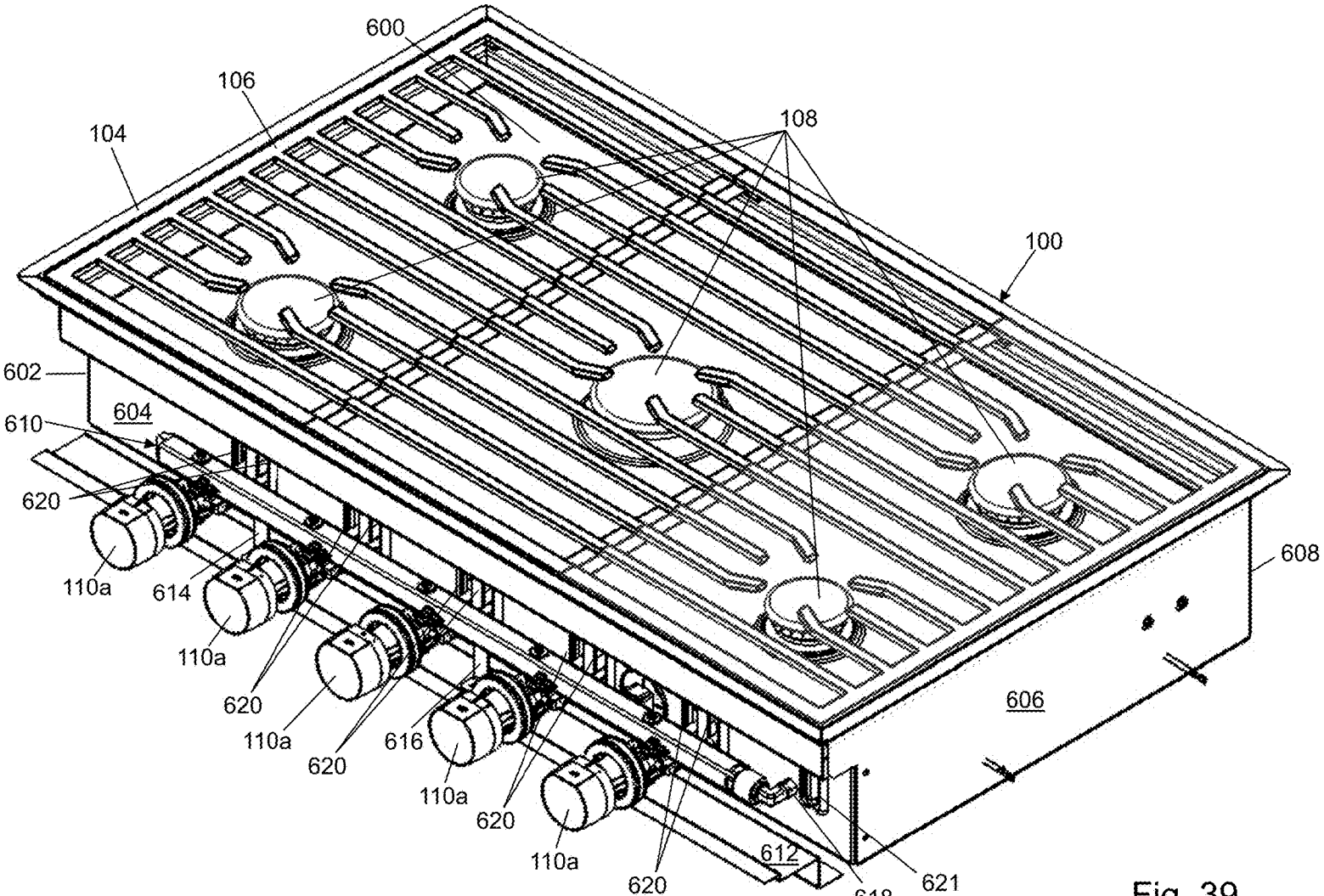
FIG. 39 depicts a top, front perspective view of the cooktop of FIG. 1 in accordance with an illustrative embodiment.
Figure 40:
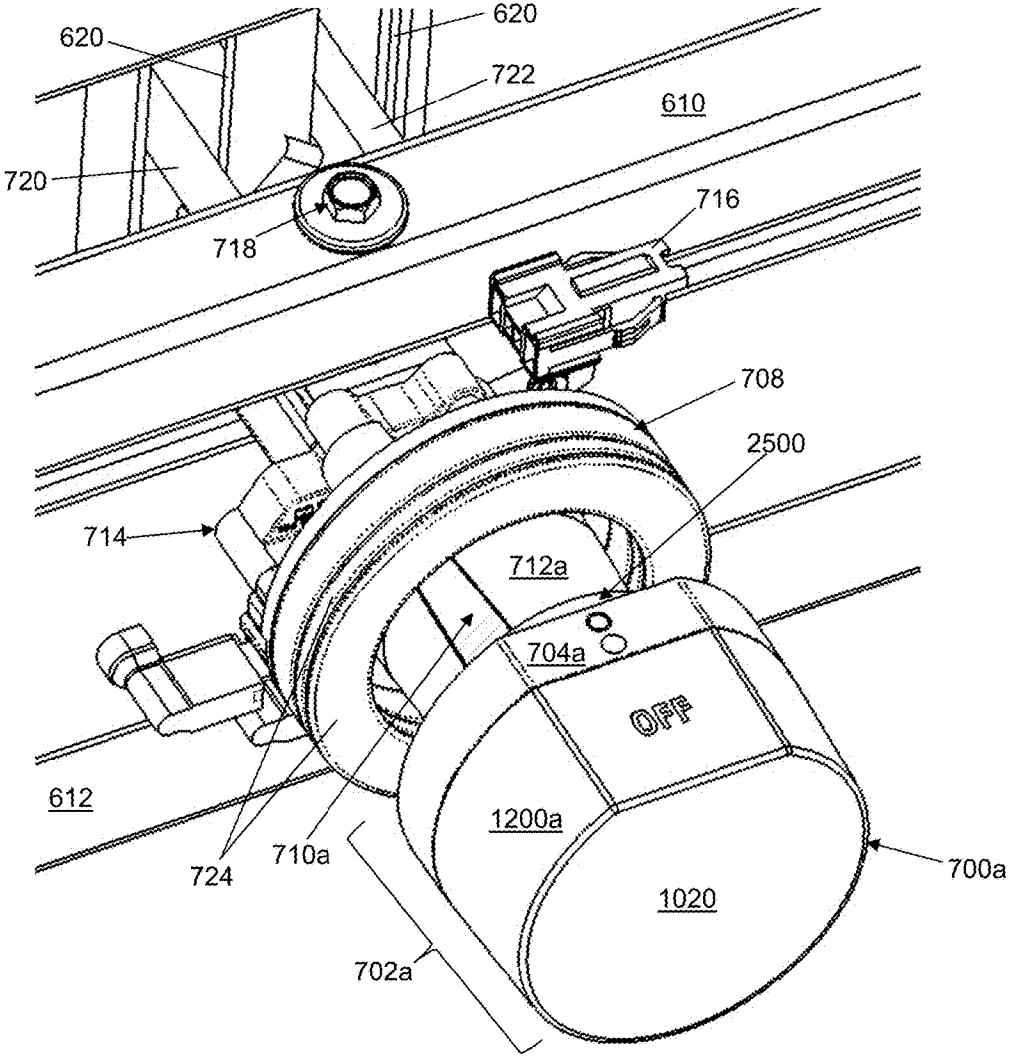
FIG. 40 depicts a zoomed, top, front perspective view of the second knob assembly of FIG. 25 in accordance with an illustrative embodiment.
Figure 41:
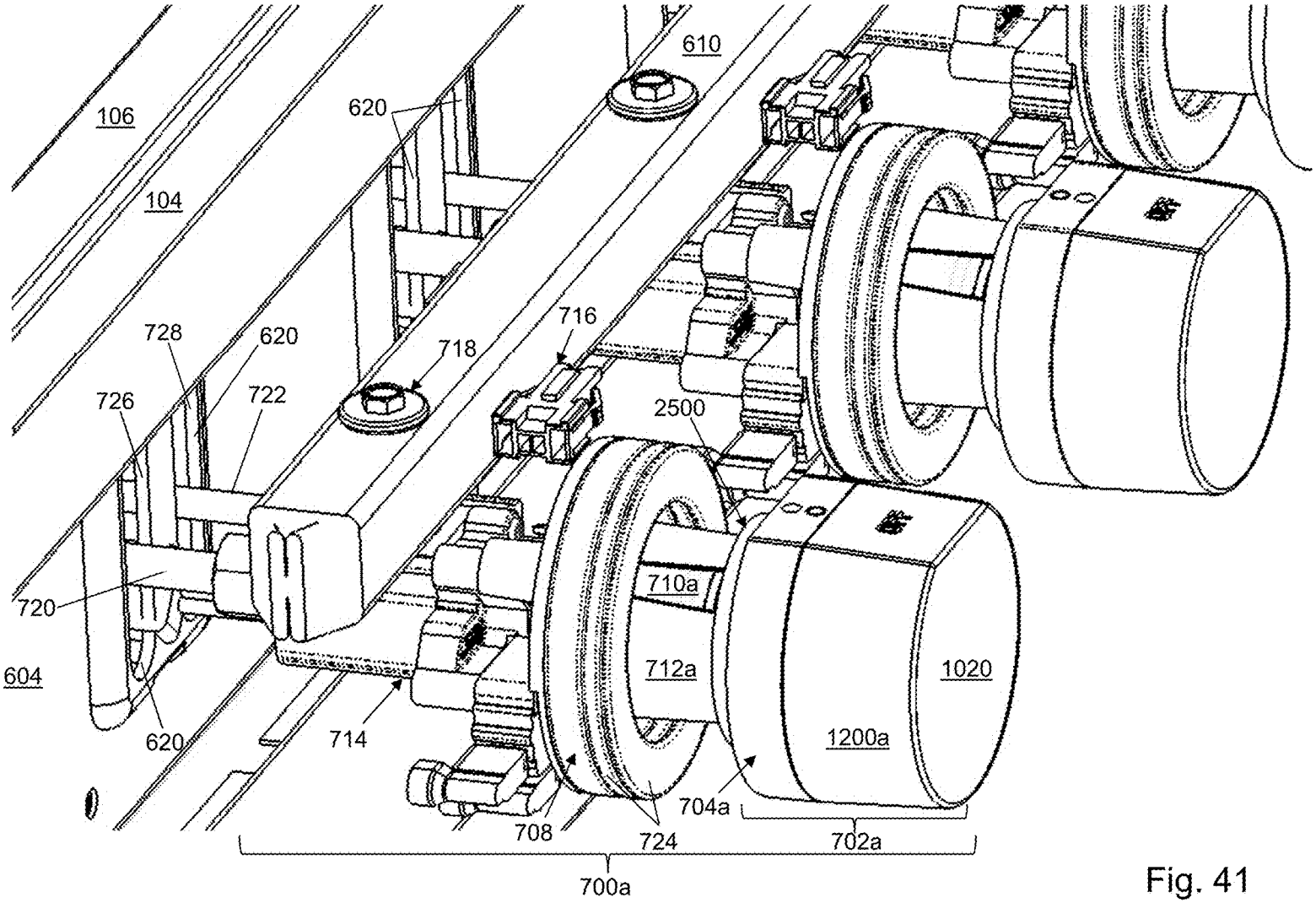
FIG. 41 depicts a zoomed, left perspective view of the second knob assembly of FIG. 25 in accordance with an illustrative embodiment.

Referring to FIG. 39, cooktop 100 is shown without cabinet 102 in accordance with an illustrative embodiment with a second plurality of control knobs 110*a* to replace the plurality of control knobs 110. Referring to FIG. 40, a top, front zoomed perspective view of a second knob assembly 700*a* of the second plurality of control knobs 110*a* is shown in accordance with an illustrative embodiment. Referring to FIG. 41, a left zoomed perspective view of second knob assembly 700*a* is shown in accordance with an illustrative embodiment. Referring to FIG. 25, a front, right exploded view of second knob assembly 700*a* is shown in accordance with an illustrative embodiment. Referring to FIG. 26, a right exploded view of second knob assembly 700*a* is shown in accordance with an illustrative embodiment. Second knob assembly 700*a* may be associated with each of the second plurality of control knobs 110*a* to mount the control knob to the respective burner to control the flame for cooking as described previously with reference to the plurality of control knobs 110.

Second knob assembly 700*a* may include a second knob 702*a*, a second mounting disc 706*a*, a light diffuser 2500, a second light assembly 710*a*, a second receptacle 712*a*, valve 714, light power connector 716, light power connectors 717, a second light power connector 2502, a third light power connector 2600, and a second light source 2602. Second knob assembly 700*a* may further include spacer 708, one or more additional spacer rings 724, valve manifold connector 718, upper burner gas line 720, and lower burner gas line 722 as described previously. Third fastener 1010 and fourth fastener 1012 mount second receptacle 712*a* to valve 714 in a manner similar to that described for knob assembly 700.

Valve 714 regulates gas pressure to the respective burner based on a rotation angle of second knob 702*a* by a consumer. The igniter receives an electrical current and lights the selected burner flame when second knob 702*a* is depressed and rotated to an ignite position. Second knob 702*a* may provide separate rotation angles to control the flow of gas to upper and lower burners separately. Knob control rod 1014 extends from valve 714 towards second knob 702*a* when second knob assembly 700*a* is assembled.

When cooktop 100 is mounted to cabinet 102, the knob aperture walls 402 are positioned between light diffuser 2500 and second receptacle 712*a*, which may or may not include spacer 708 and/or one or more additional spacer rings 724. A distance may be selected between light diffuser 2500 and second receptacle 712*a* based on a thickness of control panel 114 through which the knob aperture walls 402 extend.

Wires 2603 connect third light power connector 2600 to second light source 2602. Third light power connector 2600 mates with second light power connector 2502. Light power connector 716 connects to second light power connector 2502 through an adapter 2506. Light power connectors 717 and second light power connectors 2504 extend from adapter 2506. Light power connectors 717 connect light power connector 716 to adapter 2506. Second light power connectors 2504 connect second light power connector 2502 to adapter 2506. As a result, light power connector 716 provides power to second light source 2602.

Light diffuser 2500 is formed of translucent or refractory material that can diffuse the light emitted by second light source 2602. For illustration, second light source 2602 may be a circular or ring shaped LED. Light diffuser 2500 may be operated to radiate the light from second light source 2602 to indicate the respective burner associated with second knob assembly 700*a* is "On", when second knob assembly 700*a* is pushed towards valve 714.

Figure 27:
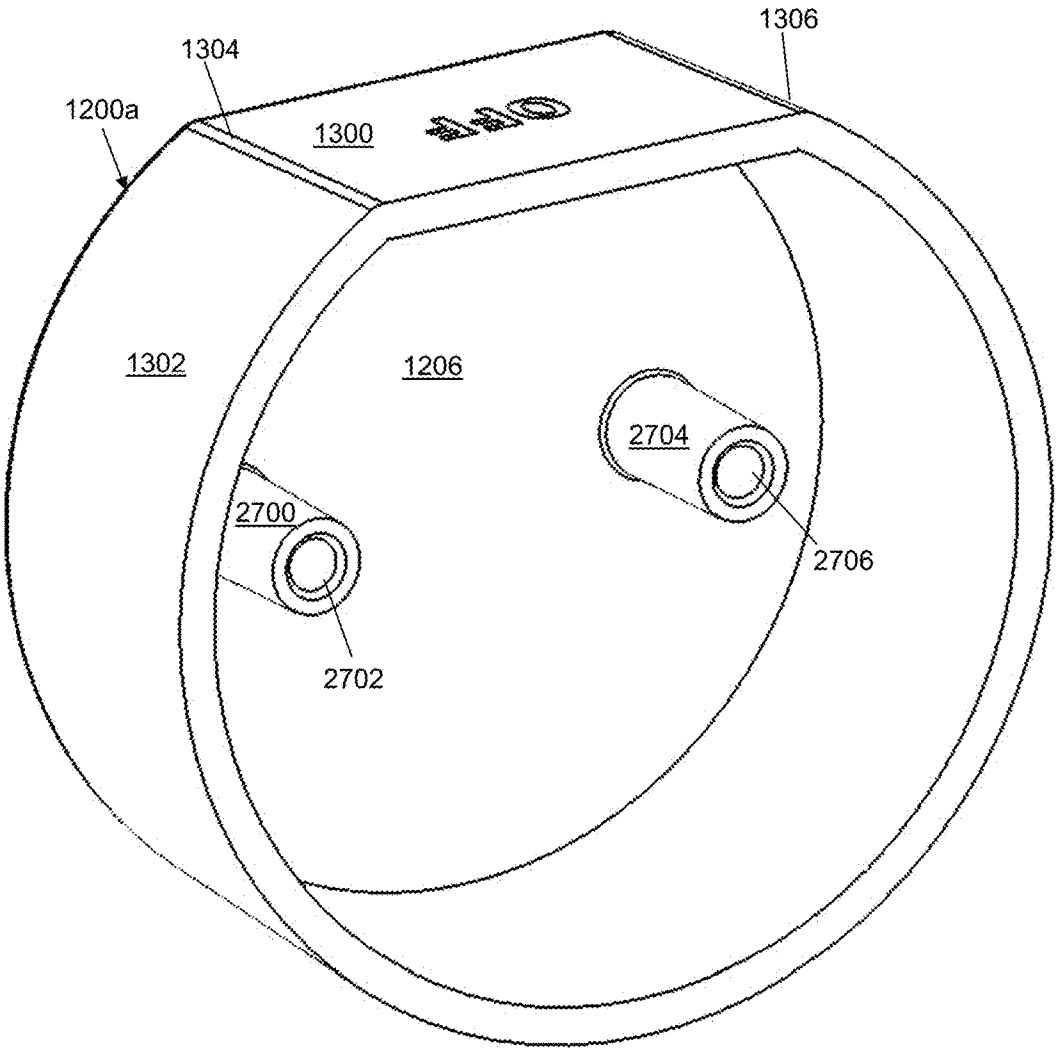
FIG. 27 depicts a back perspective view of a second knob exterior sleeve of a second knob of the second knob assembly of FIG. 25 in accordance with an illustrative embodiment.

Second knob 702*a* may include a second knob exterior sleeve 1200*a* and a second bezel 704*a*. Referring to FIG. 27, a back perspective view of second knob exterior sleeve 1200*a* of second knob 702*a* is shown in accordance with an illustrative embodiment. Second knob exterior sleeve 1200*a* may include knob face 1020, exterior flat wall 1300, exterior curved wall 1302, first exterior flat wall edge 1304, and second exterior flat wall edge 1306. Lettering may be formed on one or more of exterior flat wall 1300 and exterior curved wall 1302 to indicate a burner state of the respective burner.

A first knob-bezel mounting protrusion 2700 may include a fifth fastener aperture wall 2702 formed therein. A second knob-bezel mounting protrusion 2704 may include a sixth fastener aperture wall 2706 formed therein. First knob-bezel mounting protrusion 2700 and second knob-bezel mounting protrusion 2704 extend from an interior face of knob back wall 1206 toward valve 714 when mounted to valve 714. Knob face 1020 forms an exterior face of knob back wall 1206 of second knob exterior sleeve 1200*a*. Fifth fastener aperture wall 2702 and sixth fastener aperture wall 2706 extend into first knob-bezel mounting protrusion 2700 and into second knob-bezel mounting protrusion 2704, respectively, to form a hole sized and shaped to accept a fifth fastener 2900 (shown with reference to FIG. 29) and a sixth fastener 2902 (shown with reference to FIG. 29). Second knob exterior sleeve 1200*a* may have a different shape than that illustrated. A greater or a fewer number of fastener aperture walls may be included.

Figure 28:
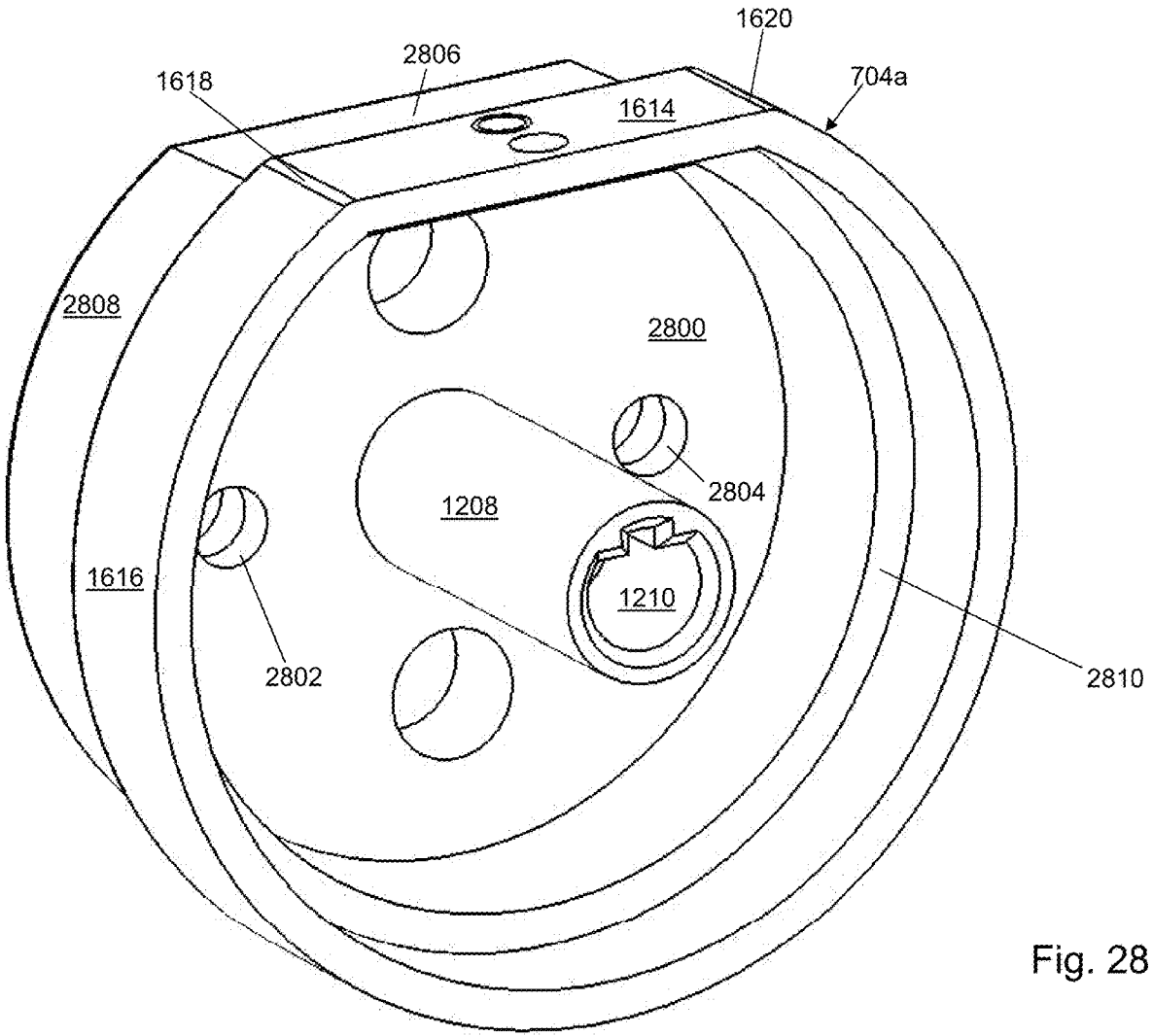
FIG. 28 depicts a back perspective view of a second bezel of the second knob assembly of FIG. 25 in accordance with an illustrative embodiment.

Referring to FIG. 28, a back perspective view of second bezel 704*a* is shown in accordance with an illustrative embodiment. Second bezel 704*a* may include bezel flat wall 1614, bezel curved wall 1616, first bezel flat wall edge 1618, and second bezel flat wall edge 1620. Lettering may be formed on one or more of bezel flat wall 1614 and bezel curved wall 1616 to indicate a burner state of the respective burner. Second bezel 704*a* further may include a bezel back wall 2800, a seventh fastener aperture wall 2802, an eighth fastener aperture wall 2804, a second bezel flat wall 2806, a second bezel curved wall 2808, and a shelf 2810. Seventh fastener aperture wall 2802 and eighth fastener aperture wall 2804 are formed through bezel back wall 2800 and sized, shaped, and positioned to allow insertion of first knob-bezel mounting protrusion 2700 and second knob-bezel mounting protrusion 2704 therethrough when second knob exterior sleeve 1200*a* is mounted to second bezel 704*a* to form second knob 702*a*. Bezel back wall 2800, second bezel flat wall 2806, and second bezel curved wall 2808 are sized and shaped to fit within exterior flat wall 1300 and exterior curved wall 1302, respectively, of second knob exterior sleeve 1200*a* when second knob exterior sleeve 1200*a* is mounted to second bezel 704*a*.

In the illustrative embodiment, second bezel flat wall 2806 and second bezel curved wall 2808 are smaller than bezel flat wall 1614 and bezel curved wall 1616. Shelf 2810 extends between second bezel flat wall 2806 and bezel flat wall 1614 and between second bezel curved wall 2808 and bezel curved wall 1616 toward knob mounting protrusion 1208.

Figure 29:
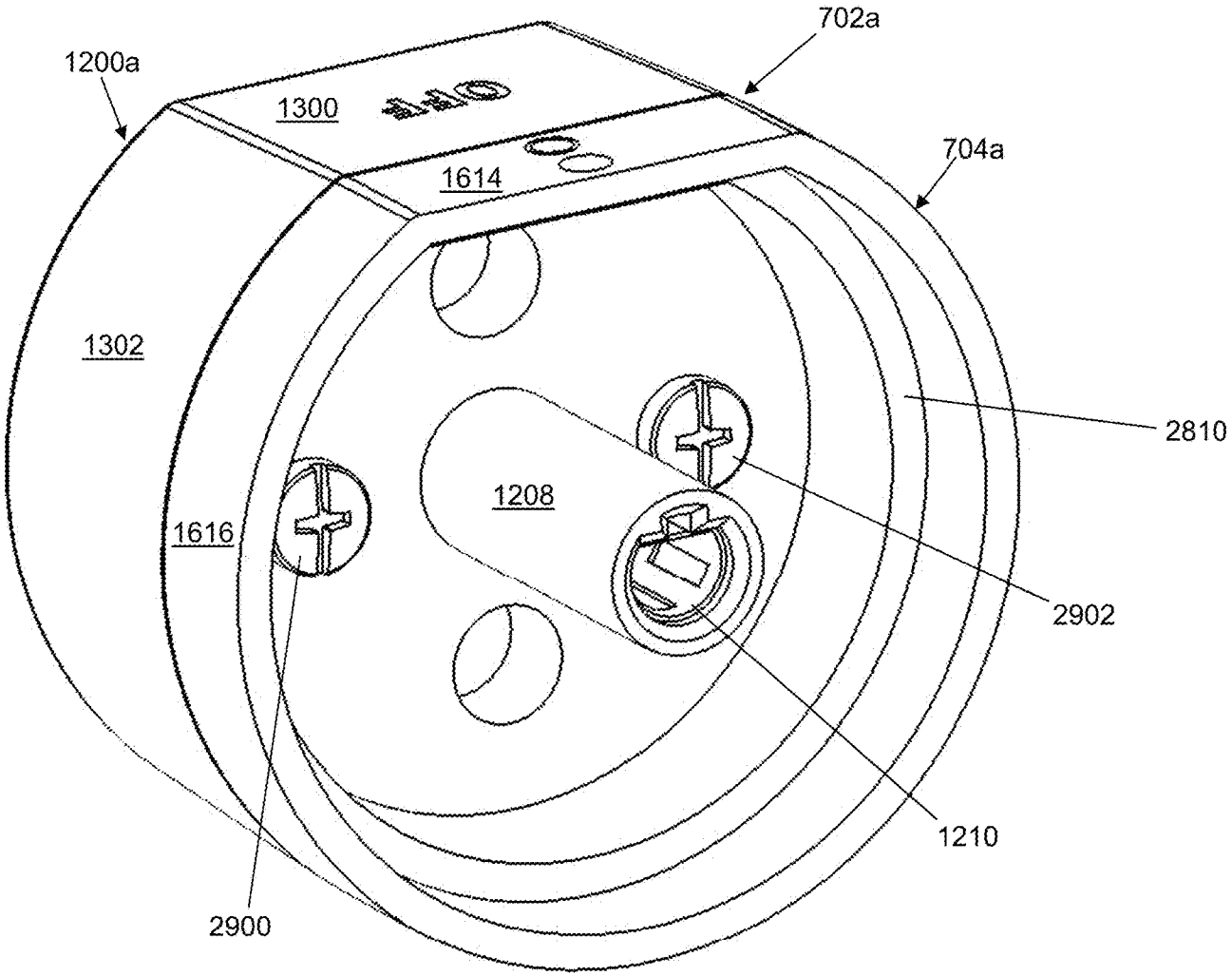
FIG. 29 depicts a back perspective view of the second knob of the second knob assembly of FIG. 25 in accordance with an illustrative embodiment.

Referring to FIG. 29, fifth fastener 2900 and sixth fastener 2902 mount second knob exterior sleeve 1200*a* to second bezel 704*a*. Other mounting structures and methods may be used. For example, second knob exterior sleeve 1200*a* and second bezel 704*a* may be integrally formed together.

Knob mounting protrusion 1208 is mounted to bezel back wall 2800 to extend towards valve 714 when second knob assembly 700*a* is assembled. Knob mounting aperture wall 1210 extends into knob mounting protrusion 1208 to form a hole sized and shaped to accept tip 2210 (shown with reference to FIG. 22) of knob control rod 1014. Tip 2210 of knob control rod 1014 is sized and shaped so that knob control rod 1014 is captured by second knob 702*a* to rotate with second knob 702*a*.

Figure 30:
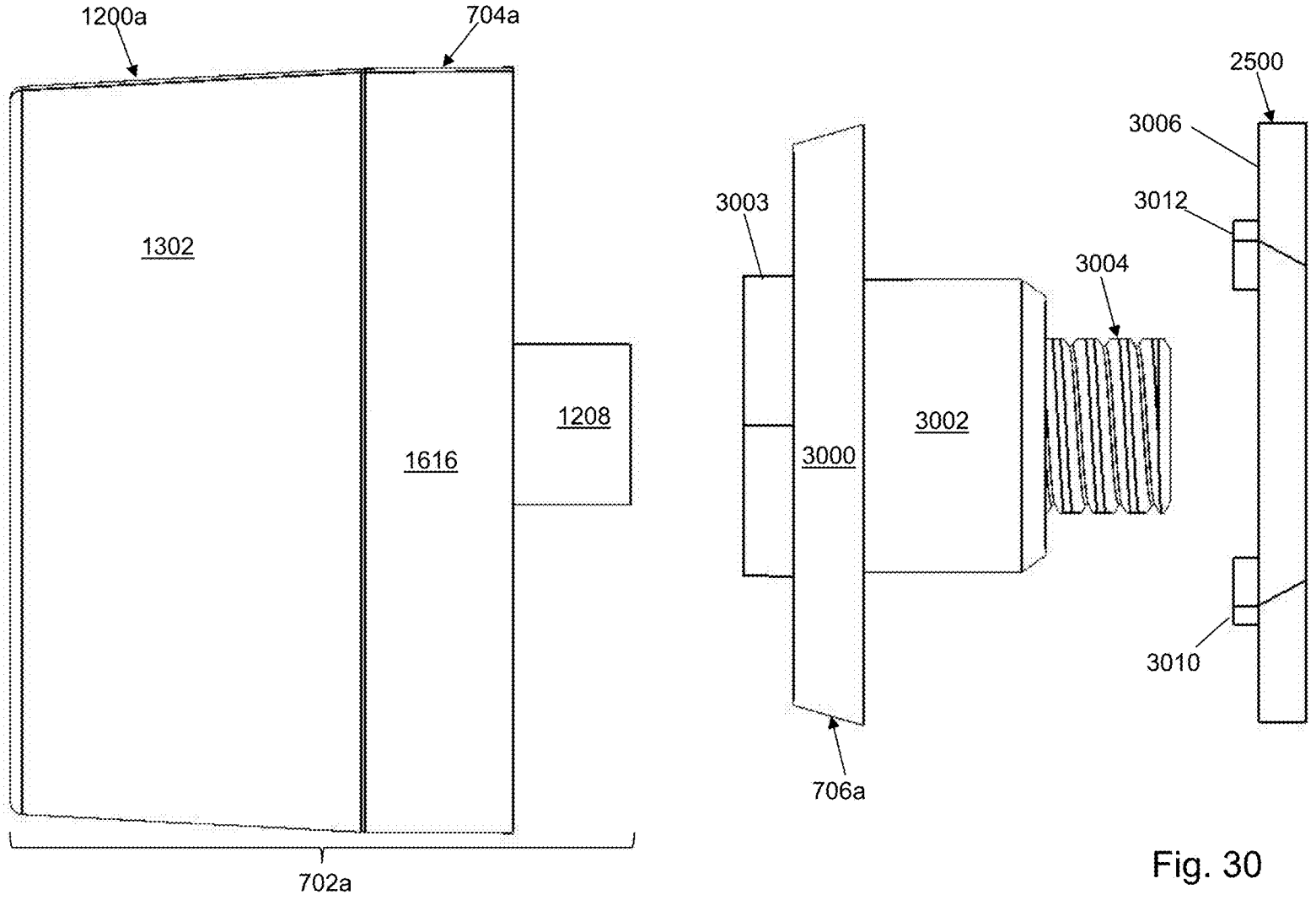
FIG. 30 depicts an exploded, side view of the second knob, a second mounting disc, and a light diffuser of the second knob assembly of FIG. 25 in accordance with an illustrative embodiment.
Figure 31:
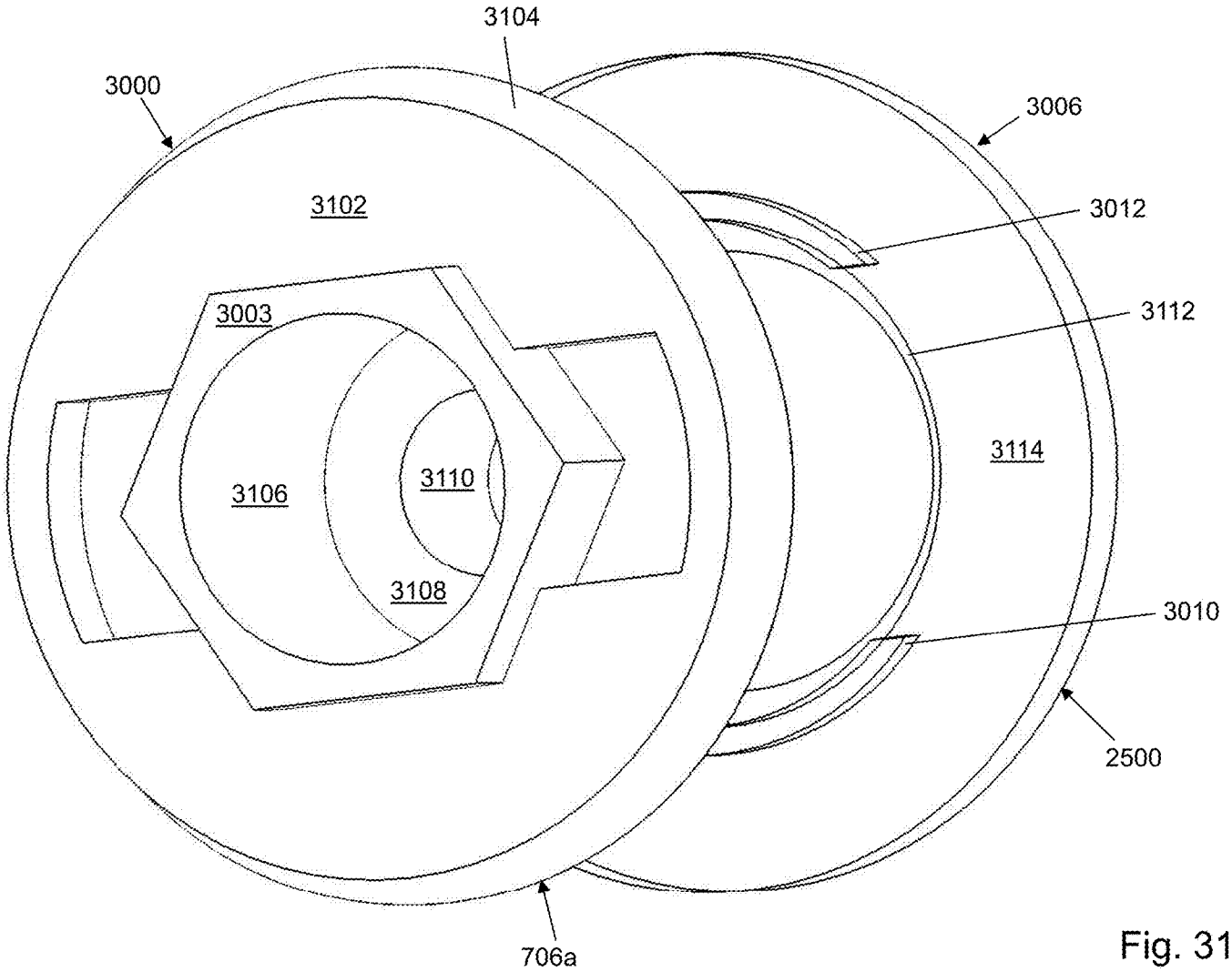
FIG. 31 depicts a front exploded view of the second mounting disc and the light diffuser of FIG. 30 in accordance with an illustrative embodiment.
Figure 32:
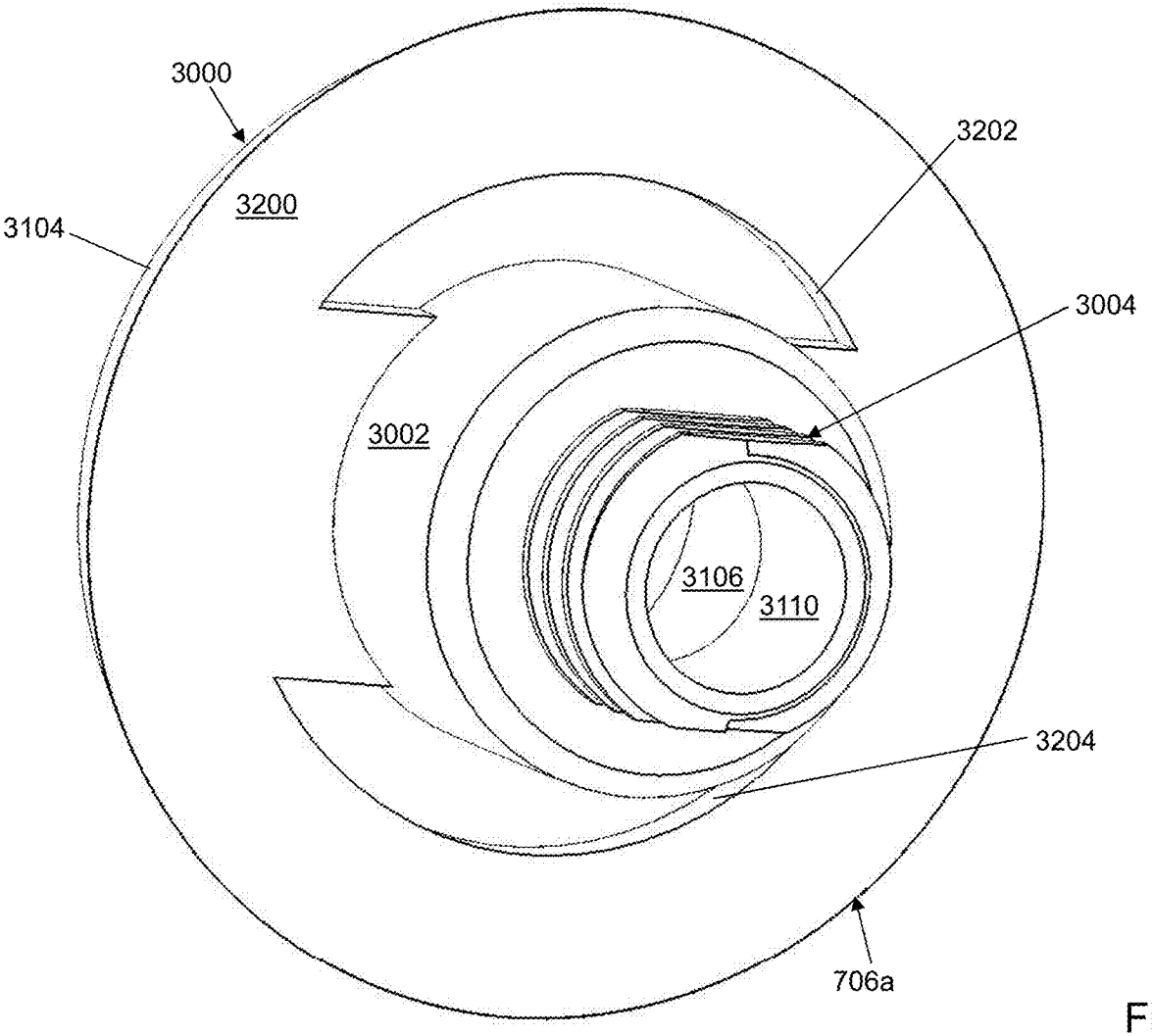
FIG. 32 depicts a back perspective view of the second mounting disc of FIG. 30 in accordance with an illustrative embodiment.
Figure 33:
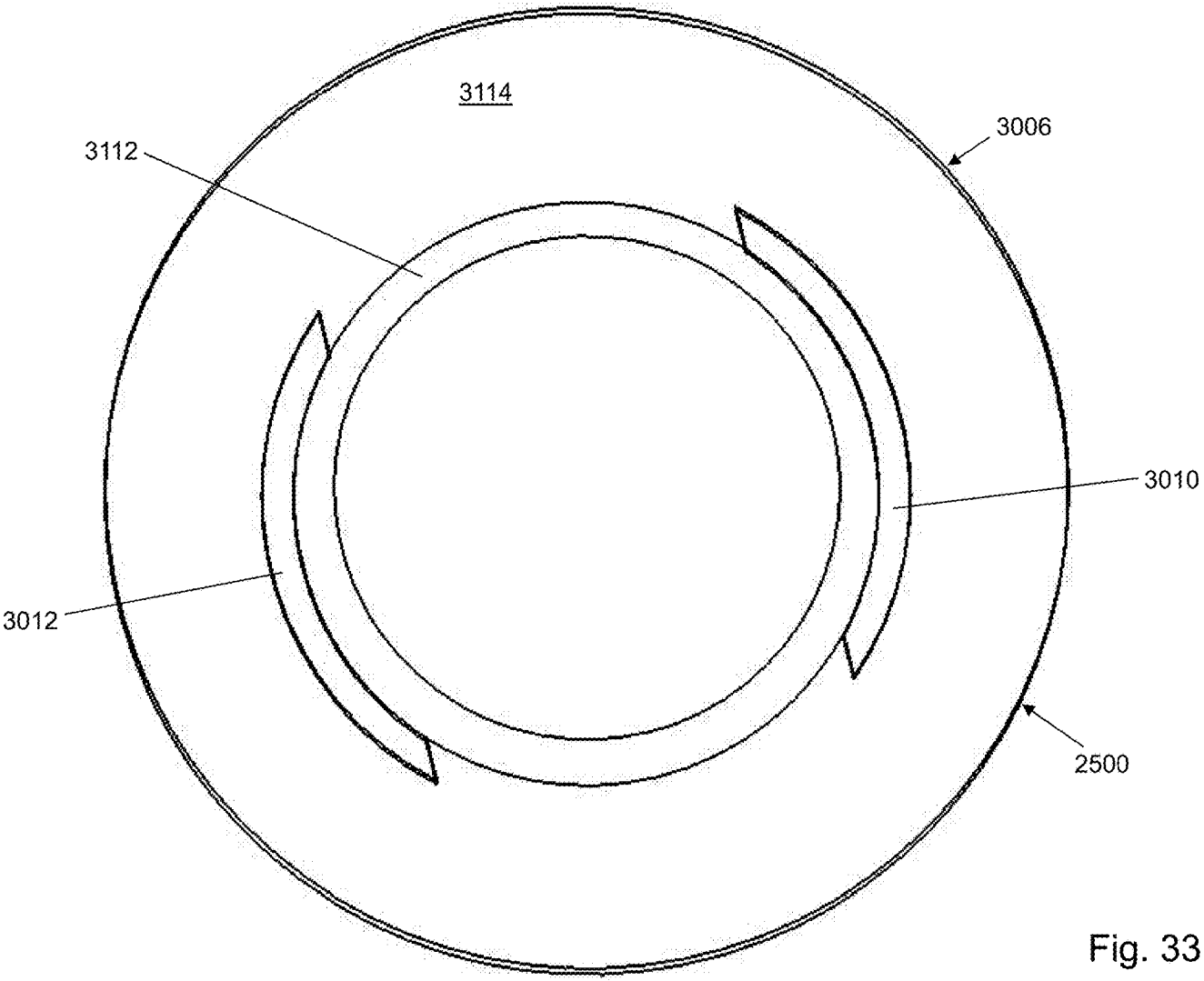
FIG. 33 depicts a front perspective view of the second mounting disc of FIG. 30 in accordance with an illustrative embodiment.

Referring to FIG. 30, a side view of second knob 702*a*, second mounting disc 706*a*, and light diffuser 2500 is shown in accordance with an illustrative embodiment. Referring to FIG. 31, a front view of second mounting disc 706*a*, and light diffuser 2500 is shown in accordance with an illustrative embodiment. Referring to FIG. 32, a back view of second mounting disc 706*a* is shown in accordance with an illustrative embodiment. Referring to FIG. 33, a front view of light diffuser 2500 is shown in accordance with an illustrative embodiment.

Referring to FIGS. 30-32, second mounting disc 706*a* may include a mounting disc head 3000, a shaft 3002, a nut 3003, and external threads 3004. In the illustrative embodiment, mounting disc head 3000 is circular though mounting disc head 3000 may have other shapes. Nut 3003 extends from a front face 3102 of mounting disc head 3000 and has a hexagon shape to facilitate mounting of second mounting disc 706*a* to second receptacle 712*a* though nut 3003 may have other shapes.

Nut 3003 and mounting disc head 3000 may be integrated to form a single head of second mounting disc 706*a*. Shaft 3002 extends from a back face 3200 of mounting disc head 3000 and has a cylindrical shape sized to fit within and generally abut a light diffuser aperture wall 3112 of light diffuser 2500. External threads 3004 extend from shaft 3002 towards valve 714 when second mounting disc 706*a* is mounted to second receptacle 712*a*. A first aperture wall 3106 is formed within mounting disc head 3000, shaft 3002, and nut 3003. A second aperture wall 3110 is formed within external threads 3004. A circumference of first aperture wall 3106 may be greater than a circumference of second aperture wall 3110 resulting in a transitional aperture wall 3108 though this is optional. First aperture wall 3106 and second aperture wall 3110 of second mounting disc 706*a* form an opening through which knob control rod 1014 is inserted when second mounting disc 706*a* is mounted to second receptacle 712*a*.

Referring to FIGS. 30, 31, and 33, light diffuser 2500 may include a body 3006, a first mating protrusion 3010, and a second mating protrusion 3012. In the illustrative embodiment, body 3006 is circular though body 3006 may have other shapes. Light diffuser aperture wall 3112 forms an opening through a center of body 3006 though light diffuser aperture wall 3112 need not be located at the center of body 3006. First mating protrusion 3010 and second mating protrusion 3012 extend from a front face 3114 of body 3006 adjacent light diffuser aperture wall 3112. First mating protrusion 3010 and second mating protrusion 3012 may extend from other locations on front face 3114 of body 3006.

Back face 3200 of mounting disc head 3000 may include a first mating indentation 3202 and a second mating indentation 3204 that form an indentation in mounting disc head 3000. First mating protrusion 3010 and second mating protrusion 3012 are sized, shaped, and positioned to fit within first mating indentation 3202 and a second mating indentation 3204 so that rotation of second mounting disc 706*a* also rotates light diffuser 2500. A fewer or a greater number of mating protrusions may be formed on front face 3114 of body 3006. A fewer or a greater number of corresponding mating indentations may be formed in mounting disc head 3000.

Figure 34:
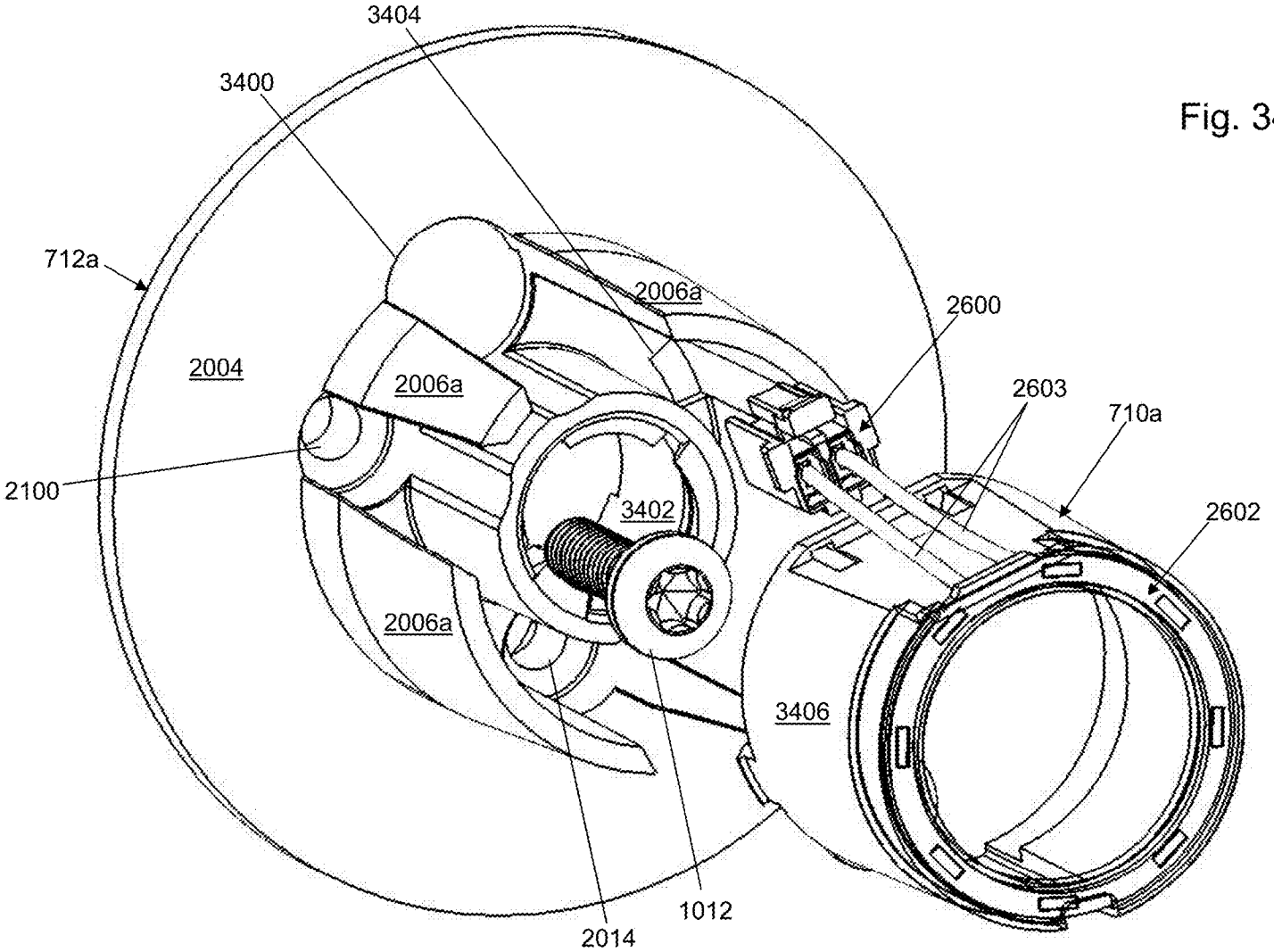
FIG. 34 depicts a front exploded view of a second receptacle and a second light assembly of the second knob assembly of FIG. 25 in accordance with an illustrative embodiment.
Figure 35:
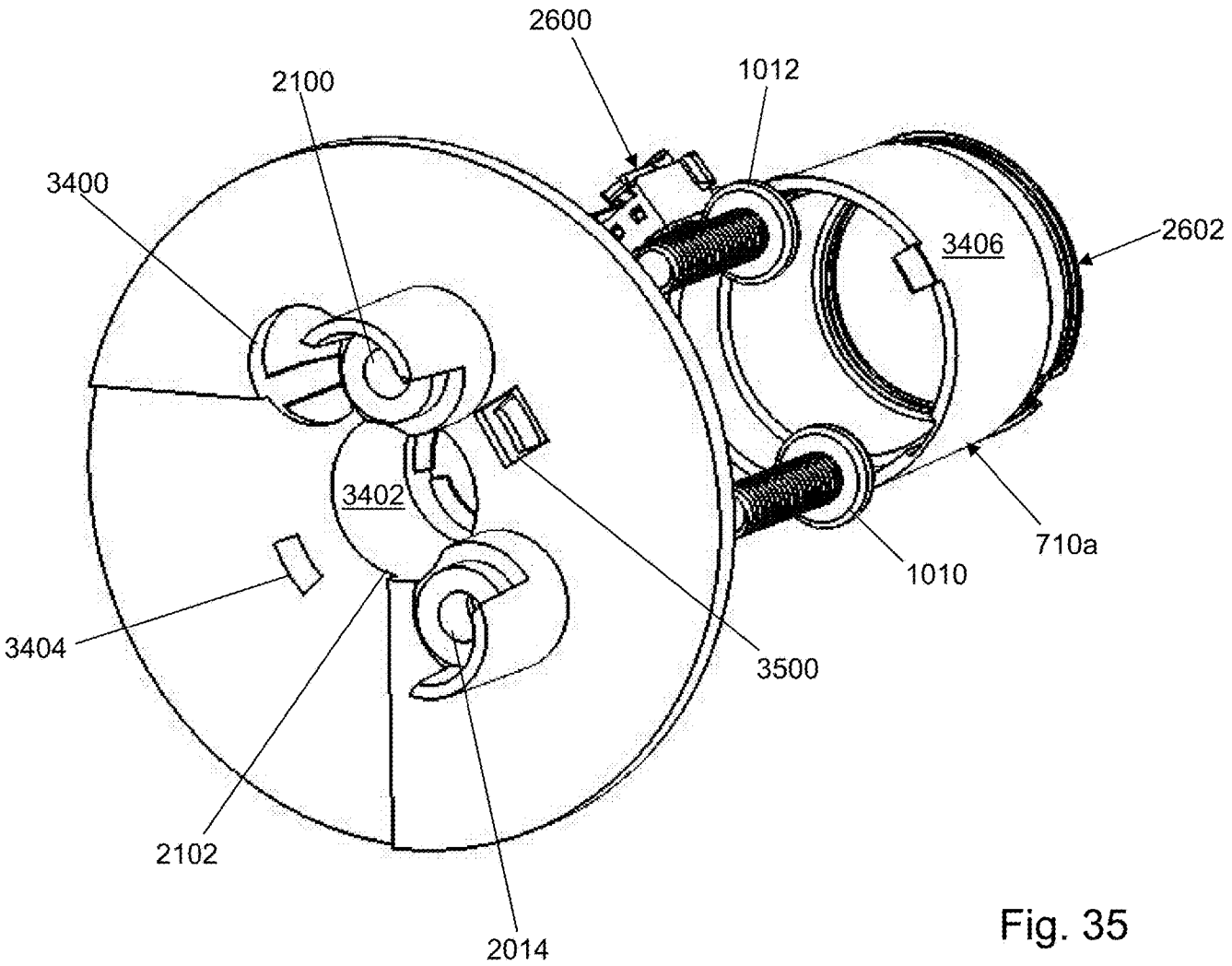
FIG. 35 depicts a back exploded view of the second receptacle and the second light assembly of FIG. 34 in accordance with an illustrative embodiment.
Figure 36:
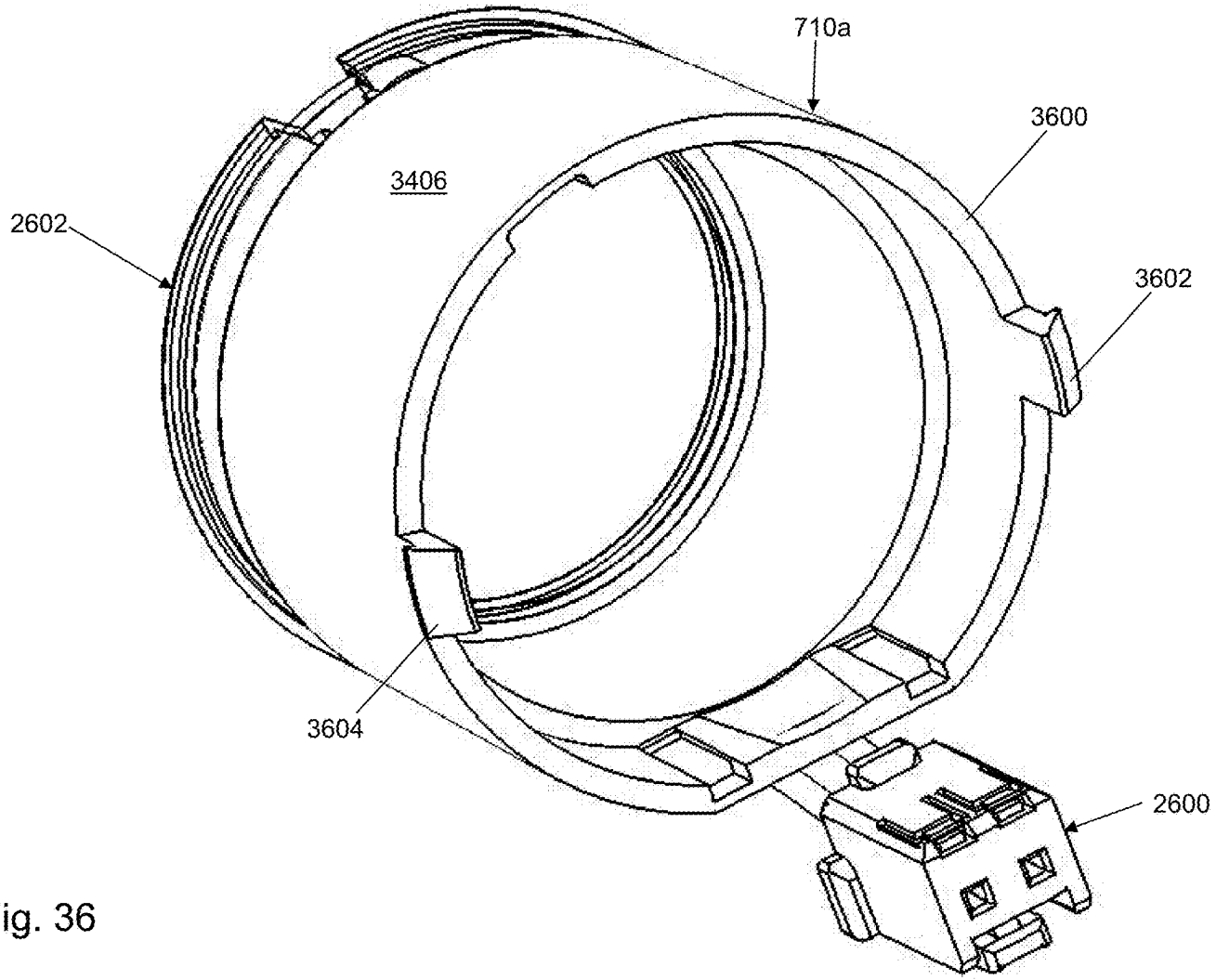
FIG. 36 depicts a back perspective view of the second light assembly of FIG. 34 in accordance with an illustrative embodiment.
Figure 37:
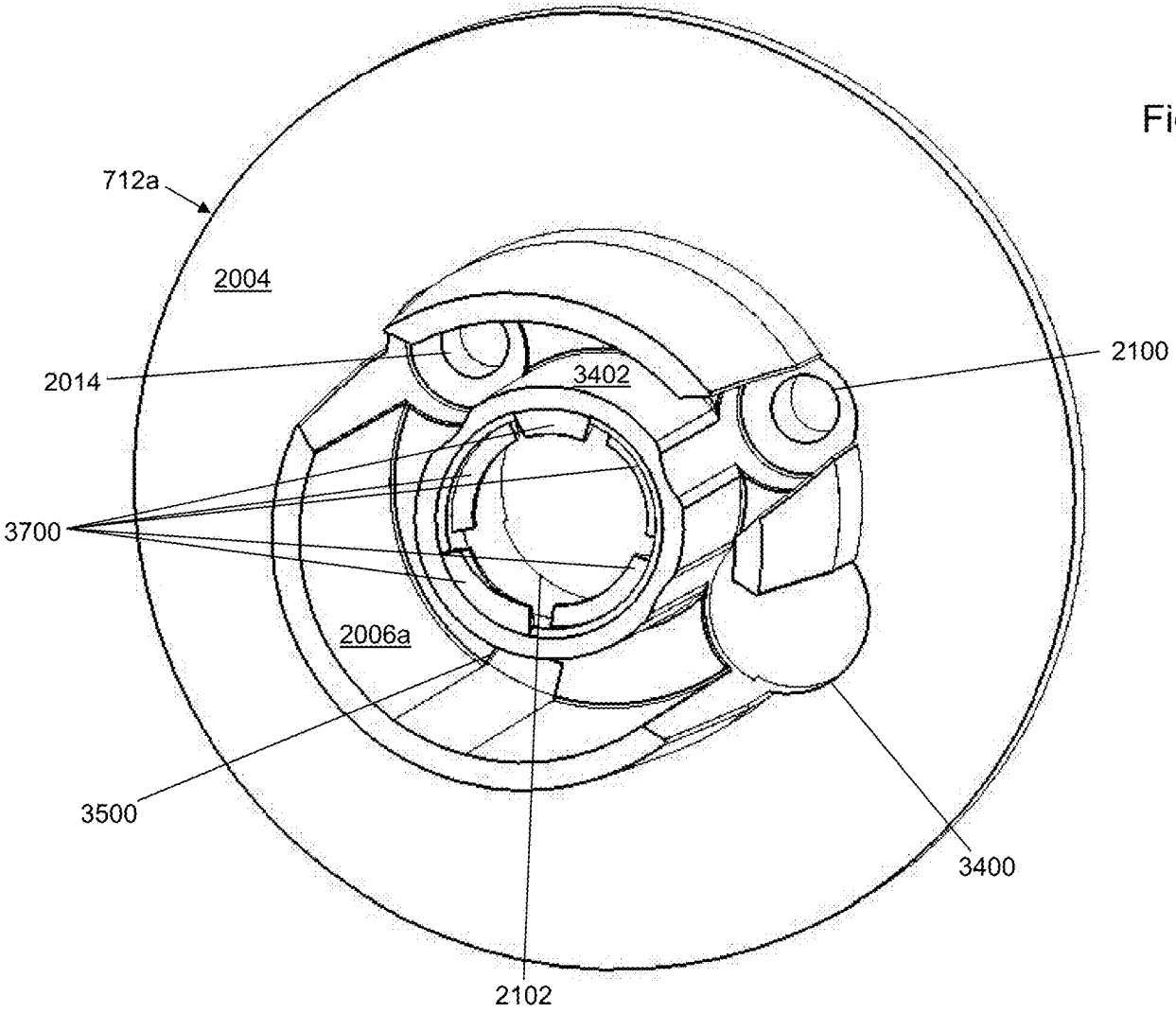
FIG. 37 depicts a back perspective view of the second receptacle of FIG. 34 in accordance with an illustrative embodiment.

Referring to FIG. 34, a front perspective view of second light assembly 710*a* and second receptacle 712*a* is shown in accordance with an illustrative embodiment. Referring to FIG. 35, a back perspective view of second light assembly 710*a* and second receptacle 712*a* is shown in accordance with an illustrative embodiment. Referring to FIG. 36, a back perspective view of second light assembly 710*a* is shown in accordance with an illustrative embodiment. Referring to FIG. 37, a front perspective view of second receptacle 712*a* is shown in accordance with an illustrative embodiment.

Referring to FIGS. 34-36, second light assembly 710*a* may include third light power connector 2600, second light source 2602, wires 2603, and a cylindrical wall 3406. Second light source 2602 is mounted to a front circumferential edge of cylindrical wall 3406. A first tab 3602 and a second tab 3604 extend from a back circumferential edge 3600 of cylindrical wall 3406. In alternative embodiments, cylindrical wall 3406 may have other shapes.

Referring to FIGS. 34, 35, and 37, second receptacle 712*a* may include receptacle abutment wall 2004, a second receptacle wall 2006*a*, a light connector wall 3400, third fastener wall 2100, fourth fastener wall 2014, control rod aperture wall 2102, a first tab aperture wall 3404, and a second tab aperture wall 3500. Second receptacle wall 2006*a* mounts to and extends upwards from receptacle abutment wall 2004 towards second light assembly 710*a*. Light connector wall 3400, first tab aperture wall 3404, and second tab aperture wall 3500 are formed through receptacle abutment wall 2004. Light connector wall 3400 defines an aperture formed through receptacle abutment wall 2004 that is sized to accept wires 2603 therethrough when second light assembly 710*a* is mounted to second receptacle 712*a*. First tab aperture wall 3404 and second tab aperture wall 3500 define apertures formed through receptacle abutment wall 2004 that are sized and shaped to accept first tab 3602 and second tab 3604 therethrough to mount second light assembly 710*a* to second receptacle 712*a*. Cylindrical wall 3406 of second light assembly 710*a* is sized and shaped to fit within second receptacle wall 2006*a* when second light assembly 710*a* is mounted to second receptacle 712*a*.

A threaded aperture wall 3402 extends from control rod aperture wall 2102 upwards from receptacle abutment wall 2004 towards second light assembly 710*a*. At least a portion of an interior of threaded aperture wall 3402 includes interior threads 3700. Interior threads 3700 extend towards an interior of threaded aperture wall 3402 and are sized and shaped to mate with external threads 3004 of second mounting disc 706*a*.

Figure 38:
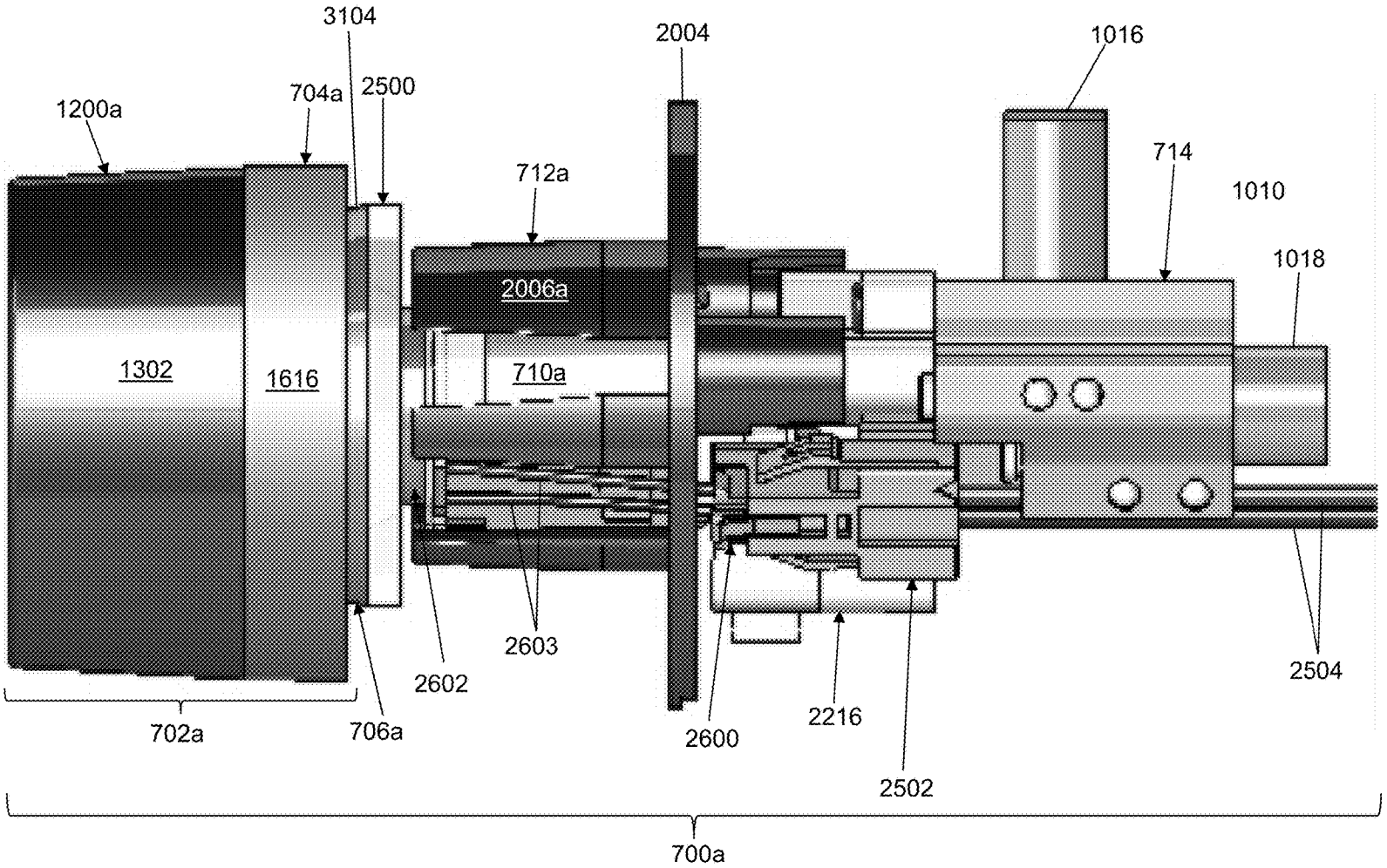
FIG. 38 depicts a side view of the second knob assembly of the cooktop of FIG. 1 in accordance with an illustrative embodiment.

Referring to FIG. 38, assembled second knob assembly 700*a* is shown in accordance with an illustrative embodiment without control panel 114 which is positioned between light diffuser 2500 and receptacle abutment wall 2004 of second receptacle 712*a*. To install cooktop 100, knob aperture walls 402 and platform 400 are formed in cabinet 102. Input gas line connector port 1016 of each valve 714 of each second knob assembly 700*a* is mounted to gas manifold 610. First burner gas line connector port 1018 and second burner gas line connector port 1100 of each valve 714 of each second knob assembly 700*a* are mounted to upper burner gas line 720 and lower burner gas line 722, respectively.

Second receptacle 712*a* is mounted to valve 714 using third fastener 1010 and fourth fastener 1012. Spacer 708 and possibly the one or more additional spacer rings 724 of each second knob assembly 700*a* are slid over second receptacle wall 2006*a*, if needed. Second light assembly 710*a* is mounted to second receptacle 712*a* by inserting first tab 3602 and second tab 3604 of second light assembly 710*a* into first tab aperture 3404 and second tab aperture 3500, respectively. Third light power connector 2600 is mated with second light power connector 2502.

Cooktop 100 is mounted to cabinet 102 by sliding second receptacle wall 2006*a* with or without spacer 708 and possibly the one or more additional spacer rings 724 of each second knob assembly 700*a* of the second plurality of knobs 110*a* through the knob aperture walls 402. Cooktop mounting flange 104 of cooktop 100 is positioned on platform 400 of cabinet 102. Valve 714, a portion of second receptacle 712*a*, a portion of second light assembly 710*a*, spacer 708, and possibly the one or more additional spacer rings 724 of each knob assembly 700 are positioned on an interior side of control panel 114 of cabinet 102. The remaining portion of second receptacle 712*a* and of second light assembly 710*a* is positioned within the knob aperture walls 402 so that receptacle abutment wall 2004 or spacer 708, and possibly the one or more additional spacer rings 724 of second receptacle 712*a* abut back panel face 2604 of control panel 114.

Light diffuser 2500 is mounted to second mounting disc 706*a* by aligning first mating protrusion 3010 and second mating protrusion 3012 with first mating indentation 3202 and a second mating indentation 3204, respectively. In an alternative embodiment, second mounting disc 706*a* may include one or more protrusions, and light diffuser 2500 may include one or more corresponding indentations. Second mounting disc 706*a* is mounted to second receptacle 712*a* by aligning external threads 3004 with threaded aperture wall 3402. In an alternative embodiment, second mounting disc 706*a* may be mounted to second receptacle 712*a* by aligning internal threads of second aperture wall 3110 with external threads of threaded aperture wall 3402. Other mounting methods may be used in alternative embodiments. Rotating second mounting disc 706*a* using nut 3003 mates external threads 3004 with interior threads 3700 of threaded aperture wall 3402 abutting light diffuser 2500 with front panel face 115 of control panel 114 adjacent or abutting second light source 2602.

Second bezel 704*a* is mounted to second knob exterior sleeve 1200*a* using fifth fastener 2900 and sixth fastener 2902. Knob mounting aperture wall 1210 of knob mounting protrusion 1208 of second knob 702*a* is mounted to tip 2210 of knob control rod 1014 that protrudes from second mounting disc 706*a*. When second knob 702*a* is rotated, knob control rod 1014 rotates with second knob 702*a* relative to valve housing 2200 as well as relative to second mounting disc 706*a*, light diffuser 2500, second light assembly 710*a*, and second receptacle 712*a*. Second knob 702*a* directly controls operation of valve 714 to provide gas to a respective burner by mounting directly to knob control rod 1014 of valve 714.

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more". Still further, using "and" or "or" in the detailed description is intended to include "and/or" unless specifically indicated otherwise.

The foregoing description of illustrative embodiments of the disclosed subject matter has been presented for purposes of illustration and of description. It is not intended to be exhaustive or to limit the disclosed subject matter to the precise form disclosed, and modifications and variations are possible in light of the above teachings or may be acquired from practice of the disclosed subject matter. The embodiments were chosen and described in order to explain the principles of the disclosed subject matter and as practical applications of the disclosed subject matter to enable one skilled in the art to utilize the disclosed subject matter in various embodiments and with various modifications as suited to the particular use contemplated.

What is claimed is:

1. A knob assembly for a gas cooktop comprising:

a valve comprising a valve housing;

an input gas port mounted to the valve housing and configured to connect to an input gas line to receive gas;

an output gas port mounted to the valve housing; and a knob control rod extending from the valve housing and configured to control a gas flow from the input gas port to the output gas port when the knob control rod is rotated and when the input gas port is connected to an input gas line;

a knob directly mounted to the knob control rod, wherein the knob control rod extends between the knob and the valve housing in a horizontal direction that is parallel to a horizontal plane defined by a horizontal support surface for a cooking receptacle, wherein the knob control rod rotates with the knob when the knob is rotated to control a flame from a cooktop burner positioned below the horizontal support surface, wherein the knob is configured to rotate in a vertical plane perpendicular to the horizontal plane;

a receptacle mounted between the valve and the knob, the receptacle comprising a receptacle abutment wall;

a receptacle wall extending from the receptacle abutment wall;

a control rod aperture wall formed through the receptacle abutment walk a light connector wall formed through the receptacle abutment wall and sized and positioned to support insertion of a light power connector therethrough; and a plurality of tab aperture walls that extend through the receptacle abutment wall, wherein each of the plurality of tab aperture walls is sized and positioned to support insertion of a tab therethrough; and a light source assembly, wherein the light source assembly comprises a cylindrical wall;

a light source mounted to a front circumferential edge of the cylindrical wall;

the light power connector connected to the light source and configured to provide power to the light source, wherein the cylindrical wall is sized and positioned to support insertion of the knob control rod therethrough when the light source assembly is mounted between the valve and the knob; and a plurality of tabs that extend from a back circumferential edge of the cylindrical wall opposite the light source, wherein each tab of the plurality of tabs is sized and positioned to insert in a respective tab aperture wall of the plurality of tab aperture walls to mount the light source assembly to the receptacle, wherein the control rod aperture wall is sized and positioned to support insertion of the knob control rod therethrough, wherein the receptacle abutment wall is configured to abut a back panel face of a control panel when the knob assembly is mounted to the control panel, wherein the receptacle wall is sized and positioned within a knob aperture wall formed through the control panel when the knob assembly is mounted to the control panel.

2. The knob assembly of claim 1, wherein the knob comprises a knob mounting aperture wall defining a hole sized and shaped to capture a tip of the knob control rod.

3. The knob assembly of claim 1, further comprising a fastener, wherein the receptacle further comprises a fastener wall formed through the receptacle abutment wall, the valve further comprises a valve fastener wall formed on the valve housing, wherein the fastener extends through the fastener wall and into the valve fastener wall to mount the receptacle to the valve housing.

4. The knob assembly of claim 1, wherein the cylindrical wall of the light source assembly fits within the receptacle wall of the receptacle when the light source assembly is mounted to the receptacle.

5. A knob assembly for a gas cooktop comprising:

a valve comprising a valve housing;

an input gas port mounted to the valve housing and configured to connect to an input gas line to receive gas;

an output gas port mounted to the valve housing; and a knob control rod extending from the valve housing and configured to control a gas flow from the input gas port to the output gas port when the knob control rod is rotated and when the input gas port is connected to an input gas line;

a knob directly mounted to the knob control rod, wherein the knob control rod extends between the knob and the valve housing in a horizontal direction that is parallel to a horizontal plane defined by a horizontal support surface for a cooking receptacle, wherein the knob control rod rotates with the knob when the knob is rotated to control a flame from a cooktop burner positioned below the horizontal support surface, wherein the knob is configured to rotate in a vertical plane perpendicular to the horizontal plane;

a receptacle mounted between the valve and the knob, the receptacle comprising a receptacle abutment wall;

a receptacle wall extending from the receptacle abutment wall;

a control rod aperture wall formed through the receptacle abutment wall;

a light connector wall formed through the receptacle abutment wall and sized and positioned to support insertion of a light power connector therethrough; and a light source assembly, wherein the light source assembly comprises a cylindrical wall;

a light source mounted to a front circumferential edge of the cylindrical wall; and the light power connector connected to the light source and configured to provide power to the light source, wherein the cylindrical wall is sized and positioned to support insertion of the knob control rod therethrough when the light source assembly is mounted between the valve and the knob; and a light diffuser configured to mount adjacent the light source, wherein the light diffuser comprises a body and a light diffuser aperture wall formed through the body to support insertion of the knob control rod therethrough when the light source assembly is mounted between the valve and the knob, wherein the light diffuser is configured to abut a front panel face of the control panel when the knob assembly is mounted to the control panel, wherein the control rod aperture wall is sized and positioned to support insertion of the knob control rod therethrough, wherein the receptacle abutment wall is configured to abut a back panel face of a control panel when the knob assembly is mounted to the control panel, wherein the receptacle wall is sized and positioned within a knob aperture wall formed through the control panel when the knob assembly is mounted to the control panel.

6. The knob assembly of claim 5, wherein the cylindrical wall of the light source assembly fits within the receptacle wall of the receptacle when the light source assembly is mounted to the receptacle.

7. The knob assembly of claim 5, wherein the receptacle further comprises a threaded aperture wall that extends from the control rod aperture wall, wherein the threaded aperture wall is sized and positioned to support insertion of the knob control rod therethrough when the receptacle is mounted between the valve and the knob.

8. The knob assembly of claim 7, further comprising a mounting disc, wherein the mounting disc comprises a shaft from which threads extend, wherein the threads are configured to mate with at least a portion of the threaded aperture wall to mount the mounting disc to the receptacle, wherein an aperture is formed within the shaft and the threads to support insertion of the knob control rod therethrough when the mounting disc is mounted to the receptacle.

9. The knob assembly of claim 8, wherein the light diffuser aperture wall shaft is sized and positioned to support insertion of the shaft therethrough when the mounting disc is mounted to the receptacle.

10. The knob assembly of claim 8, wherein the mounting disc further comprises a mounting disc head sized and positioned to abut the light diffuser on a side opposite the light source.

11. The knob assembly of claim 10, wherein the mounting disc head mates with the body of the light diffuser.

12. A gas cooktop comprising:

a housing comprising one or more walls;

a grate mounted between the one or more walls of the housing, the grate forming a horizontal support surface for a cooking receptacle;

a burner mounted below the grate within the one or more walls of the housing;

an input gas line; and a knob assembly comprising a valve comprising a valve housing;

an input gas port mounted to the valve housing and configured to connect to the input gas line to receive gas;

an output gas port mounted to the valve housing; and a knob control rod extending from the valve housing and configured to control a flow of the gas from the input gas port to the output gas port when the knob control rod is rotated;

a knob directly mounted to the knob control rod, wherein the knob control rod extends between the knob and the valve housing in a horizontal direction that is parallel to a horizontal plane defined by the horizontal support surface for the cooking receptacle, wherein the knob control rod rotates with the knob when the knob is rotated to control a flame from the burner, wherein the knob is configured to rotate in a vertical plane perpendicular to the horizontal plane; and a receptacle mounted between the valve and the knob, the receptacle comprising a receptacle abutment wall;

a receptacle wall extending from the receptacle abutment wall; and a control rod aperture wall formed through the receptacle abutment wall, wherein the control rod aperture wall is sized and positioned to support insertion of the knob control rod therethrough, wherein the receptacle abutment wall is configured to abut a back panel face of a control panel when the knob assembly is mounted to the control panel, wherein the receptacle wall is sized and positioned within a knob aperture wall formed through the control panel when the knob assembly is mounted to the control panel.

13. The gas cooktop of claim 12, wherein a front housing wall of the one or more walls of the housing comprises a slot aperture wall formed therethrough, wherein an output gas line connected to the output gas port of the valve extends through the slot aperture wall, wherein the slot aperture wall is sized larger than a size of the output gas line to support movement of the knob assembly in the vertical plane.

14. The gas cooktop of claim 13, wherein the output gas line is formed of a corrugated metal configured to support movement of the knob assembly in the horizontal direction.

15. The gas cooktop of claim 12, wherein the front housing wall further comprises a second slot aperture wall formed therethrough, wherein the input gas line extends through the second slot aperture wall, wherein the second slot aperture wall is sized larger than a size of the input gas line to further support movement of the knob assembly in the vertical plane.

16. The gas cooktop of claim 15, wherein the input gas line is formed of a corrugated metal configured to support movement of the knob assembly in the horizontal direction.

17. The gas cooktop of claim 12, further comprising:

a light source assembly, wherein the light source assembly comprises a cylindrical wall;

a light source mounted to a front circumferential edge of the cylindrical wall; and a light power connector connected to the light source and configured to provide power to the light source, wherein the cylindrical wall is sized and positioned to support insertion of the knob control rod therethrough when the light source assembly is mounted between the valve and the knob; and a light diffuser configured to mount adjacent the light source, wherein the light diffuser comprises a body; and a light diffuser aperture wall formed through the body to support insertion of the knob control rod therethrough when the light source assembly is mounted between the valve and the knob, wherein the light diffuser is configured to abut a front panel face of the control panel when the knob assembly is mounted to the control panel, wherein the receptacle further comprises a light connector wall formed through the receptacle abutment wall and sized and positioned to support insertion of the light power connector therethrough.

18. The gas cooktop of claim 12, wherein the receptacle further comprises a plurality of tab aperture walls that extend through the receptacle abutment wall, wherein each of the plurality of tab aperture walls is sized and positioned to support insertion of a tab therethrough, and further comprising:

a light source assembly, wherein the light source assembly comprises a cylindrical wall;

a light source mounted to a front circumferential edge of the cylindrical wall;

a light power connector connected to the light source and configured to provide power to the light source, wherein the cylindrical wall is sized and positioned to support insertion of the knob control rod therethrough when the light source assembly is mounted between the valve and the knob; and a plurality of tabs that extend from a back circumferential edge of the cylindrical wall opposite the light source, wherein each tab of the plurality of tabs is sized and positioned to insert in a respective tab aperture wall of the plurality of tab aperture walls to mount the light source assembly to the receptacle, wherein the receptacle further comprises a light connector wall formed through the receptacle abutment wall and sized and positioned to support insertion of the light power connector therethrough.

19. The gas cooktop of claim 18, wherein the cylindrical wall of the light source assembly fits within the receptacle wall of the receptacle when the light source assembly is mounted to the receptacle.

20. A method of installing a gas cooktop, the method comprising:

mounting a receptacle to a valve of a gas cooktop, wherein the receptacle comprises a receptacle abutment wall;

a receptacle wall extending from the receptacle abutment wall; and a control rod aperture wall formed through the receptacle abutment wall, wherein the valve is mounted to the gas cooktop and the valve comprises a valve housing;

an input gas port mounted to the valve housing and configured to connect to an input gas line to receive gas;

an output gas port mounted to the valve housing; and a knob control rod extending from the valve housing and configured to control a flow of the gas from the input gas port to the output gas port when the knob control rod is rotated;

positioning the gas cooktop within an opening formed in a counter top by inserting the receptacle wall into a knob aperture wall of a control panel until the receptacle abutment wall abuts a back panel face of the control panel or a spacer that abuts the receptacle abutment wall abuts a back panel face of the control panel, wherein the knob aperture wall is formed through the control panel in a horizontal direction that is parallel to a grate of the gas cooktop, wherein the grate forms a horizontal support surface for a cooking receptacle, wherein the control panel is mounted perpendicular to the horizontal support surface; and mounting a knob directly to the knob control rod such that the knob control rod rotates with the knob when the knob is rotated to control a flame from a burner of the gas cooktop, wherein the control rod aperture wall is sized and positioned to support insertion of the knob control rod therethrough.

* * * * *